US009975358B2

(12) United States Patent
Ito et al.

(10) Patent No.: US 9,975,358 B2
(45) Date of Patent: May 22, 2018

(54) INKJET RECORDING APPARATUS

(71) Applicant: Brother Kogyo Kabushiki Kaisha, Nagoya-shi, Aichi-ken (JP)

(72) Inventors: Tsuyoshi Ito, Nagoya (JP); Yuji Koga, Nagoya (JP); Wataru Sugiyama, Nishio (JP); Kenji Samoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days. days.

(21) Appl. No.: 15/407,503

(22) Filed: Jan. 17, 2017

(65) Prior Publication Data

US 2017/0341429 A1 Nov. 30, 2017

Related U.S. Application Data

(63) Continuation of application No. 14/939,334, filed on Nov. 12, 2015, now Pat. No. 9,550,379, which is a (Continued)

(30) Foreign Application Priority Data

Nov. 28, 2011 (JP) ..... 2011-259493
Apr. 27, 2012 (JP) ..... 2012-104095

(51) Int. Cl.
*B41J 11/00* (2006.01)
*B41J 11/14* (2006.01)
(Continued)

(52) U.S. Cl.
CPC ..... *B41J 11/14* (2013.01); *B41J 2/01* (2013.01); *B41J 11/006* (2013.01); *B41J 11/007* (2013.01);
(Continued)

(58) Field of Classification Search
CPC ..... B41J 11/005; B41J 11/0025; B41J 11/00; B41J 11/0045
See application file for complete search history.

(56) References Cited

U.S. PATENT DOCUMENTS 5,805,176 A 9/1998 Saito et al.
5,874,979 A 2/1999 Ohyama
(Continued)

FOREIGN PATENT DOCUMENTS

CN 101254713 A 9/2008
CN 101804921 A 8/2010
(Continued)

OTHER PUBLICATIONS

Notice of Allowance issued in corresponding U.S. Appl. No. 14/169,862 dated Jul. 15, 2014.
(Continued)

*Primary Examiner* — Huan Tran
(74) *Attorney, Agent, or Firm* — Banner & Witcoff, Ltd.

(57) ABSTRACT

An image forming apparatus may include a mechanism for forming a corrugated shape in a sheet to be conveyed. The mechanism may include various components include one or more pressing portions, one or more ribs, one or more discharge rollers, a switching mechanism and the like. In one arrangement, ribs and pressing portions configured to create the corrugated shape may be disposed at various locations upstream or downstream of the platen, recording portion and/or nozzles thereof. In one example, pressing portions may be disposed both upstream and downstream of the nozzles of the recording portion to maintain a corrugated shape in the conveyed sheet. Various other configurations may be used.

13 Claims, 31 Drawing Sheets

Related U.S. Application Data continuation of application No. 14/225,604, filed on Mar. 26, 2014, now Pat. No. 9,186,917, which is a continuation of application No. 13/628,668, filed on Sep. 27, 2012, now Pat. No. 8,696,109.

(51) Int. Cl.

| | |
|---|---|
| ***B41J 2/01*** | (2006.01) |
| ***B65H 9/00*** | (2006.01) |
| ***B65H 5/06*** | (2006.01) |
| ***B41J 11/06*** | (2006.01) |

(52) U.S. Cl.

CPC ..... *B41J 11/0045* (2013.01); *B41J 11/06* (2013.01); *B65H 5/068* (2013.01); *B65H 9/002* (2013.01); *B41J 11/0025* (2013.01)

(56) References Cited

U.S. PATENT DOCUMENTS

| | | | | |
|---|---|---|---|---|
| 6,503,011 | B2 | 1/2003 | Kono | |
| 6,616,361 | B2 | 9/2003 | Sugiyama | |
| 6,659,603 | B2 | 12/2003 | Kida et al. | |
| 6,712,463 | B2 | 3/2004 | Matsumoto | |
| 6,896,432 | B2 | 5/2005 | Ohyama | |
| 7,232,269 | B2 | 6/2007 | Ohyama | |
| 8,696,109 | B2 * | 4/2014 | Ito | B41J 11/006 347/104 |
| 9,056,505 | B2 | 6/2015 | Ito et al. | |
| 9,186,917 | B2 * | 11/2015 | Ito | B41J 11/006 |
| 9,550,379 | B2 * | 1/2017 | Ito | B41J 11/006 |
| 2003/0025777 | A1 | 2/2003 | Sugiyama | |
| 2003/0048345 | A1 | 3/2003 | Matsumoto | |
| 2004/0126164 | A1 | 7/2004 | Ohyama | |
| 2005/0168557 | A1 | 8/2005 | Ohyama | |
| 2007/0070113 | A1 | 3/2007 | Kawabata et al. | |
| 2008/0205954 | A1 | 8/2008 | Sugiyama et al. | |
| 2010/0207321 | A1 | 8/2010 | Samoto et al. | |
| 2013/0135409 | A1 | 5/2013 | Ito et al. | |
| 2013/0278661 | A1 * | 10/2013 | Terada | B41J 2/04501 347/14 |
| 2014/0146118 | A1 | 5/2014 | Ito et al. | |

FOREIGN PATENT DOCUMENTS

| | | | |
|---|---|---|---|
| CN | 203063275 | U | 7/2013 |
| JP | H07-68871 | A | 3/1995 |
| JP | 7285251 | A | 10/1995 |
| JP | 10-071711 | A | 3/1998 |
| JP | 2000-071532 | A | 3/2000 |
| JP | 2002-308505 | A | 10/2002 |
| JP | 2002-337408 | A | 11/2002 |
| JP | 2004-106978 | A | 4/2004 |
| JP | 2009-006630 | A | 1/2009 |
| JP | 2010-208853 | A | 9/2010 |
| JP | 2011-063035 | A | 3/2011 |

OTHER PUBLICATIONS

First Office Action and Search Report issued in corresponding Chinese Patent Application No. 20121049718 dated Jul. 3, 2014.

Aug. 22, 2014—(U.S.) Notice of Allowance—U.S. Appl. No. 14/169,862.

Feb. 11, 2015—(U.S.) Notice of Allowance—U.S. Appl. No. 14/590,375.

Jun. 30, 2015—(U.S.) Non-Final Office Action—U.S. Appl. No. 14/724,145.

Nov. 30, 2015—(U.S.) Notice of Allowance—U.S. Appl. No. 14/724,145.

Feb. 2, 2016—(JP) Notice of Reasons for Rejection—App 2012-104095, Eng Tran.

* cited by examiner

D/2 (D1/2)
D5
D6
D (D2)
D7
D8
D (D3)
D9
D (D4)
256A
256B
256C
256D
256E
P1
P2
P3
250
251A
251B
251C
251D
252
257
209
207

D (D10)
D (D11)
D (D12)
260A
260B
260C
260D
270
256
251
L
263
263A

INKJET RECORDING APPARATUS

CROSS-REFERENCE TO RELATED APPLICATIONS

This application is a continuation of U.S. patent application Ser. No. 14/939,334 filed Nov. 12, 2015, which is a continuation of U.S. patent application Ser. No. 14/225,604 filed Mar. 26, 2014, issued as U.S. Pat. No. 9,186,917 on Nov. 17, 2015, which is a continuation of U.S. patent application Ser. No. 13/628,668 filed Sep. 27, 2012, issued as U.S. Pat. No. 8,696,109 on Apr. 15, 2014, which claims priority from Japanese Patent Application No. 2012-104095, filed on Apr. 27, 2012, which claims priority from Japanese Patent Application No. 2011-259493, filed on Nov. 28, 2011. The contents of these applications are incorporated herein by reference in their entirety.

TECHNICAL FIELD

Aspects described herein relate to an inkjet recording apparatus that records an image onto a sheet while conveying the sheet maintained in a specified shape.

BACKGROUND

A known inkjet recording apparatus is configured to convey a sheet by a conveyor roller pair while holding the sheet by a platen, record an image onto the sheet held by the platen by ejecting ink droplets from a recording head, and discharge the sheet having the recorded image by a discharge roller pair. The known inkjet recording apparatus is further configured to convey the sheet while maintaining the sheet in a shape having alternating ridge portions and groove portions (hereinafter, also referred to as a "corrugated shape") so as to prevent the sheet on the platen from curling up during the image recording.

The known inkjet recording apparatus includes a plurality of ribs disposed on the platen, a recording-sheet pressing plate, and a plurality of spurs. The recording-sheet pressing plate is disposed between the conveyor roller pair (including a sheet-feeding drive roller and a registration roller) and the recording head with respect to a conveying direction. The plurality of spurs are disposed between the recording head and the discharge roller pair (including a sheet-discharge drive roller and sheet discharge spurs) with respect to the conveying direction.

The plurality of ribs extend parallel to the conveying direction and define grooves therebetween. The recording-sheet pressing plate includes a plurality of protrusions that protrude toward the respective grooves. The plurality of spurs are located in the respective grooves. While the sheet passes between the ribs and the protrusions, the sheet is pressed by the ribs and the protrusions in opposite directions. Therefore, the sheet is formed into a corrugated shape such that the sheet has ridge portions that are held by the ribs and groove portions that are depressed by the protrusions. The corrugated sheet is conveyed while the ridge portions are held by the ribs of the platen, respectively. After the sheet passes the platen, the groove portions of the sheet are depressed by the spurs.

SUMMARY

In the known inkjet recording apparatus, the recording head may continue to eject ink droplets after a trailing edge of the sheet passes the conveyor roller pair with respect to the conveying direction. Therefore, the known inkjet recording apparatus may need to be provided with the plurality of spurs that press the sheet to maintain the sheet in the corrugated shape after the trailing edge of the sheet passes the conveyor roller pair.

However, this configuration may cause a paper jam at the plurality of spurs. More specifically, the ridge portions of the sheet may have the same heights because the ridge portions of the sheet are held by the ribs of the platen when the sheet is conveyed. However, the groove portions of the sheet may have different depths from each other because a degree of curvature of the groove portions in a corrugation pattern of the sheet may become smaller due to ink adhering to the sheet. This decrease in the degree of curvature of the groove portions may also cause a height measured between the ridge portions and the groove portions to decrease. The degree of change in the height between the ridge and groove portions may vary in accordance with, for example, stiffness of the sheet, the environmental conditions, such as moisture and temperature, an amount of ejected ink, or an area where ink is spread on the sheet. Because the depths of the groove portions in the corrugation pattern may vary, a sheet conveying load may increase at the plurality of spurs that press the groove portions of the sheet, and thus, a paper jam may occur.

According to one or more aspects, a configuration that may maintain a sheet in a corrugated shape after the sheet passes a conveyor roller pair and may reduce an occurrence of a paper jam.

In one or more example, an inkjet recording apparatus may comprise a first conveyor configured to nip and convey a sheet along a conveying direction. A platen may be disposed downstream of the first conveyor with respect to the conveying direction. A recording portion may be configured to eject ink droplets from nozzles onto the sheet held by the platen. A corrugate mechanism may be disposed upstream of the nozzles with respect to the conveying direction and configured to form a corrugated shape in the sheet. A plurality of second conveyors may be disposed downstream of the platen with respect to the conveying direction and spaced apart from each other with respect to the width direction. The plurality of second conveyors may be configured to nip and convey the sheet. A pressing portion disposed downstream of nip points of the plurality of second conveyors with respect to the conveying direction. The pressing portion may be configured to come into contact with an upper surface of the sheet by a lower end of the pressing portion and the lower end of pressing portion is located lower than the nip points of the plurality of second conveyors. The pressing portion may be disposed between a pair of second conveyors with respect to the width direction.

In some example, an inkjet recording apparatus may comprise a first conveyor may be configured to nip and convey a sheet along a conveying direction. A platen may be disposed downstream of the first conveyor with respect to the conveying direction. A recording portion may be configured to eject ink droplets from nozzles onto the sheet held by the platen. A corrugate mechanism may be disposed upstream of the nozzles with respect to the conveying direction and configured to form a corrugated shape in the sheet. A plurality of second conveyors may be disposed downstream of the platen with respect to the conveying direction and spaced apart from each other with respect to the width direction. The plurality of second conveyors may be configured to nip and convey the sheet. A first defining member may be disposed downstream of the platen with respect to the conveying direction. A second defining member may be disposed opposite to the first defining member and defining a conveying path between the second defining member and the first defining member. A pressing portion may be disposed on the second defining member and located at or downstream of nip points of the plurality of second conveyors with respect to the conveying direction. The second pressing portion has a protruding end that protrudes toward the first defining member. The protruding end of the pressing portion may be located closer to the first defining member than the nip points of the plurality of second conveyors.

In other example, an inkjet recording apparatus may comprise a conveyor configured to nip and convey a sheet along a conveying direction. A platen may be disposed downstream of the conveyor with respect to the conveying direction and configured to hold the sheet conveyed by the conveyor. A recording head may be disposed opposite to the platen and configured to eject ink droplets from nozzles. A plurality of discharge rollers may be disposed downstream of the platen with respect to the conveying direction and spaced apart from each other with respect to a width direction orthogonal to the conveying direction. A following roller may be disposed opposite to the plurality of discharge rollers and configured to nip and convey the sheet in conjunction with the plurality of discharge rollers. A support member may be disposed downstream of the plurality of discharge rollers with respect to the conveying direction and configured to hold the sheet that is conveyed by the plurality of discharge rollers and the following roller. A holder member may comprise a pressing portion configured to come into contact with the sheet at a position downstream of nip points between the plurality of discharge rollers and the following roller, and disposed opposite to the support member. The pressing portion may be disposed between a pair of the plurality of discharge rollers with respect to the width direction. A lower end of the pressing portion may be located lower than the nip points and disposed downstream of the plurality of discharge rollers with respect to the conveying direction.

According to the one or more aspects, the sheet may be maintained in the corrugated shape when the plurality of second pressing portions presses the sheet. For example, the plurality of second pressing portions may be disposed downstream of the nip points of the plurality of second conveyors in the conveying direction. Therefore, the plurality of second pressing portions may press the respective groove portions having the constant or consistent depths on the corrugated sheet. Accordingly, a conveyance resistance to the sheet may be reduced when the second pressing portions press the sheet, and an occurrence of a paper jam may be reduced.

DESCRIPTION OF THE DRAWINGS

For a more complete understanding of the present disclosure, needs satisfied thereby, and the objects, features, and advantages thereof, reference now is made to the following descriptions taken in connection with the accompanying drawing.

DETAILED DESCRIPTION OF EMBODIMENTS

Figure 1:
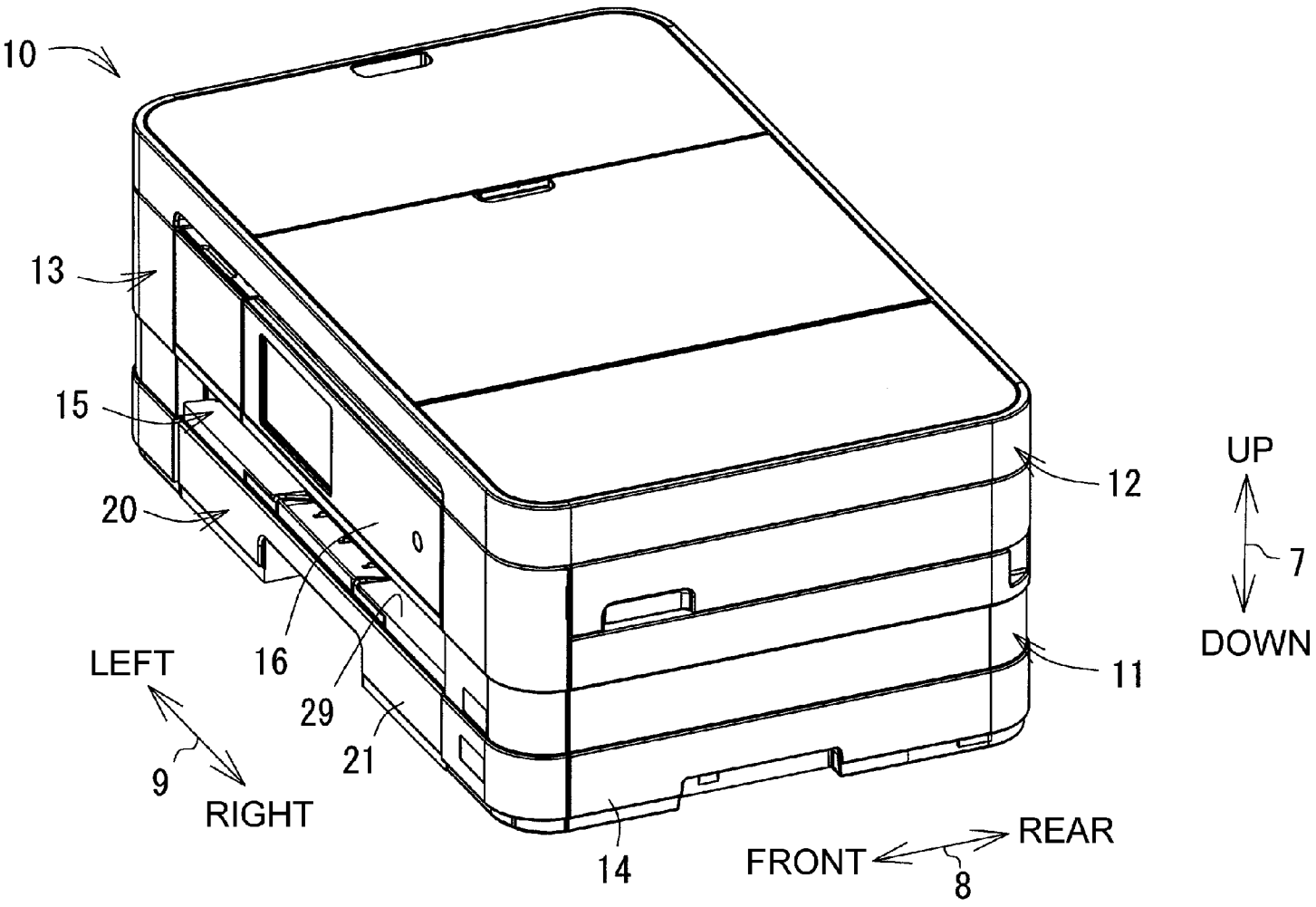
FIG. 1 is a perspective view depicting an inkjet recording apparatus in a first illustrative embodiment according to one or more aspects of the disclosure.

Illustrative embodiments according to one or more aspects are described below with reference to the accompanying drawings. The illustrative embodiments described below are only examples. Various changes, arrangements and modifications may be applied therein without departing from the spirit and scope of the disclosure. As depicted in FIG. 1, an up-down direction 7 may be defined with reference to an orientation of an inkjet recording apparatus 10 that may be disposed in which it may be intended to be used. A side of the inkjet recording apparatus 10, in which a control panel 16 may be provided, may be defined as the front of the inkjet recording apparatus 10. A front-rear direction 8 may be defined with reference to the front of the inkjet recording apparatus 10. A right-left direction 9 may be defined with respect to the inkjet recording apparatus 10 as viewed from its front. Hereinafter, a first illustrative embodiment according to the one or more aspects of the disclosure is described.

As depicted in FIG. 1, the inkjet recording apparatus 10 may comprise a printer unit 11 and a scanner unit 12. The printer unit 11 may be configured to record an image onto a sheet 6 (see FIG. 2). The sheet 6 may be, for example, recording paper, glossy paper, a postcard and/or other types of printing/recording media. The scanner unit 12 may be configured to read an image recorded on a document (not depicted). The inkjet recording apparatus 10 may be configured to perform one or more of printing, scanning, and copying. The inkjet recording apparatus 10 may not necessarily comprise the scanner unit 12, whose detailed description is omitted.

Figure 2:
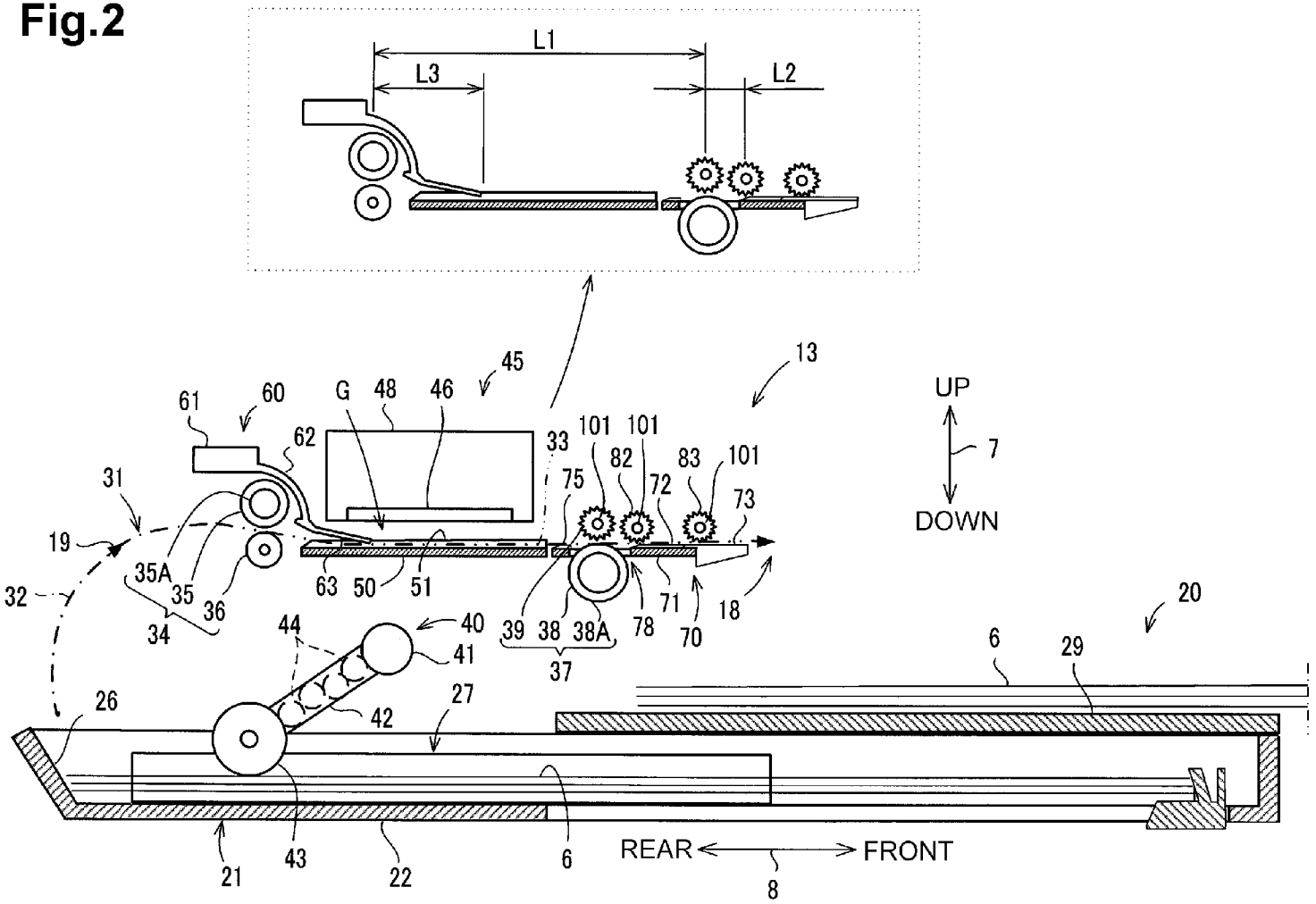
FIG. 2 is a schematic longitudinal sectional view depicting a main body of the inkjet recording apparatus of FIG. 1 in the first illustrative embodiment according to one or more aspects of the disclosure.

As further depicted in FIG. 1, the printer unit 11 may comprise a main body 13 and a sheet feed cassette 20. The sheet feed cassette 20 may be disposed in a lower portion of the main body 13. As depicted in FIG. 2, the sheet feed cassette 20 may be configured to accommodate one or more sheets 6 that may be loaded therein by a user. The main body 13 may comprise a housing 14 (see FIG. 1) that may comprise therein a feeding portion 40, a conveying path 31, a conveyor roller pair 34, a discharge roller pair 37, contact members 60, a recording portion 45, second spurs 82 and third spurs 83.

The main body 13 may be configured to feed the sheet 6 into the conveying path 31 by the feeding portion 40 and convey the fed sheet 6 by the conveyor roller pair 34. The main body 13 may be further configured to form the sheet 6 being conveyed into a shape of alternate ridge portions and groove portions (hereinafter, also referred to as a "corrugated shape") to provide a corrugation pattern. For example, the corrugated shape of the sheet 6 may be formed by the contact members 60. Consequently, the main body 13 may record an image onto the sheet 6 having a corrugation pattern by ejecting ink droplets from the recording portion 45. A sheet having a corrugation pattern may also be referred to as a "corrugated sheet". The main body 13 may be further configured to maintain the sheet 6 in the corrugated shape by the discharge roller pair 37, the second spurs 82 and the third spurs 83 and to discharge the sheet 6 onto a sheet discharge tray 29 of the sheet feed cassette 20 by the discharge roller pair 37. Hereinafter, components of the printer unit 11 are described.

The housing 14 may have an opening 15 in the front of the housing 14 in the front-rear direction 8. The sheet feed cassette 20 may be inserted into or removed from the inkjet recording apparatus 10 via the opening 15. The housing 14 may comprise rails (not depicted) at a back portion of the housing 14 behind the opening 15. The rails may be configured to support the sheet feed cassette 20 slidably along the front-rear direction 8.

The sheet feed cassette 20 may be configured to be accommodated in the lower portion of the housing 14. The sheet feed cassette 20 may be supported by the rails (not depicted) disposed at the housing 14 and configured to be slidable along the front-rear direction 8 via the rails. As depicted in FIG. 2, the sheet feed cassette 20 may comprise a main tray 21 and the sheet discharge tray 29. The main tray 21 may be configured to hold one or more sheets 6 on which an image is to be recorded. The sheet discharge tray 29 may be configured to receive one or more sheets 6 on which an image has been recorded. The sheet discharge tray 29 may be disposed above the main tray 21 and supported by the main tray 21.

The main tray 21 may comprise a lower surface 22 and an inclined wall 26. One or more sheets 6 may be received on the lower surface 22 of the main tray 21. The inclined wall 26 may extend obliquely upward from a rear end of the lower surface 22 in the front-rear direction 8. The inclined wall 26 may be configured to allow the one or more sheets 6 to move obliquely upward into the conveying path 31 from the feeding portion 40. A side guide mechanism 27 may be disposed on the lower surface 22. The side guide mechanism 27 may be configured to center the one or more sheets 6 received on the lower surface 22 (center alignment). In the center alignment, one or more sheets 6 of any size may be positioned on the lower surface 22 while the center line of the one or more sheets 6 with respect to the right-left direction 9 may be aligned with the center line of the main tray 21 with respect to the right-left direction 9.

The feeding portion 40 may comprise a support shaft 41, an arm 42, and a feed roller 43. The support shaft 41 may be rotatably supported by a frame (not depicted). The arm 42 may extend obliquely downward from the support shaft 41. One end of the arm 42 may be rotatably supported by the support shaft 41 and the other end of the arm 42 may rotatably support the feed roller 43. The arm 42 may comprise a plurality of gears 44 for transmitting the rotation of the support shaft 41 to the feed roller 43.

The feed roller 43 may be configured to be rotatable by a force generated by the rotation of the support shaft 41 and transmitted through the plurality of gears 44. The feed roller 23 may be configured to feed the one or more sheets 6, one by one, from the main tray 21 toward the rear with respect to the front-rear direction 8 with the rotation of the feed roller 43. The fed sheet 6 may be allowed to move into the conveying path 31 by the inclined wall 26 of the main tray 21.

As depicted in FIG. 2, the conveying path 31 may be defined by a plurality of guide members, including a support member 70 (as an example of a support member), and a platen 50. The guide members other than the support member 70 are omitted from the drawings. The conveying path 31 may comprise a curved section 32, which is indicated by a dotted and dashed line, and a straight section 33, which is indicated by a double-dotted and dashed line. The curved section 32 may extend upward from an upper end of the inclined wall 26 of the main tray 21 and be curved toward the front in the front-rear direction 8. The straight section 33 may extend from an end of the curved section 32 toward the front in the front-rear direction 8. The support member 70 is described in further detail below.

Figures 5A, 5B, 5C:
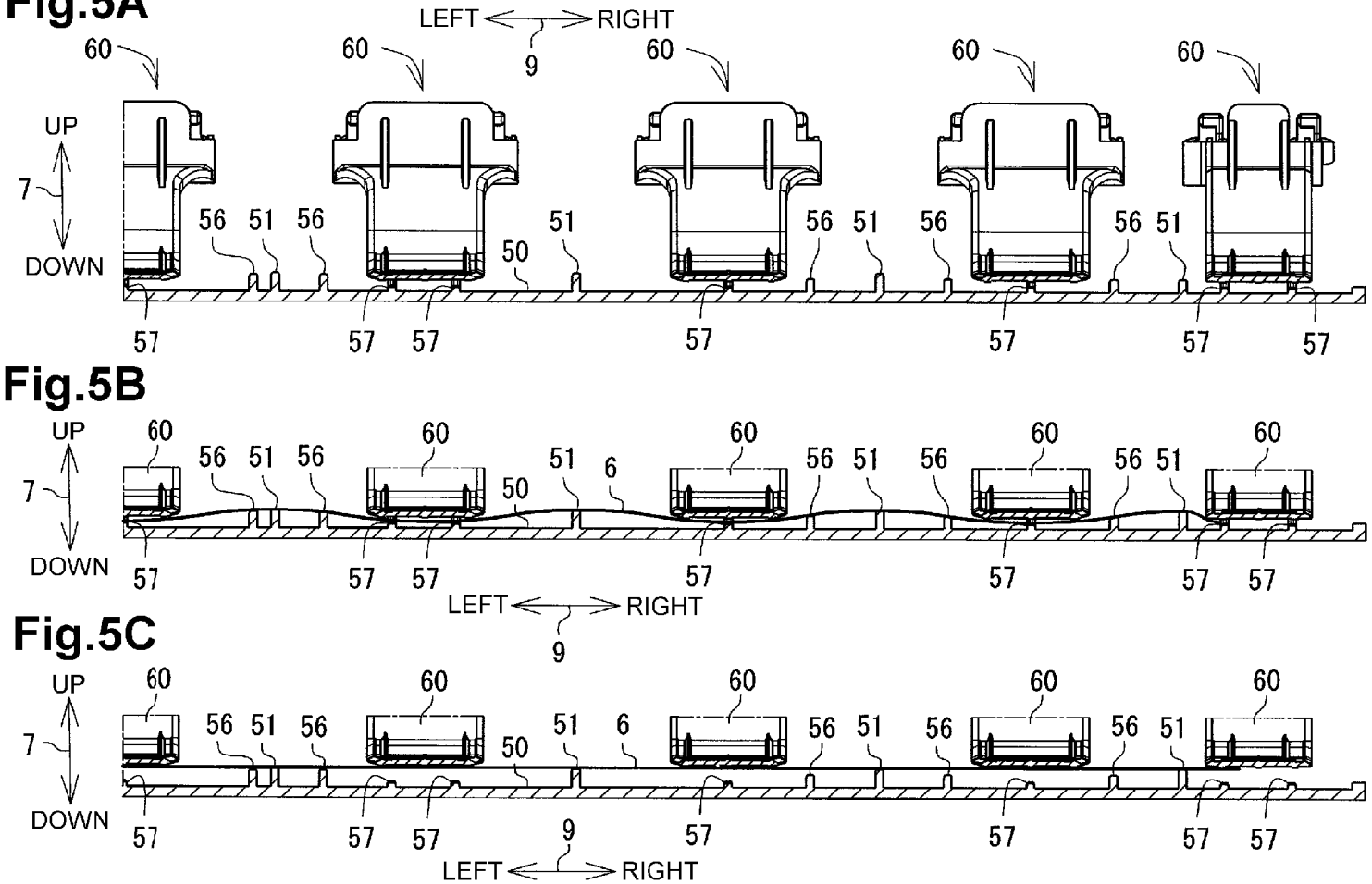
FIG. 5A is a sectional view depicting a platen and contact members, taken along a line extending in a right-left direction, in the first illustrative embodiment according to one or more aspects of the disclosure.
FIG. 5B is a sectional view depicting the platen and the contact members when a sheet having relatively lower stiffness is conveyed, taken along the line extending in the right-left direction, in the first illustrative embodiment according to one or more aspects of the disclosure.
FIG. 5C is a sectional view depicting the platen and the contact members when a sheet having relatively higher stiffness is conveyed, taken along the line extending in the right-left direction, in the first illustrative embodiment according to one or more aspects of the disclosure.

The platen 50 may have a plate-like shape having a thickness in the up-down direction 7. The platen 50 may be disposed above the sheet feed cassette 20. As depicted in FIG. 5A, the platen 50 may comprise a plurality of first ribs 51 (as an example of a platen rib), a plurality of eighth ribs 56, and a plurality of other ribs 57 that may upwardly protrude from an upper surface of the platen 50.

Figure 6:
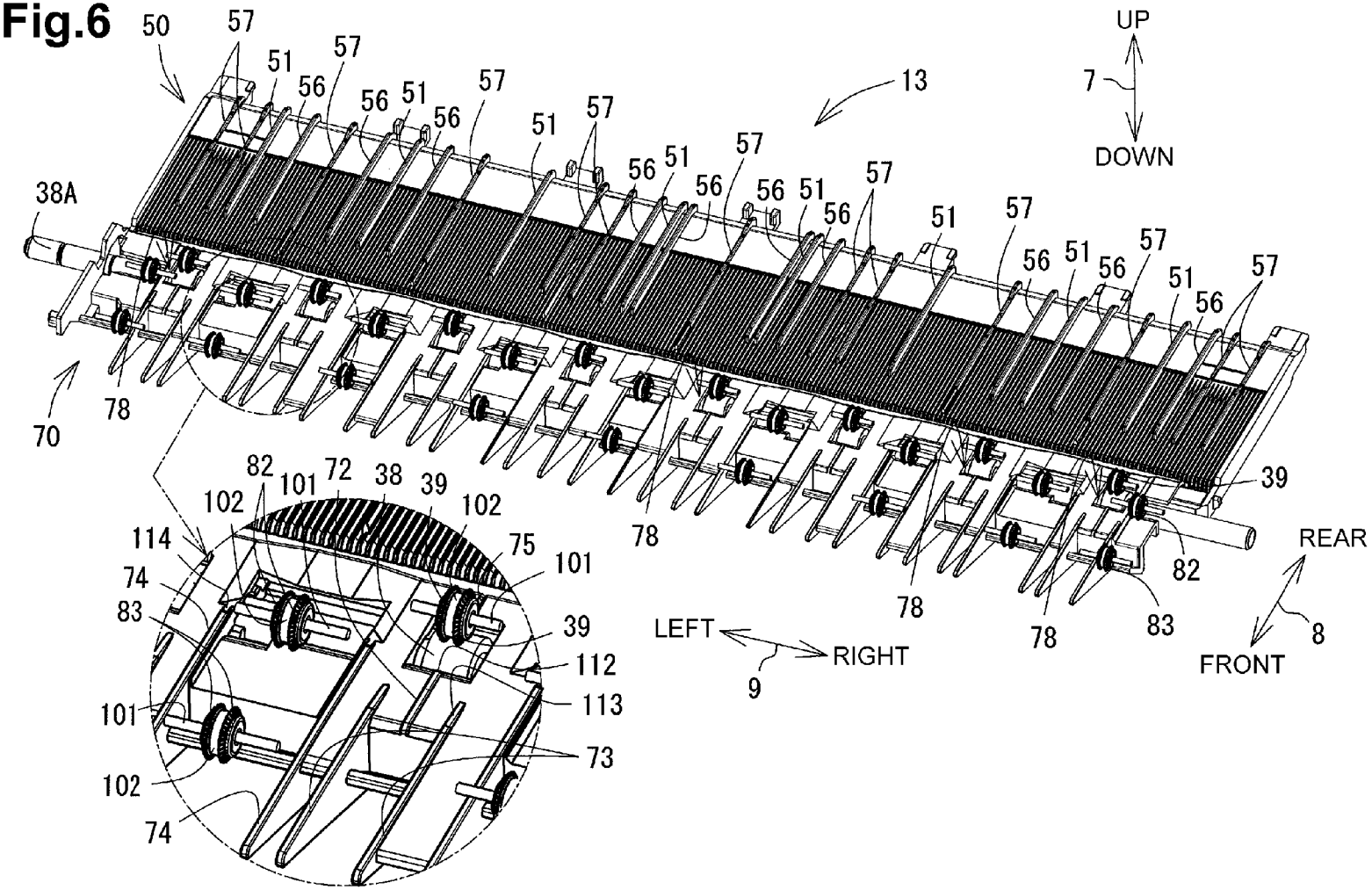
FIG. 6 is a perspective view depicting the platen and a support member, in the first illustrative embodiment according to one or more aspects of the disclosure.

The first ribs 51 may be provided and configured to hold the sheet 6 to form ridge portions in the sheet 6. As depicted in FIG. 6, the first ribs 51 may extend along the front-rear direction 8 from a rear end of the platen 50 to the vicinity of a front end of the platen 50. With this configuration, the first ribs 51 may hold the ridge portions of the corrugated sheet 6 to the vicinity of the front end of the platen 50.

The first ribs 51 may be spaced apart from each other in the right-left direction 9 and disposed at diametrically opposed positions about the center line of the platen 50 in the right-left direction 9. This configuration may provide a symmetric corrugation pattern in the sheet 6 of any size, which may be centered by the side guide mechanism 27, with respect to the center line of the sheet 6. The symmetric pattern may reduce a tendency of the corrugation pattern in the sheet 6 to be deformed and improve image-recording accuracy. A recording head 46 may be configured to eject ink droplets onto the sheet 6 based on a distance between the sheet 6 and each nozzle 47 (see FIG. 3) that may be changeable due to the corrugation pattern formed in the sheet 6. Therefore, the image-recording accuracy may be improved when the corrugation pattern of the sheet 6 is maintained.

The eighth ribs 56 may be provided for adjusting the shape of respective curves (curvature radiuses) of the corrugation pattern formed in the sheet 6. As depicted in FIG. 5A, each of the eighth ribs 56 may be disposed between each of the first ribs 51 and each of the contact members 60 in the right-left direction 9. The eighth ribs 56 may extend along a conveying direction 19 of the sheet 6 (see FIG. 2). Each of the contact members 60 may be disposed at a middle position between two adjacent ribs of the first ribs 51 in the right-left direction 9.

The eighth ribs 56 may be shorter in height than the first ribs 51 such that portions of the sheet 6 held by the respective eighth ribs 56 do not become the tops or crests of the ridge portions in the corrugation pattern. Each of the eighth ribs 56 may hold a portion of the sheet 6 between a ridge portion and a groove portion of each curve in the corrugation pattern to adjust and/or maintain the curvature radius of each curve in the corrugation pattern of the sheet 6.

The ribs 57 may be provided and configured to hold or support the groove portions of the corrugated sheet 6. Upper edges of the ribs 57 may be located lower than upper edges of the eighth ribs 56 (e.g., the height of ribs 57 may be smaller than the height of eighth ribs 56). Each of the ribs 57 may extend from a position under a downstream end of a contact portion 63 of a corresponding one of the contact members 60 with respect to the conveying direction 19 (see FIG. 2) to the front end of the platen 50 in the front-rear direction 8.

Some of the ribs 57 may be disposed at a middle position under a corresponding one of the contact members 60 in the right-left direction 9. These ribs 57 may hold bottoms of the groove portions (e.g., the troughs), respectively, of the corrugated sheet 6. Pairs of ribs of the rest of the ribs 57 may be spaced apart from each other under a corresponding one of the contact portions 63 in the right-left direction 9. These ribs 57 may be configured to hold the right and left portions of the bottom of each of the groove portions of the corrugated sheet 6. The corrugated sheet 6 may be conveyed over the platen 50 while the ridge portions are held by the first ribs 51 and the groove portions are held by the ribs 57. Therefore, the tendency of the corrugation pattern of the sheet 6 to be deformed may be reduced.

The platen 50 may be pivotably supported by a rotating shaft 38A of discharge rollers 38 (see FIG. 2) at the front end of the platen 50 with respect to the front-rear direction 8. With this configuration, the platen 50 may allow a sheet 6 having relatively higher stiffness to pass therethrough without forming a corrugated shape in the sheet 6 (see FIG. 5C). The platen 50 may be configured to pivot between a first position depicted in FIG. 5A and a second position depicted in FIG. 5C. A rearward part of the platen 50 in the front-rear direction 8 may be urged toward the first position (upward) by one or more elastic members (not depicted). When the sheet 6 having relatively higher stiffness is conveyed, the platen 50 may be pivoted from the first position to the second position by the sheet 6 against urging force of the one or more elastic members.

Figure 4:
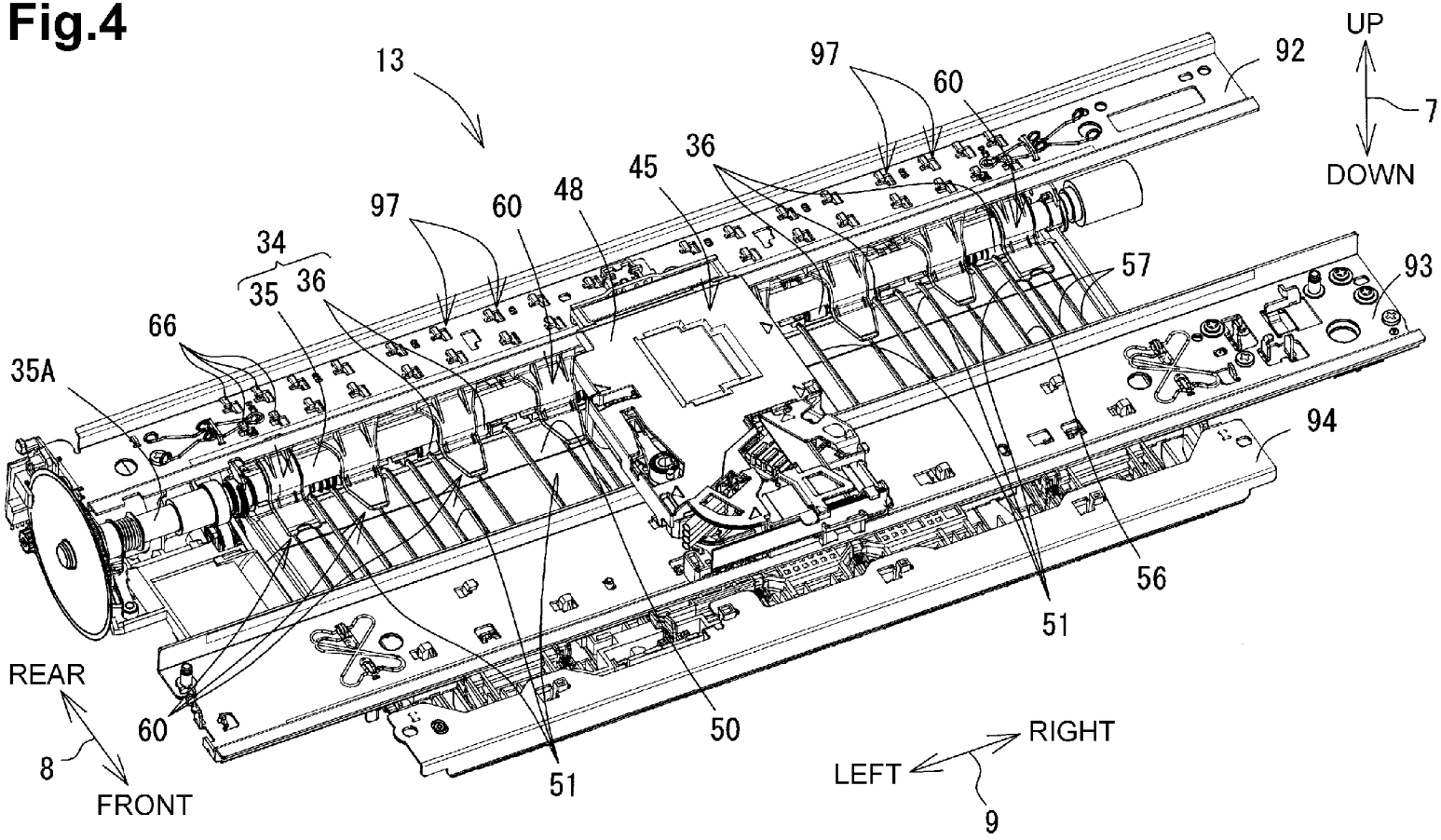
FIG. 4 is a partial perspective view depicting the main body in the first illustrative embodiment according to one or more aspects of the disclosure.

Referring again to FIG. 2, the recording portion 45 may comprise a carriage 48 disposed above the platen 50, and the recording head 46 mounted on the carriage 48. Referring to FIG. 4, the carriage 48 may be supported by a pair of front and rear guide rails 92, 93 disposed above the platen 50 and may be configured to reciprocate along the right-left direction 9. The guide rails 92, 93 may be supported by the frame (not depicted) at both ends, respectively, with respect to the right-left direction 9. The guide rail 93 may be provided with a belt (not depicted) to which the carriage 48 may be fixed. The belt may be configured to be rotated by a drive motor (not depicted) to allow the carriage 48 to reciprocate along the right-left direction 9.

Figure 3:
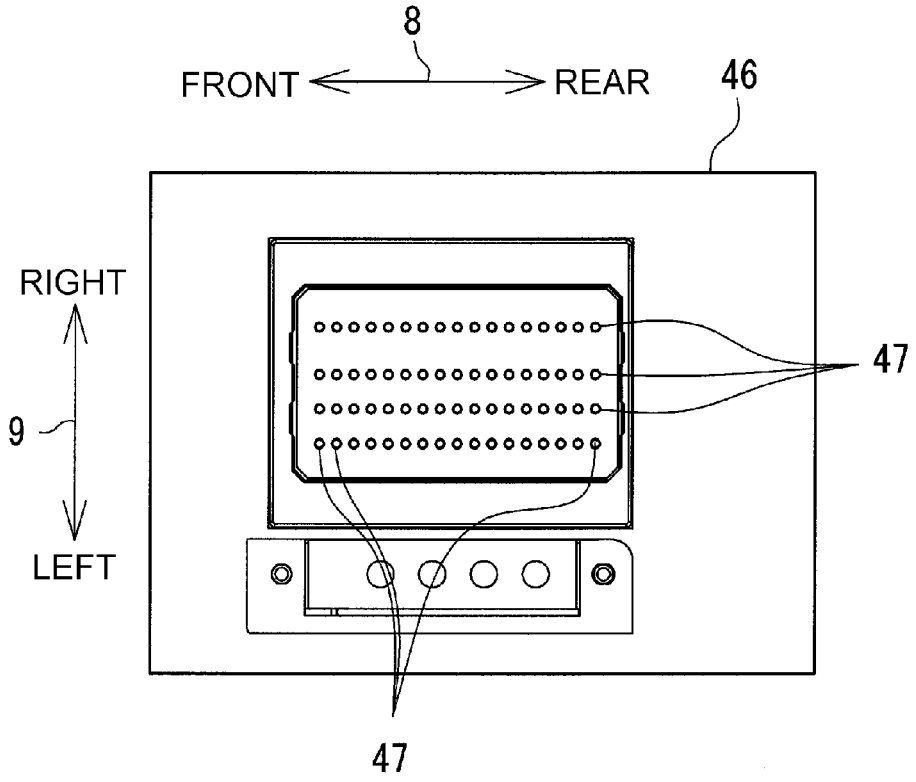
FIG. 3 is a bottom view depicting a recording head in the first illustrative embodiment according to one or more aspects of the disclosure.

As depicted in FIG. 2, the recording head 46 may be mounted on the carriage 48, and disposed above the platen 50 while leaving a gap G between the recording head 46 and the platen 50. In FIG. 3, the recording head 46 is shown with the plurality of nozzles 47 in a lower surface of the recording head 46 to eject ink droplets therefrom. The recording head 46 may be configured to record an image onto a sheet 6 by ejecting ink droplets from the nozzles 47 onto the sheet 6 held by the platen 50.

As depicted in FIG. 2, a conveyor roller pair 34 (as an example of a first conveyor) may be disposed upstream of the platen 50 with respect to the conveying direction 19 (behind the platen 50 in the front-rear direction 8). The conveyor roller pair 34 may be configured to nip the sheet 6 fed from the feeding portion 40 and convey the sheet 6 along the conveying direction 19.

The conveyor roller pair 34 may comprise a rotating shaft 35A, a conveyor roller 35, and following rollers 36. The rotating shaft 35A may extend along the right-left direction 9 (a direction perpendicular to the drawing sheet of FIG. 2). The conveyor roller 35 may be disposed on the rotating shaft 35A and may be configured to rotate integrally with the rotating shaft 35A. The following rollers 36 may be disposed below the conveyor roller 35. The rotating shaft 35A may be supported by the frame (not depicted) at both ends of the rotating shaft 35A with respect to the right-left direction 9 and configured to be rotated by a drive motor (not depicted).

The following rollers 36 may be rotatably supported by a holding member (not depicted). The holding member may be urged upward by one or more elastic members (not depicted). The following rollers 36 may be in pressure contact with the conveyor roller 35, which may be disposed above the following rollers 36, by the one or more elastic members. The conveyor roller pair 34 may be configured to nip the sheet 6 by the conveyor roller 35 and the following rollers 36 and convey the sheet 6 along the conveying direction 19. The sheet 6 being conveyed may be formed into a corrugated shape by the first ribs 51 of the platen 50 and the contact members 60.

As depicted in FIG. 4, the contact members 60 may be attached to the guide rail 92 and spaced apart from each other in the right-left direction 9. Each of the contact members 60 may be disposed at the middle position between ribs of the first ribs 51 adjacent in the right-left direction 9. This configuration may form ridge portions and groove portions alternately at regular intervals in the sheet 6. Accordingly, the tendency of the corrugation pattern in the sheet 6 to be deformed may be reduced and the image-recording accuracy may be improved.

A structure of the contact members 60 is now described with reference to FIG. 2. In one or more examples, all of the contact members 60 may have the same configuration, and therefore, the description of one of the contact member 60 may apply to a remainder of the contact members 60. The contact member 60 may comprise a fixing portion 61, a curved portion 62, and the contact portion 63. The fixing portion 61 may be configured to be attached to the guide rail 92 (see FIG. 4). The curved portion 62 may curvedly extend downward from the fixing portion 61 such that the curved portion 62 does not come into contact with the conveyor roller 35. The contact portion 63 may extend from a lower end of the curved portion 62 such that the contact portion 63 may extend toward the gap G.

The fixing portion 61 may comprise protrusions (not depicted) to be inserted from below into respective insertion openings 97 (see FIG. 4) provided in the guide rail 92. As depicted in FIG. 4, each of the protrusions may comprise a pawl 66 at its upper end. The pawls 66 may engage an upper surface of the guide rail 92. The fixing portion 61 may be fixed to the guide rail 92 by sandwiching the guide rail 92 from above and below by an upper end surface of the fixing portion 61 and the pawls 66.

The contact portion 63 may have a plate-like shape that may extend obliquely downward from a tip end, e.g., a front end of the curved portion 62. A forward part of the contact portion 63, with respect to the conveying direction, may be located closer to the upper surface of the platen 50 than a back part of the contact portion 63. In one example, the contact portion 63 becomes gradually closer to the upper surface of the platen 50 from a back part to a forward part of the contact portion 63. A lower end of the contact portion 63 (e.g., a front end of the contact portion 63 in the front-rear direction 8) may be located in the gap G and adjacent to the nozzles 47 (see FIG. 3).

As depicted in FIG. 5A, the lower end of the contact portion 63 may be located lower than the upper edges of the first ribs 51 of the platen 50 located in the first position. The sheet 6 to be conveyed over the platen 50 may be formed into a corrugated shape by the first ribs 51 and the contact portions 63. For example, the sheet 6 may have ridge portions that may be held by the first ribs 51 and groove portions that may be depressed by the contact portions 63. The corrugated sheet 6 may be conveyed over the platen 50 without curling, and an image may be recorded on the sheet 6 by the recording head 46. The sheet 6 on which the image has been recorded may then reach the discharge roller pair 37 and be further conveyed by the discharge roller pair 37.

As depicted in FIG. 2, the discharge roller pair 37 (as an example of a second conveyor) may comprise the rotating shaft 38A, the plurality of discharge rollers 38, and a plurality of first spurs 39. The rotating shaft 38A may be disposed downstream of the platen 50 with respect to the conveying direction 19 (in front of the platen 50 with respect to the front-rear direction 8). The plurality of discharge rollers 38 may be disposed on the rotating shaft 38A. The plurality of first spurs 39 may be disposed above the respective discharge rollers 38.

Figure 7:
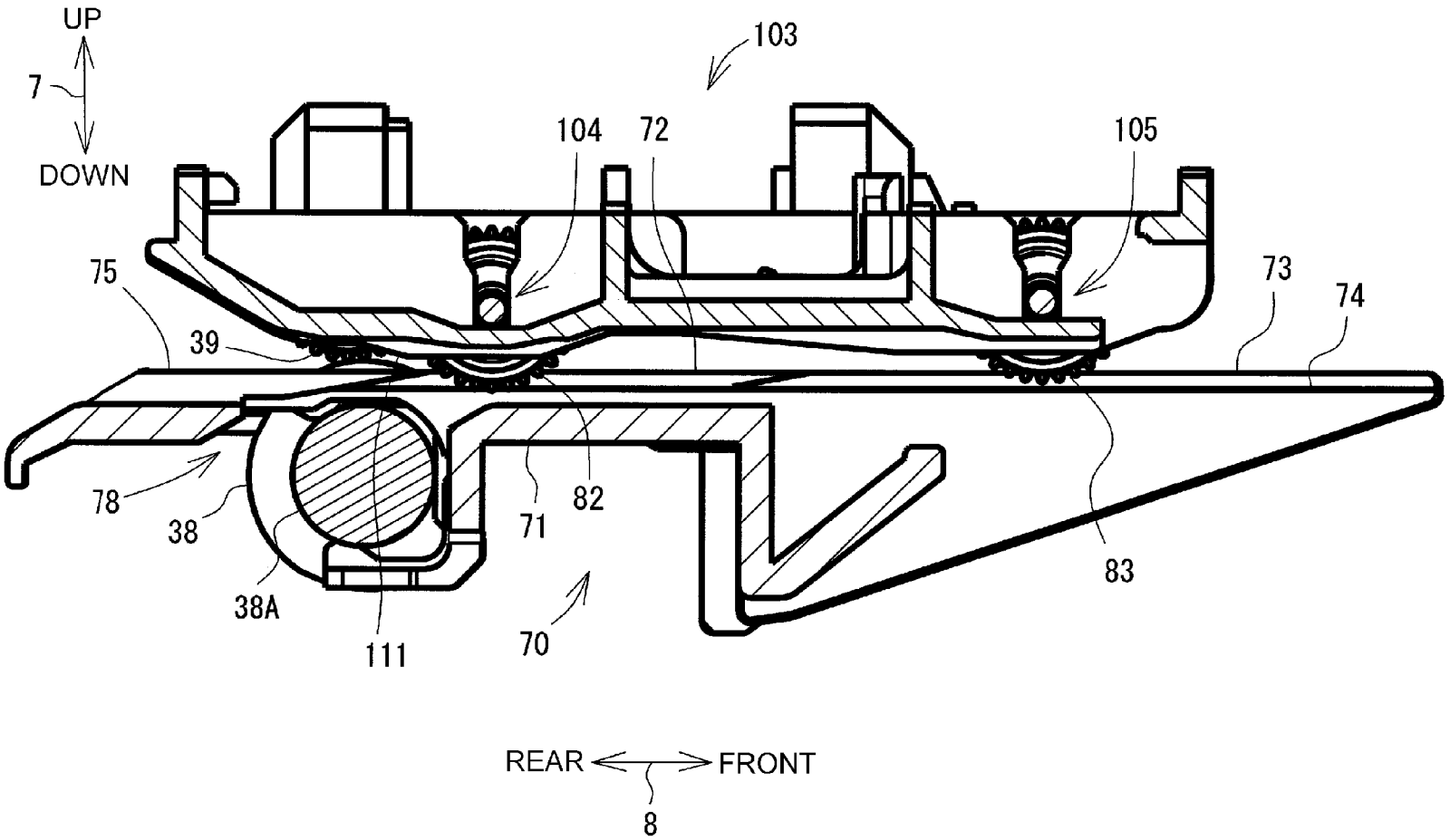
FIG. 7 is a longitudinal sectional view depicting the support member and a holder in the first illustrative embodiment according to one or more aspects of the disclosure.

The rotating shaft 38A may extend along the right-left direction 9 (the direction perpendicular to the drawing sheet of FIG. 2). The rotating shaft 38A may be rotatably supported by the frame (not depicted) at both ends. The rotating shaft 38A may be configured to be rotated by the drive motor (not depicted). As depicted in FIG. 7, the rotating shaft 38A may be located such that nip points of the discharge roller pair 37 may be located slightly higher than upper edges of fifth ribs 75 (described later). This configuration may allow the sheet 6 to move such that the tops of the ridge portions of the corrugated sheet 6 held by the fifth ribs 75 may fall on and contact the respective nip points of the discharge roller pair 37.

As depicted in FIG. 6, the first spurs 39 may be rotatably disposed on elastic shafts 101, respectively. The elastic shafts 101 may have elasticity with respect to a diameter direction of each of the elastic shafts 101. More specifically, the first spurs 39 may be disposed in pairs on respective ones of the elastic shafts 101. The pair of right and left first spurs 39 may be spaced apart from each other in the right-left direction 9 by a spacer 102 disposed on the elastic shaft 101. Both ends of the elastic shaft 101 with respect to the right-left direction 9 may be fixed to a holder 103 (see FIG. 7). The elastic shaft 101 may be configured to be deformed such that a middle part of the elastic shaft 101 in the right-left direction 9 may be located higher than both ends of the elastic shaft 101 when the pair of first spurs 39 is in contact with the corresponding discharge roller 38. In this state, the elastic shaft 101 may urge the pair of first spurs 39 downward. The pair of first spurs 39 may be in pressure contact with the corresponding discharge roller 38 by an urging force of the elastic shaft 101. In some arrangements, all of the pairs of first spurs 39 and the elastic shafts 101 may have the same configuration.

As depicted in FIG. 6, the discharge roller pair 37 may be disposed such that the nip points of the discharge roller pair 37 may be disposed on extensions of the first ribs 51, respectively, along the conveying direction 19 (see FIG. 2) (in front of the respective first ribs 51 in the front-rear direction 8). After the first ribs 51 hold/contact the tops of the ridge portions of the corrugated sheet 6, respectively, the discharge roller pair 37 may nip the tops of the ridge portions of the corrugated sheet 6 as the tops of the ridge portions reach the nip points of the discharge roller pair 37.

As depicted with a dashed line in FIG. 2, a distance L1 between the nip points of the conveyor roller pair 34 and the respective nip points of the discharge roller pair 37 in the conveying direction 19 may be shorter than a length of a longer side of a sheet 6 having the shortest length, in the conveying direction 19, useable by the image forming apparatus. Therefore, a downstream edge of a sheet 6 of any size may be nipped by the discharge roller pair 37 before an upstream edge of the sheet 6 passes the nip points of the conveyor roller pair 34 with respect to the conveying direction 19.

As depicted in FIG. 7, the holder 103 may be disposed above the discharge rollers 38 and may extend along the conveying direction 19 (see FIG. 2). The holder 103 may be fixed to an upper plate 94 (see FIG. 4). The upper plate 94 may be supported by the frame (not depicted) at its both ends with respect to the right-left direction 9.

As depicted in FIG. 7, the holder 103 may comprise a plurality of first fixing portions (not depicted), a plurality of second fixing portions 104, and a plurality of third fixing portions 105. The plurality of first fixing portions may be configured to fix both ends of the elastic shafts 101 (see FIG. 6) of the first spurs 39, respectively, with respect to the right-left direction 9. The plurality of second fixing portions 104 may be configured to fix both ends of the elastic shafts 101 of second spurs 82, respectively, with respect to the right-left direction 9. The plurality of third fixing portions 105 may be configured to fix both ends of the elastic shafts 101 of third spurs 83, respectively, with respect to the right-left direction 9. In one or more examples, the first fixing portions, the second fixing portion 104, and the third fixing portions 105 may have the same configuration.

The first fixing portions may be disposed above the respective discharge rollers 38 and spaced apart from each other in the right-left direction 9. The second fixing portions 104 may be disposed on extensions of the contact portions 63, respectively, and downstream of the first fixing portions in the conveying direction 19 (in front of the first fixing portions with respect to the front-rear direction 8). The second fixing portions 104 may be spaced apart from each other in the right-left direction 9. The third fixing portions 105 may be disposed on extensions of the second fixing portions 104, respectively, and downstream of the second fixing portions 104 in the conveying direction 19. The third fixing portions 105 may also be spaced apart from each other in the right-left direction 9.

As depicted in FIG. 7, the holder 103 (as an example of a guide member) may comprise first guide surfaces 111 (as an example of a guide portion) for guiding the groove portions of the corrugated sheet 6 to the second spurs 82. The first guide surfaces 111 may be disposed on extensions of the contact members 60, respectively, along the conveying direction 19 (see FIG. 2) such that the first guide surfaces 111 contact respective groove portions formed in the leading edge of the corrugated sheet 6. Each of the first guide surfaces 111 may be located between a corresponding one of the nip points of the discharge roller pair 37 and a lower end of a corresponding one of the second spurs 82 with respect to the conveying direction 19. The first guide surfaces 111 may extend obliquely downward along the front-rear direction 8 from above the nip points of the discharge roller pair 37, respectively. Front ends (lower ends) of the first guide surfaces 111 with respect to the front-rear direction 8 may be located at the same or substantially the same level as the nip points of the discharge roller pair 37 in the up-down direction 7. The leading edge of the sheet 6 being conveyed may come into contact with the first guide surfaces 111 to move obliquely downward. This movement of the sheet 6 will be described in detail later. In other embodiments, for example, the holder 103 may comprise one or more inclined surfaces that may extend obliquely downward along the front-rear direction 8 from a position upstream of the nip points of the discharge roller pair 37 with respect to the conveying direction 19. In this case, an area that may extend between the nip points of the discharge roller pair 37 and the lower ends of the second spurs 82 with respect to the conveying direction 19 may correspond to the first guide portions.

The second spurs 82 and the third spurs 83 may be provided for maintaining the corrugation pattern of the sheet 6 by pressing the bottoms of the groove portions of the corrugated sheet 6 from above. In some examples, and as depicted in FIG. 6, the second spurs 82 and the third spurs 83 may have the same configuration as the first spurs 39. The second spurs 82 and the third spurs 83 may also be rotatably disposed on respective elastic shafts 101. Therefore, the second spurs 82 and the third spurs 83 may be allowed to retract upward when a sheet 6 having higher stiffness is conveyed. The second spurs 82 may be disposed in pairs on respective elastic shafts 101 and each pair of second spurs 82 may be separated from each other by the spacer 102 in the right-left direction 9. The third spurs 83 may also be disposed in pairs on respective elastic shafts 101 and each pair of third spurs 83 may also be separated from each other by the spacer 102 in the right-left direction 9. For each pair of second spurs 82, a middle position between the pair of second spurs 82 connected to each other by the spacer 102 in the right-left direction 9 may correspond to a position of a corresponding one of the bottoms of the groove portions of the corrugated sheet 6. The second spurs 82 and the third spurs 83 may be disposed in pairs on respective elastic shafts 101 to scatter or distribute forces that may act on the sheet 6 when the second spurs 82 and the third spurs 83 press the sheet 6.

As depicted in FIG. 7, both ends of the elastic shafts 101 of the second spurs 82 in the right-left direction 9 may be fixed to the second fixing portions 104 of the holder 103, respectively. The lower ends of the second spurs 82 may be located below the nip points of the discharge roller pair 37, respectively, and at the same or substantially the same level as the front ends (the lower ends) of the contact portions 63, respectively, in the front-rear direction 8. Therefore, the second spurs 82 may be configured to press the bottoms of the groove portions of the corrugated sheet 6, respectively, from above.

As depicted by the dashed line in FIG. 2, the second spurs 82 may be disposed such that a distance L2 between the lower ends of the second spurs 82 and the respective nip points of the discharge roller pair 37 in the conveying direction 19 may be shorter than a distance L3 between the nip points of the conveyor roller pair 34 and the respective front ends of the contact portions 63 in the conveying direction 19 (the respective downstream ends of the contact portions 63 with respect to the conveying direction 19). With this configuration, the leading edge of the sheet 6 may reach the second spurs 82 while the upstream edge of the sheet 6, in the conveying direction 19 (hereinafter, simply referred to as the trailing edge of the sheet 6), may be nipped between the first ribs 51 and the contact portions 63 from above and below. Therefore, the upstream part and the downstream part of the sheet 6 with respect to the conveying direction 19 may be maintained in the corrugated shape.

As depicted in FIG. 7, both ends of the elastic shafts 101 of the third spurs 83 with respect to the right-left direction 9 may be fixed to the third fixing portions 105 of the holder 103, respectively. The lower ends of the third spurs 83 may be located below the nip points of the discharge roller pair 37 and at the same or substantially the same level as the lower ends of the contact portions 63, respectively. Therefore, the third spurs 83 may be configured to press the bottoms of the groove portions of the corrugated sheet 6, respectively.

The third spurs 83 may be disposed downstream of the second spurs 82 in the conveying direction 19 (see FIG. 2) and spaced apart from the second spurs 82, respectively. With this configuration, the second spurs 82 and the third spurs 83 may press the respective groove portions of the corrugated sheet 6 at the two points spaced apart from each other in the conveying direction 19. Therefore, the curling of the trailing edge of the sheet 6 on the platen 50 may be reduced after the trailing edge of the sheet 6 passes the contact portions 63. When the distance between the second spurs 82 and the third spurs 83 is too long, the trailing edge of the sheet 6 may pass the contact portions 63 before the leading edge of the sheet 6 reaches the third spurs 83 and thus the sheet 6 may be rotated about the second spurs 82. Therefore, the third spurs 83 may be disposed at the appropriate positions apart from the second spurs 82 such that the leading edge of the sheet 6 having a shortest length in the conveying direction 19 may reach the third spurs 83 before the trailing edge of the sheet 6 passes the contact portions 63.

As depicted in FIG. 2, the support member 70 may be disposed below the holder 103 and configured to hold the sheet 6 to be pressed by the second spurs 82 and the third spurs 83. The sheet 6 may be discharged onto the sheet discharge tray 29 from a discharge port 18 provided downstream of the support member 70 with respect to the conveying direction 19.

As depicted in FIG. 7, the support member 70 may comprise a plate-shaped base 71, a plurality of second ribs 72, a plurality of third ribs 73, a plurality of fourth ribs 74, and a plurality fifth ribs 75. The base 71 may be disposed between the rotating shaft 38A and the holder 103 and fixed to the frame (not depicted). The second ribs 72, the third ribs 73, the fourth ribs 74 and the fifth ribs 75 may protrude from an upper surface of the base 71. As depicted in FIG. 6, the base 71 may have a plurality of openings 78. The discharge rollers 38 may stick out from the upper surface of the base 71 via the openings 78, respectively.

The fifth ribs 75 may be provided for guiding the tops of the ridge portions of the corrugated sheet 6 to the nip points of the discharge roller pair 37. Each of the fifth ribs 75 may extend from the midpoint (with respect to the right-left direction 9) of an upstream edge (with respect to the conveying direction 19 (see FIG. 2)) of a corresponding one of the openings 78 (e.g., a rear edge of the opening 78 with respect to the front-rear direction 8) to an upstream end of the base 71 with respect to the conveying direction 19 (the rear end of the base 71 with respect to the front-rear direction 8). Therefore, the fifth ribs 75 may be disposed on extensions of the first ribs 51, respectively, with respect to the conveying direction 19. Upper edges of the fifth ribs 75 may be located at the substantially same level as the upper edges of the first ribs 51. Therefore, the fifth ribs 75 may hold the tops of the ridge portions of the corrugated sheet 6, respectively. The platen 50 may have the pivotable configuration. Thus, the first ribs 51 of the platen 50 may not be able to extend to the nip points of the discharge roller pair 37. Accordingly, the holder 103 may need to be provided with the fifth ribs 75.

Figure 8A:
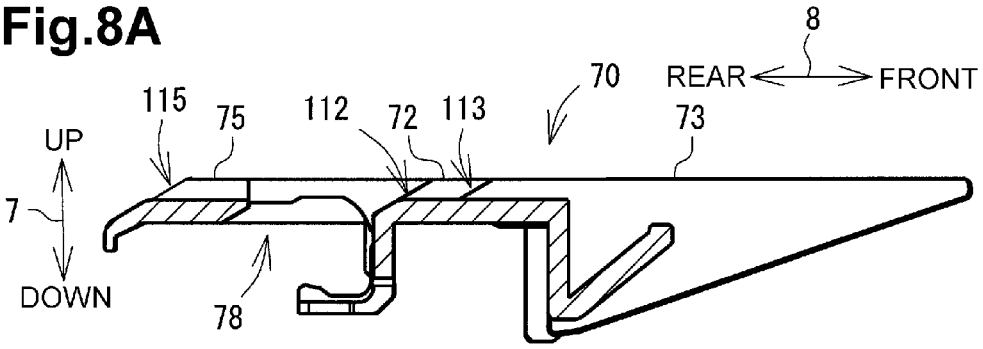
FIG. 8A is a longitudinal sectional view depicting the support member, taken along a line passing one of second ribs and one of fifth ribs, in the first illustrative embodiment according to one or more aspects of the disclosure.

As depicted in FIG. 8A, each of the fifth ribs 75 may comprise a fifth guide surface 115 at an upstream end of each of the fifth ribs 75 with respect to the conveying direction 19 (see FIG. 2). In each of the fifth ribs 75, the fifth guide surface 115 may extend obliquely upward from an upstream end of the upper surface of the base 71 to an upper edge of the fifth rib 75 with respect to the conveying direction 19. The fifth guide surfaces 115 may come into contact with the leading edge of the sheet 6 to allow the sheet 6 to move to the upper edges of the fifth ribs 75. This configuration may reduce catching of the sheet 6 on the upstream ends of the fifth ribs 75 with respect to the conveying direction 19.

As depicted in FIG. 6, the second ribs 72 may be provided for holding the tops of the ridge portions of the corrugated sheet 6. The second ribs 72 may be disposed on the extensions of the first ribs 51, respectively, with respect to the conveying direction 19 (see FIG. 2). Upper edges of the second ribs 72 may be located at the same or substantially the same level as the upper edges of the first ribs 51. Therefore, the second ribs 72 may hold the tops of the ridge portions of the corrugated sheet 6, respectively. Each of the second ribs 72 may extend along the conveying direction 19 from the midpoint (with respect to the right-left direction 9) of a downstream edge (with respect to the conveying direction 19) of a corresponding one of the openings 78 (a front edge of the opening 78 with respect to the front-rear direction 8). Upstream ends of the second ribs 72 may be located upstream of the lower ends of the second spurs 82, respectively, with respect to the conveying direction 19 (front ends of the second ribs 72 with respect to the front-rear direction 8). Therefore, the upstream ends of the second ribs 72 with respect to the conveying direction 19 may be located upstream of the lower ends of the second spurs 82. This configuration may allow the second ribs 72 to hold the ridge portions of the corrugated sheet 6 when the second spurs 82 press the groove portions of the corrugated sheet 6 from above. Each of the second ribs 72 may extend from the downstream edge of a corresponding one of the openings 78 to a position between the second spurs 82 and the third spurs 83 along the conveying direction 19 because the third ribs 73 may be provided on the platen 50. The second ribs 72 and the third ribs 73 may correspond to further rib portions.

As depicted in FIG. 8A, each of the second ribs 72 may comprise a second guide surface 112 at an upstream end of each of the second ribs 72 with respect to the conveying direction 19 (see FIG. 2). In each of the second ribs 72, the second guide surface 112 may extend obliquely upward from a downstream edge of a corresponding one of the openings 78 to an upper edge of the second rib 72. The second guide surfaces 112 may come into contact with the leading edge of the sheet 6 that has passed the nip points of the discharge roller pair 37, and allow the sheet 6 to move to the upper edges of the second ribs 72. This configuration may reduce catching of the sheet 6 on the upstream ends of the second ribs 72 with respect to the conveying direction 19.

The third ribs 73 may be provided and configured to hold the ridge portions of the corrugated sheet 6 by taking over from the second ribs 72. As depicted in FIG. 6, the third rib 73 may be disposed on both sides of each of the second ribs 72 in the right-left direction 9 such that each pair of third ribs 73 may hold the right and left portions of the top of a corresponding ridge portion of the corrugated sheet 6. The third ribs 73 may extend from respective positions upstream of the downstream ends of the second ribs 72 to respective positions downstream of the second spurs 82 in the conveying direction 19 (see FIG. 2). With this configuration, the third ribs 73 may take over holding the sheet 6 from the second ribs 72. Upper edges of the third ribs 73 may be located lower than the upper edges of the second ribs 72. While the sheet 6 is conveyed, the third ribs 73 may hold the right and left portions of the tops of the ridge portions of the sheet 6, respectively, after the second ribs 72 held the tops of the ridge portions of the sheet 6, respectively. For example, the holding of the right and left portions of the ridge portion tops may transfer from the second ribs 72 to the third ribs 73.

As depicted in FIG. 8A, each of the third ribs 73 may comprise a third guide surface 113 at an upstream end thereof in the conveying direction 19 (see FIG. 2). In each of the third ribs 73, the third guide surface 113 may extend obliquely upward from the upper surface of the base 71 to an upper edge of the third rib 73. The third guide surfaces 113 may come into contact with the leading edge of the sheet 6 to allow the sheet 6 to move to the upper edges of the third ribs 73. This configuration may reduce catching of the sheet 6 on the upstream ends of the third ribs 73 with respect to the conveying direction 19.

The fourth ribs 74 may be provided and configured to hold the right and left portions of the bottoms of the groove portions of the corrugated sheet 6 being pressed by the second spurs 82 and the third spurs 83. As depicted in FIG. 6, the fourth ribs 74 may extend from respective positions upstream of the second spurs 82 to respective positions downstream of the third spurs 83 with respect to the conveying direction 19 (see FIG. 2). The fourth rib 74 may be disposed between each third rib 73 and each second spur 82 that may be adjacent to each other with respect to the right-left direction 9. With this configuration, the fourth ribs 74 may hold the right and left portions of the bottoms of the groove portions of the corrugated sheet 6. Upper edges of the fourth ribs 74 may be located lower than the upper edges of the second ribs 72 and the third ribs 73 to hold the groove portions of the corrugated sheet 6.

Figure 8B:
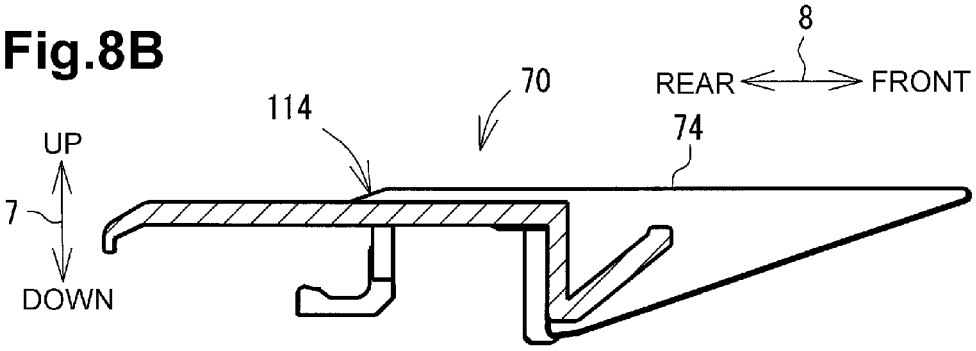
FIG. 8B is a longitudinal sectional view depicting the support member, taken along a line passing one of fourth ribs, in the first illustrative embodiment according to one or more aspects of the disclosure.

As depicted in FIG. 8B, each of the fourth ribs 74 may comprise a fourth guide surface 114 at an upstream end of each of the fourth ribs 74 in the conveying direction 19 (see FIG. 2). In each of the fourth ribs 74, the fourth guide surface 114 may extend obliquely upward from the upper surface of the base 71 to an upper edge of the fourth rib 74. The fourth guide surfaces 114 may come into contact with the leading edge of the sheet 6 to allow the sheet 6 to move to the upper edges of the fourth ribs 74. This configuration may reduce catching of the sheet 6 on the upstream ends of the fourth ribs 74 with respect to the conveying direction 19. While the sheet 6 is conveyed, the fourth ribs 74 may hold the right and left portions of the groove portions of the corrugated sheet 6, respectively.

An operation of the inkjet recording apparatus 10 is now described with reference to FIG. 2. First, the feed roller 43 may feed, one by one, one or more sheets 6 placed on the main tray 21 into the conveying path 31. Then, the conveyor roller pair 34 may convey the one or more fed sheets 6 successively. While the sheet 6 passes the contact portions 63 of the contact members 60, the first ribs 51 may hold the sheet 6 and the contact portions 63 of the contact members 60 may press an upper surface of the sheet 6 to form the sheet 6 into a corrugated shape. More specifically, the sheet 6 may be formed into the corrugated shape, in which the sheet 6 may have ridge portions that may be held by the first ribs 51 and groove portions that may be depressed by the contact portions 63.

The conveyor roller pair 34 may further convey the corrugated sheet 6 over the platen 50 without the sheet 6 curling. When a leading edge of the sheet 6 reaches under the nozzles 47 (see FIG. 3) of the recording head 46, the conveyor roller 35 may be allowed to stop rotating (e.g., the conveyor roller 35 may be stopped from rotating). After that, while the carriage 48 reciprocates along the right-left direction 9, the recording head 47 may eject ink droplets from the nozzles 47 onto the sheet 6 to perform a single line of printing. After performing the single line of printing, the conveyor roller 35 may be allowed to start rotating to convey the sheet 6 by a single line to start next single line of printing in a new line. The inkjet recording apparatus 10 may record an image on the sheet 6 by alternately performing a single line of printing and a line feed.

The conveyor roller pair 34 may convey the sheet 6 while the first ribs 61 of the platen 50 may hold the tops of the ridge portions of the corrugated sheet 6 and then the fifth ribs 75 of the support member 70 may hold the tops of the ridge portions of the corrugated sheet 6. After that, the tops of the ridge portions of the corrugated sheet 6 held by the fifth ribs 75 may reach the nip points of the discharge roller pair 37. The discharge roller pair 37 may nip the tops of the ridge portions of the corrugated sheet 6 and convey the sheet 6 further along the conveying direction 19.

The second ribs 72 may hold the tops of the ridge portions of the sheet 6 that has passed the nip points of the discharge roller pair 37. At this time, the first guide surfaces 111 and the fourth guide surfaces 114 may guide the groove portions of the sheet 6 to the lower ends of the second spurs 82 and the second spurs 82 may press the sheet 6 from above. Additionally, the trailing edge of the sheet 6 has not passed the contact portions 63 yet. Therefore, the forward part and the rearward part of the sheet 6 may be maintained in the corrugated shape. Thus, the sheet 6 may be reliably maintained in the corrugated shape.

After the leading edge of the sheet 6 passes the second spurs 82, the leading edge of the sheet 6 may reach the third ribs 73 and the fourth ribs 74. The discharge roller pair 37 may further convey the sheet 6 along the conveying direction 19 while the third ribs 73 hold the right and left portions of the ridge portions of the corrugated sheet 6, respectively, and the fourth ribs 74 hold the right and left portions of the groove portions of the corrugated sheet 6, respectively. The sheet 6 conveyed as described above may then reach the third spurs 83. The third spurs 83 may press the bottoms of the groove portions of the third spurs 83, respectively. With this configuration, the second spurs 82 and the third spurs 3 may press the sheet 6 at the two points spaced apart from each other in the conveying direction 19. Therefore, the sheet 6 may be conveyed without rotating about the second spurs 82 after passing the contact portions 63.

When a sheet 6 having relatively higher stiffness is conveyed, the platen 50 may be pivotally moved from the first position depicted in FIG. 5A to the second position depicted in FIG. 5C against the urging force of the one or more elastic members. Therefore, the sheet 6 may be conveyed without being formed into a corrugated shape as depicted in FIG. 5C. After performing image recording by the recording portion 45, the discharge roller pair 37 may nip and convey the sheet 6 further. While the sheet 6 passes under the second spurs 82 and the third spurs 83, the elastic shafts 101 of the second spurs 82 and the third spurs 83 may be deformed by the sheet 6 such that the second spurs 82 and the third spurs 83 are upwardly moved. The discharge roller pair 37 may convey the sheet 6 to discharge the sheet 6 onto the sheet discharge tray 29 while maintaining the sheet 6 in the flat shape (e.g., without forming a corrugated shape/pattern) by which the sheet 6 may move the second spurs 82 and the third spurs 83 upward.

In the first illustrative embodiment, the discharge roller pair 37 may nip the tops of the ridge portions of the corrugated sheet 6 and the second spurs 82 may press the bottoms of the groove portions of the corrugated sheet 6 from above. This configuration may maintain the sheet 6 in the corrugated shape. The second spurs 82 may be disposed downstream of the nip points of the discharge roller pair 37 in the conveying direction 19. Therefore, the second spurs 82 may press the bottoms of the groove portions of the corrugated sheet 6 after the discharge roller pair 37 nipped the tops of the ridge portions of the corrugated sheet 6. With this configuration, the depths of the groove portions may become stable (e.g., consistency in shape, depth, size, etc. may be maintained) when the second spurs 82 press the sheet 6. The second spurs 82 may be disposed downstream of the nip points of the discharge roller pair 37 in the conveying direction 19. Therefore, the discharge roller pair 37 may be disposed closer to the platen 50 as compared with a case where the second spurs 82 may be disposed upstream of the nip points of the discharge roller pair 37 with respect to the conveying direction 19. With this configuration, the sheet 6 that may tend to become flat due to the ink droplets adhered to the sheet 6 may be nipped by the discharge roller pair 37 before the sheet 6 becomes flat. Therefore, the change of the depths of the groove portions may be reduced/minimized and the depths of the groove portions may be stably maintained when the second spurs 82 press the sheet 6. Thus, a conveyance resistance to the sheet 6 may be reduced when the second spurs 82 press the sheet 6. As a result, in the first illustrative embodiment, the sheet 6 may be maintained in the corrugated shape and an occurrence of a paper jam or the degradation of the image-recording accuracy may be reduced.

In the first illustrative embodiment, the first guide surfaces 111 provided on the holder 103 may guide the bottoms of the groove portions of the corrugated sheet 6 to the lower ends of the second spurs 82 although the depth of one or more of the groove portions of the corrugated sheet 6 may become slightly shallower. As a result, the conveyance resistance to the sheet 6 may be further reduced.

In the first illustrative embodiment, the fourth ribs 74 may comprise the fourth guide surfaces 114, respectively, that may allow the leading edge of the sheet 6, which is moving obliquely downward by the first guide surfaces 111, to move to the lower ends of the second spurs 82. Therefore, an occurrence of a paper jam at the second spurs 82 may be reduced.

In the first illustrative embodiment, the second ribs 72 may hold the ridge portions of the corrugated sheet 6 when the second spurs 82 press the bottoms of the groove portions of the corrugated sheet 6. Therefore, the sheet 6 may be reliably maintained in the corrugated shape.

Additionally, the third spurs 83 may be disposed downstream of the second spurs 82 in the conveying direction 19 and the second spurs 82 and the third spurs 83 may press the sheet 6 at the two points spaced apart from each other in the conveying direction 19. This configuration may reduce the curling of the sheet 6 on the platen 50 after the trailing edge of the sheet 6 passes the contact portions 63.

In the first illustrative embodiment, the second spurs 82 may be rotatably disposed in pairs on respective elastic shafts 101 while each pair of the second spurs 82 may be spaced apart from each other in the right-left direction 9 by the spacer 102. The third spurs 83 may also be rotatably disposed in pairs on respective elastic shafts 101 while each pair of third spurs 83 may be spaced apart from each other in the right-left direction 9 by the spacer 102. Therefore, the force that may act on the sheet 6 may be scattered when the second spurs 82 and the third spurs 83 press the sheet 6. Accordingly, the conveyance resistance to the sheet 6 may be further reduced.

Figure 9A:
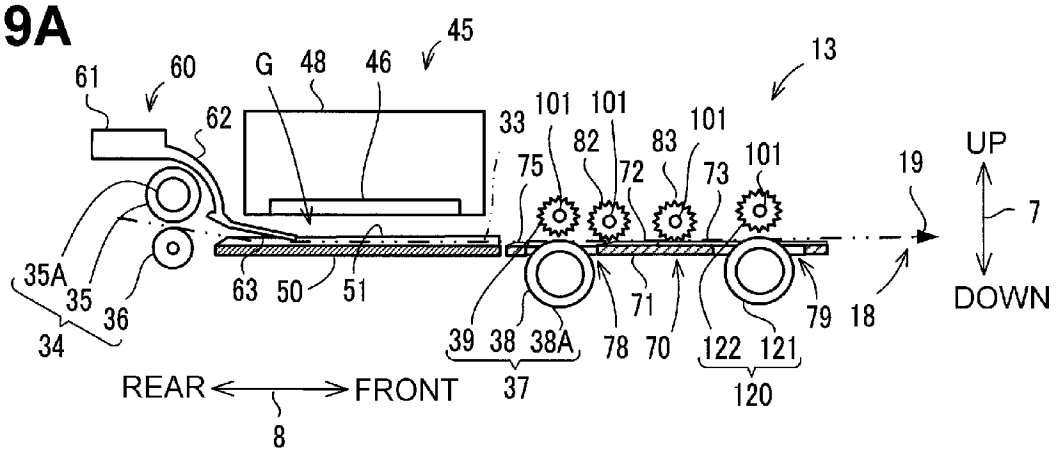
FIG. 9A is a partial schematic longitudinal sectional view depicting a main body in a first variation of the first illustrative embodiment according to one or more aspects of the disclosure.

A first variation of the first illustrative embodiment is now described. As depicted in FIG. 9A, for example, a roller pair 120 (as an example of a third conveyor) may be further disposed downstream of the third spurs 83 with respect to the conveying direction 19 (see FIG. 2). In one arrangement, the roller pair 120 may comprise rollers 121 having the same configuration as the discharge rollers 38, and fourth spurs 122 having the same configuration as the first spurs 39. The roller pair 120 may be disposed at the same position as the discharge roller pair 37 with respect to the up-down direction 7 and the right-left direction 9. Both end portions of each of the elastic shafts 101 of the fourth spurs 122 in the right-left direction 9 may be fixed to the holder 103. The support member 70 may have openings 79. The rollers 121 may stick out (e.g., extend) from the upper surface of the support member 70 via the openings 79, respectively. The other configuration of the inkjet recording apparatus 10 according to the first variation may be the same or different as the inkjet recording apparatus 10 according to the first illustrative embodiment described above.

The roller pair 120 may be configured to convey the sheet 6 to discharge the sheet 6 onto the sheet discharge tray 29 by nipping the tops of the ridge portions of the corrugated sheet 6. As described above, one or more aspects described herein may be adopted to the inkjet recording apparatus 10 that may further comprise the roller pair 120 disposed downstream of the third spurs 83 with respect to the conveying direction 19.

Figure 9B:
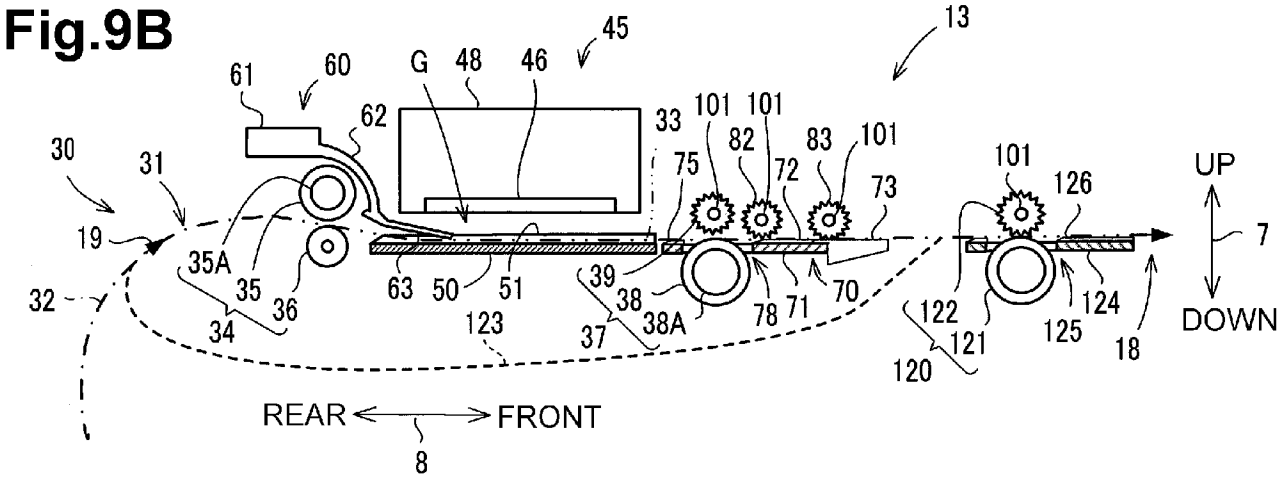
FIG. 9B is a partial schematic longitudinal sectional view of a main body in a second variation of the first illustrative embodiment according to one or more aspects of the disclosure.

A second variation of the first illustrative embodiment is now described. As depicted in FIG. 9B, for example, the inkjet recording apparatus 10 may have a double-sided printing function. The inkjet recording apparatus 10 may comprise the roller pair 120, a sheet reversing path 123, and a support member 124.

The support member 124 may be disposed downstream of the support member 70 in the conveying direction 19 (see FIG. 2). The support member 124 may have openings 125. The roller pair 120 may comprise the plurality of rollers 121. The rollers 121 of the roller pair 120 may stick out from an upper surface of the support member 124 via the openings 125, respectively. Sixth ribs 126 having the same configuration as the second ribs 72 may protrude from the upper surface of the support member 124. The sixth ribs 126 may be disposed at the same positions, in the up-down direction 7 and the right-left direction 9, as the second ribs 72. The sixth ribs 126 may also be configured to hold the tops of the ridge portions of the sheet 6, respectively.

The sheet reversing path 123 may extend from a position between the support member 70 and the support member 124 with respect to the conveying direction 19 to the curved section 32 by passing under the platen 50. The sheet reversing path 123 may be defined by one or more guide members (not depicted). The other configuration of the inkjet recording apparatus 10 according to the second variation may be the same as the inkjet recording apparatus 10 according to the first illustrative embodiment described above.

When the inkjet recording apparatus 10 performs the single-sided printing, the roller pair 120 may convey the sheet 6 on which an image has been recorded, along the conveying direction 19, to discharge the sheet 6 onto the sheet discharge tray 29. When the inkjet recording apparatus 10 performs double-sided printing, the roller pair 120 may rotate in the reverse direction after the trailing edge of the sheet 6 in which an image may be recorded on its one side passes the support member 70. Thus, the trailing edge of the sheet 6 with respect to the conveying direction 19 may enter the sheet reversing path 123. The inkjet recording apparatus 10 may convey the sheet 6 onto the platen 50 via the sheet reversing path 123 and the curved section 32 while the sheet 6 is turned upside down. Then, the inkjet recording apparatus 10 may record an image on the other side of the sheet 6 on the platen 50, and discharge the sheet 6 onto the sheet discharge tray 29 by the roller pair 120. As described above, the one or more aspects may be adopted to the inkjet recording apparatus 10 having the double-sided printing function.

Figure 8C:
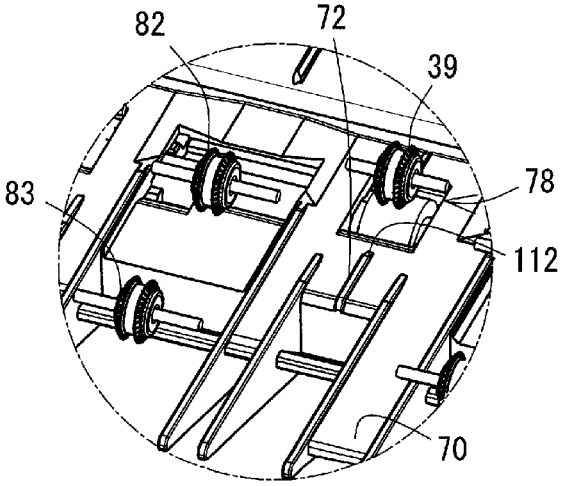
FIG. 8C is a partial perspective view of the support member in a third variation of the first illustrative embodiment according to one or more aspects of the disclosure.

A third variation of the first illustrative embodiment is now described. In the above-described first illustrative embodiment, as depicted in the enlarged view of FIG. 6, the upstream ends of the second ribs 72 with respect to the conveying direction 19 (see FIG. 2) may be disposed upstream of the lower ends of the second spurs 82 with respect to the conveying direction 19. In some arrangements, only the second ribs 72 might be needed to hold the ridge portions of the corrugated sheet 6 when the second spurs 82 press the groove portions of the corrugated sheet 6 from above. Therefore, in the third variation, for example, as depicted in FIG. 8C, the second ribs 72 may be disposed apart from the edges of the respective openings 78. More specifically, the second ribs 72 may be disposed such that the upstream ends of the second ribs 72 may extend along the conveying direction 19 from the same respective positions as the lower ends of the second spurs 82 with respect to the conveying direction 19. Accordingly, the second ribs 72 disposed as described above may hold the ridge portions of the corrugated sheet 6 when the second spurs 82 press the groove portions of the corrugated sheet 6, and the sheet 6 may be maintained in the corrugated shape.

Figure 10A:
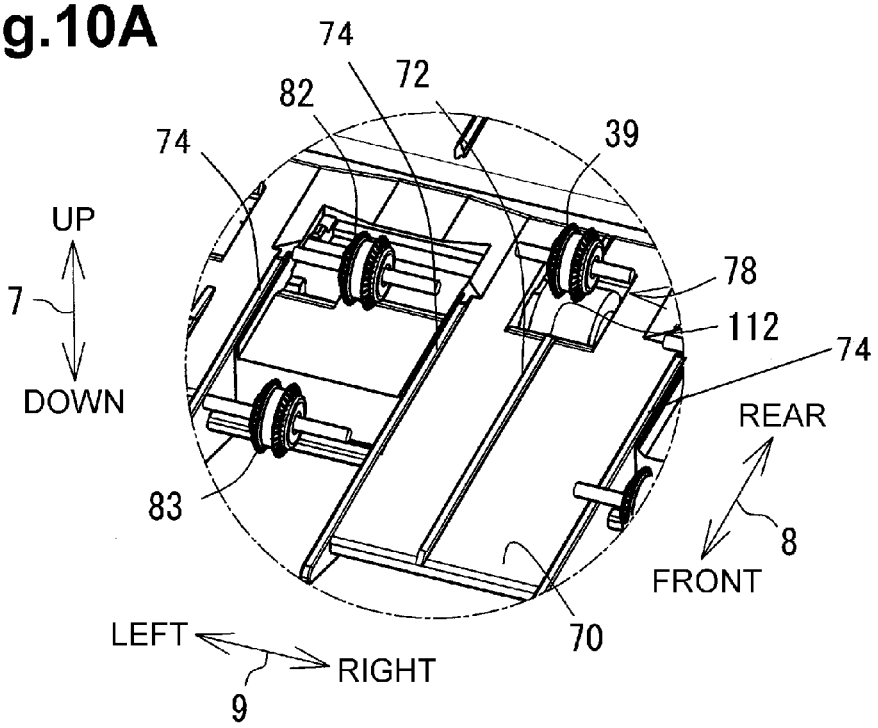
FIG. 10A is partial perspective view depicting a support member in a fourth variation of the first illustrative embodiment according to one or more aspects of the disclosure.

A fourth variation of the first illustrative embodiment is now described. In the above-described first illustrative embodiment, as depicted in FIG. 6, the second rib portions may comprise the second ribs 72 and the third ribs 73. Nevertheless, in the fourth variation, for example, as depicted in FIG. 10A, the second ribs 72 may extend to respective positions downstream of the third spurs 83 with respect to the conveying direction 19, instead of providing the third ribs 73. The second ribs 72 may hold the ridge portions of the sheet 6, respectively, when the second spurs 82 and the third spurs 83 press the groove portions of the sheet 6, respectively, from above. Therefore, the sheet 6 may be reliably maintained in the corrugated shape. In the fourth variation, the second ribs 72 may correspond to the second rib portions. All or one or more of the second ribs 72 may be configured like the second ribs 72 according to the fourth variation. In addition to the third ribs 73 (see FIG. 6), the second ribs 72 may extend to the respective positions downstream of the third spurs 83 with respect to the conveying direction 19.

Figure 10B:
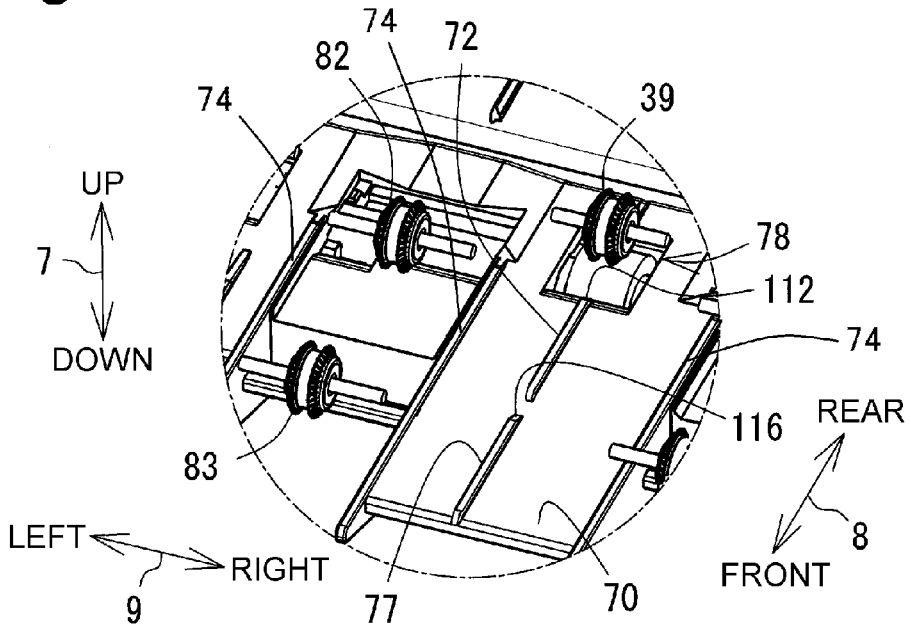
FIG. 10B is a partial perspective view depicting a support member in a fifth variation of the first illustrative embodiment according to one or more aspects of the disclosure.

A fifth variation of the first illustrative embodiment is now described. In the fourth variation, as depicted in FIG. 10A, the second ribs 72 may extend to the respective positions downstream of the third spurs 83 with respect to the conveying direction 19, instead of providing the third ribs 73. Nevertheless, in the fifth variation, for example, as depicted in FIG. 10B, seventh ribs 77 may be disposed instead of providing the third ribs 73. The seventh ribs 77 may be disposed as the same respective positions, in the right-left direction 9, as the second ribs 72. The seventh ribs 72 may extend to respective positions downstream of the second ribs 72 in the conveying direction 19. Upstream ends of the seventh ribs 77 may be disposed upstream of the third spurs 83 in the conveying direction 19. Downstream ends of the seventh ribs 77 may be disposed downstream of the third spurs 83 with respect to the conveying direction 19. Upper edges of the seventh ribs 77 may be located at the same level as the upper edges of the second ribs 72. Each of the seventh ribs 77 may comprise a seventh guide surface 117 at the upstream end of the seventh rib 77 with respect to the conveying direction 19. In each of the seventh ribs 77, the seventh guide surface 117 may extend obliquely upward from the upper surface of the support member 70 to the upper edge of the seventh rib 77. The seventh guide surfaces 117 may come into contact with the ridge portions of the corrugated sheet 6 to allow the ridge portions of the corrugated sheet 6 to move to the upper edges of the seventh ribs 77. This configuration may reduce catching of the sheet 6 on the upstream ends of the seventh ribs 77. In the fifth variation, the second ribs 72 and the seventh ribs 77 may correspond to the second rib portions according to the disclosure.

The seventh ribs 77 may hold the ridge portions of the sheet 6 when the third spurs 83 press the groove portions of the sheet 6. With this configuration, the sheet 6 may be further reliably maintained in the corrugated shape. One or more of the second ribs 72 according to the first illustrative embodiment may be configured like the second ribs 72 according to the fifth variation. In other embodiments, for example, one or more of the second ribs 72 may be configured like the second ribs 72 according to the fifth variation and one or more of the rest of the second ribs 72 may be configured like the second ribs 72 according to the fourth variation.

Other variations of the first illustrative embodiment are now described. In the above-described first illustrative embodiment, the third spurs 83 may be disposed in pairs on respective elastic shafts 101 to press the respective groove portions of the corrugated sheet 6. Nevertheless, in other variations, for example, one each of the third spurs 82 may be disposed on each of the elastic shafts 101. The third spurs 83 may be configured to press the respective groove portions that are being pressed by the corresponding second spurs 82. Accordingly, it may be unnecessary for the third spurs 83 to press the sheet 6 with the same force as that applied by the second spurs 82. In some cases, it may be unnecessary to scatter or distribute the sheet pressing force of the third spurs 83. In this case, one each of the third spurs 83 may be disposed on each of the elastic shafts 101.

According to one or more aspects, when the force of the second spurs 82 that press the sheet 6 is smaller, one each of the second spurs 82 may also be disposed on each of the elastic shafts 101.

In the above-described first illustrative embodiment, the third spurs 83 may be provided in the inkjet recording apparatus 10. Nevertheless, in other embodiments or variations, for example, the inkjet recording apparatus 10 might not comprise the third spurs 83. Instead, the second spurs 82 may maintain the sheet 6 in the corrugated shape appropriately by pressing the groove portions of the corrugated sheet 6 without providing/using the third spurs 83.

In the above-described first illustrative embodiment, the support member 70 may be provided in the inkjet recording apparatus 10. Nevertheless, in other embodiments or variations, for example, the inkjet recording apparatus might not comprise the support member 70. In this case, the second spurs 82 may be disposed downstream of the nip points of the discharge roller pair 37 in the conveying direction 19 and close to the nip points of the discharge roller pair 37. With this configuration, the discharge roller pair 37 and the second spurs 82 may maintain the sheet 6 in the corrugated shape appropriately even though the second ribs 72 of the support member 70 do not hold the ridge portions of the corrugated sheet 6.

In the above-described first illustrative embodiment, the holder 103 may comprise the first guide surfaces 111. However, in other embodiments or variations, for example, the holder 103 might not comprise the first guide surfaces 111. In this case, the discharge roller pair 37 may be disposed as close to the nozzles 47 of the recording head 46, in the conveying direction 19, as possible. With this configuration, the discharge roller pair 37 may nip the sheet 6 therebetween immediately after the sheet 6 becomes flat due to the ink droplets adhered to the sheet 6. Therefore, it may become unnecessary to guide the groove portions of the corrugated sheet 6 to the second spurs 82.

In the above-described first illustrative embodiment, the first to seventh guide surfaces 111-117 may be provided. Nevertheless, in other embodiments or variations, for example, the first to seventh guide surfaces 111-117 might not be provided. The sheet 6 may be maintained in the corrugated shape appropriately and the risk of a paper jam may be reduced without the provision of the first to seventh guide surfaces 111-117.

In the above-described first illustrative embodiment, the first to seventh guide surfaces 111-117 may be the inclined surfaces (flat surfaces). Nevertheless, in other embodiments or variations, for example, the first to seventh guide surfaces 111-117 may be spherical surfaces or curved surfaces.

Figure 11:
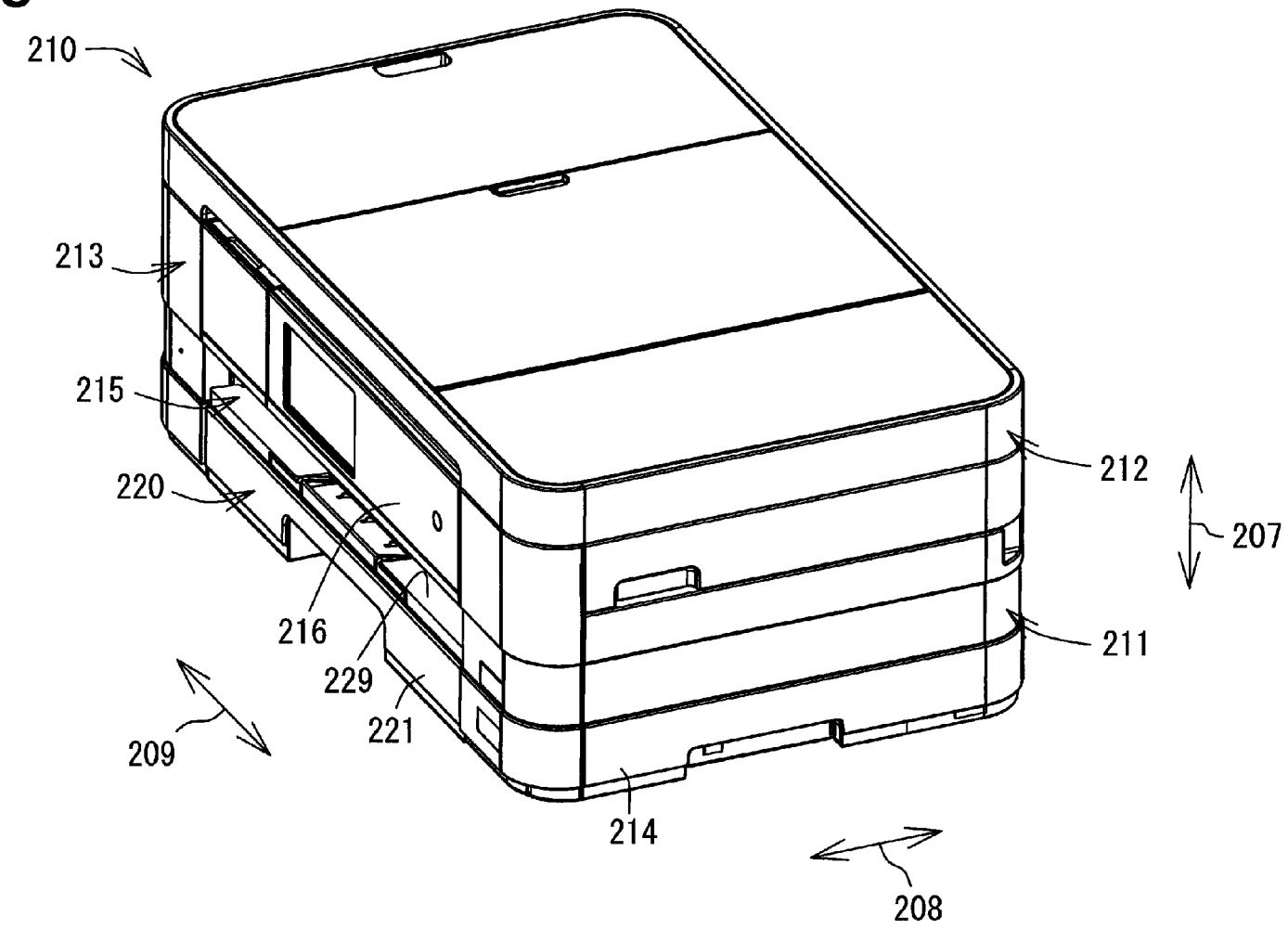
FIG. 11 is a perspective view depicting an inkjet recording apparatus in a second illustrative embodiment according to one or more aspects of the disclosure.

Hereinafter, a second illustrative embodiment according the one or more aspects is described. As depicted in FIG. 11, an up-down direction 207 may be defined with reference to an orientation of an inkjet recording apparatus 210 that may be disposed in which it may be intended to be used/operated. A side of the inkjet recording apparatus 210, in which a control panel 216 may be provided, may be defined as the front of the inkjet recording apparatus 210. A front-rear direction 208 may be defined with reference to the front of the inkjet recording apparatus 210. A right-left direction 209 may be defined with respect to the inkjet recording apparatus 210 as viewed from its front.

As depicted in FIG. 11, the inkjet recording apparatus 210 may comprise a printer unit 211 and a scanner unit 212. The printer unit 211 may be configured to record an image onto a sheet 206 (see FIG. 12). The sheet 206 may be, for example, recording paper, glossy paper, a postcard or other types of recording media. The scanner unit 212 may be configured to read an image recorded on a document (not depicted). The inkjet recording apparatus 210 may be configured to perform one or more of printing, scanning, and copying. The inkjet recording apparatus 210 might not necessarily comprise the scanner unit 212, whose detailed description is omitted.

As depicted in FIG. 11, the inkjet recording apparatus 210 may comprise a housing 214. The housing 214 may have an opening 215 in the front of the housing 214 with respect to the front-rear direction 8. A sheet feed cassette 220 may be inserted into or removed from the inkjet recording apparatus 210 via the opening 215. The housing 214 may comprise rails (not depicted) at a back portion of the housing 214 and behind the opening 215. The rails may be configured to support the sheet feed cassette 220 slidably along the front-rear direction 208.

Figure 12:
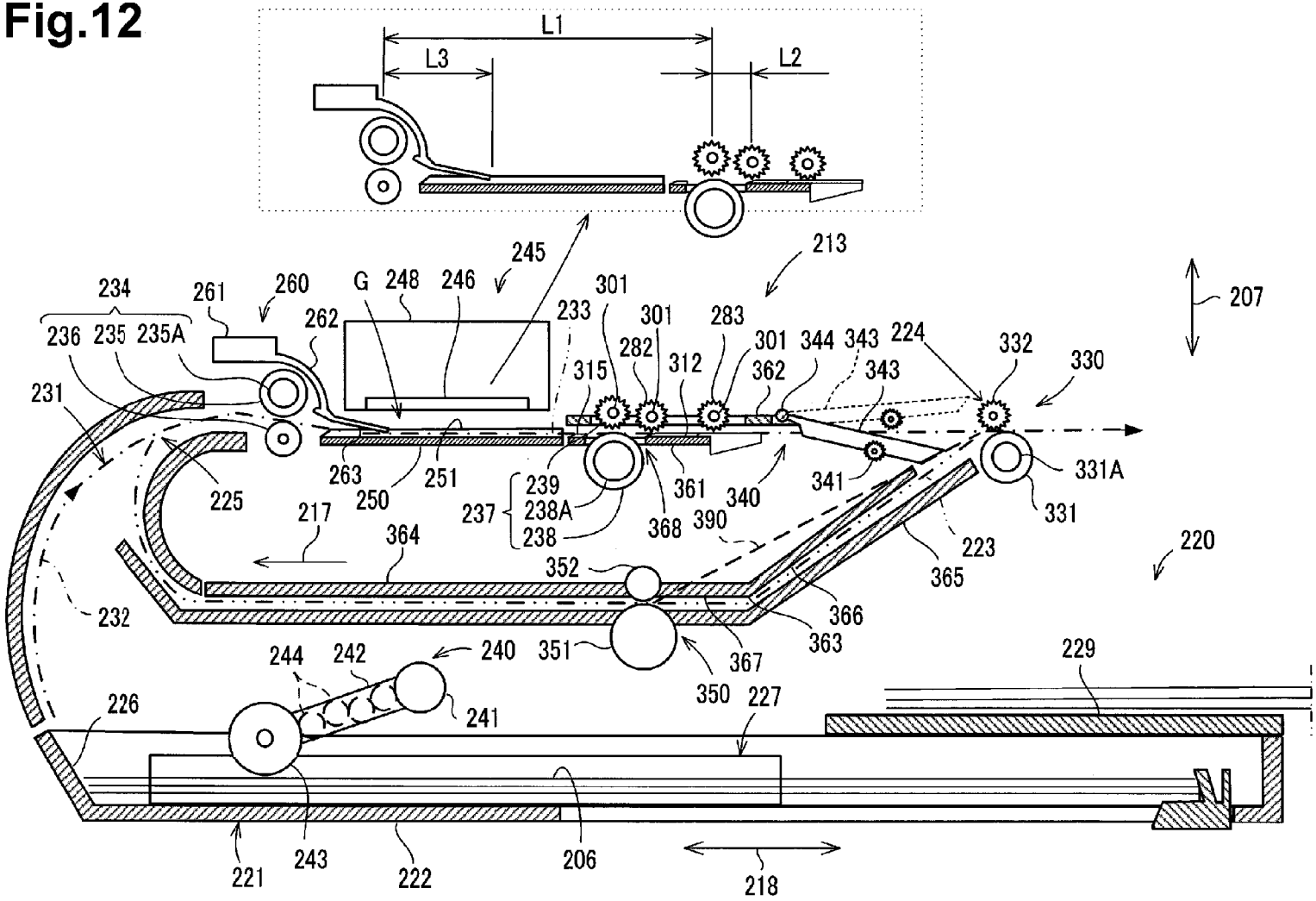
FIG. 12 is a schematic longitudinal sectional view depicting a main body of inkjet recording apparatus of FIG. 11 in the second illustrative embodiment according to one or more aspects of the disclosure.

The printer unit 211 may comprise a main body 213 and the sheet feed cassette 220. The sheet feed cassette 220 may be disposed in a lower portion of the main body 213. As depicted in FIG. 12, the sheet feed cassette 220 may be configured to accommodate one or more sheets 206 that may be loaded therein by a user.

As depicted in FIG. 12, the sheet feed cassette 220 may comprise a main tray 221 and a sheet discharge tray 229. The main tray 221 may be configured to hold one or more sheets 206 on which an image is to be recorded. The sheet discharge tray 229 may be configured to receive one or more sheets 206 on which an image has been recorded. The sheet discharge tray 229 may be disposed above the main tray 221 and supported by the main tray 221.

The main tray 221 may comprise a lower surface 222 and an inclined wall 226. One or more sheets 206 may be received on the lower surface 222 of the main tray 221. The inclined wall 226 may extend obliquely upward from a rear end of the lower surface 222 in the front-rear direction 8. The inclined wall 226 may be configured to allow the one or more sheets 6 to move obliquely upward into a first conveying path 231 from a feeding portion 240 disposed in the housing 214 of the main body 213 of the printer unit 211. A side guide mechanism 227 may be disposed on the lower surface 222. The side guide mechanism 227 may be configured to center the one or more sheets 206 received on the lower surface 222 (center alignment). In the center alignment, one or more sheets 206 of any size may be positioned on the lower surface 222 while the center line of the one or more sheets 206 with respect to the right-left direction 209 may be aligned with the center line of the main tray 221 with respect to the right-left direction 209.

As depicted in FIG. 12, the feeding portion 240 may comprise a support shaft 241, an arm 242, and a feed roller 243. The support shaft 241 may be rotatably supported by a frame (not depicted). The arm 242 may extend obliquely downward from the support shaft 241. One end of the arm 242 may be rotatably supported by the support shaft 241 and the other end of the arm 242 may rotatably support the feed roller 243. The arm 242 may comprise a plurality of gears 244 for transmitting the rotation of the support shaft 241 to the feed roller 243.

The feed roller 243 may be configured to be rotated by a rotation force of the support shaft 241 transmitted through the plurality of gears 244. The feed roller 223 may be configured to feed the one or more sheets 206, one by one, from the main tray 221 toward the rear with respect to the front-rear direction 208 with the rotation of the feed roller 243. The fed sheet 206 may be allowed to move into the first conveying path 231 by the inclined wall 226 of the main tray 221.

As depicted in FIG. 12, the first conveying path 231 may be defined by a plurality of defining members, including a first defining member 361 and a second defining member 362, and a platen 250. The defining members other than the first defining member 361 and the second defining member 362 are omitted from the drawings. The first conveying path 231 may comprise a curved section 232, indicated by a dotted and dashed line, and a straight section 233, indicated by a double-dotted and dashed line. The curved section 232 may extend upward from an upper end of the inclined wall 226 of the main tray 221 and may be curved toward the front in the front-rear direction 208. The straight section 233 may extend from an end of the curved section 232 toward the front in the front-rear direction 208.

As depicted in FIG. 12, a second conveying path 223 may extend from a first junction 224 to a second junction 225. The first junction 224 may be located between the discharge roller pair 237 and a reversible roller pair 330 in the first conveying path 231. The second junction 225 may be located upstream of a conveyor roller 235 in the curved section 232 with respect to the conveying direction 219. The second conveying path 223 may extend obliquely downward toward the rear (e.g., toward the recording portion 245 with respect to the first junction 224) from the first junction 224 and join the curved section 232 of the first conveying path 231 at the second junction 225 by passing under the recording portion 245 and above the feed roller 243. The sheet 206 may be conveyed in the second conveying path 223 along a conveying direction 217. The conveying direction 217 may extend from the first junction 224 to the second junction 225 in the second conveying path 223.

As depicted in FIG. 12, the platen 250 may be disposed above the sheet feed cassette 220. The platen 250 may be supported by a frame (not depicted) of the printer unit 211 at both ends of the platen 250 in the right-left direction 209.

Figure 13:
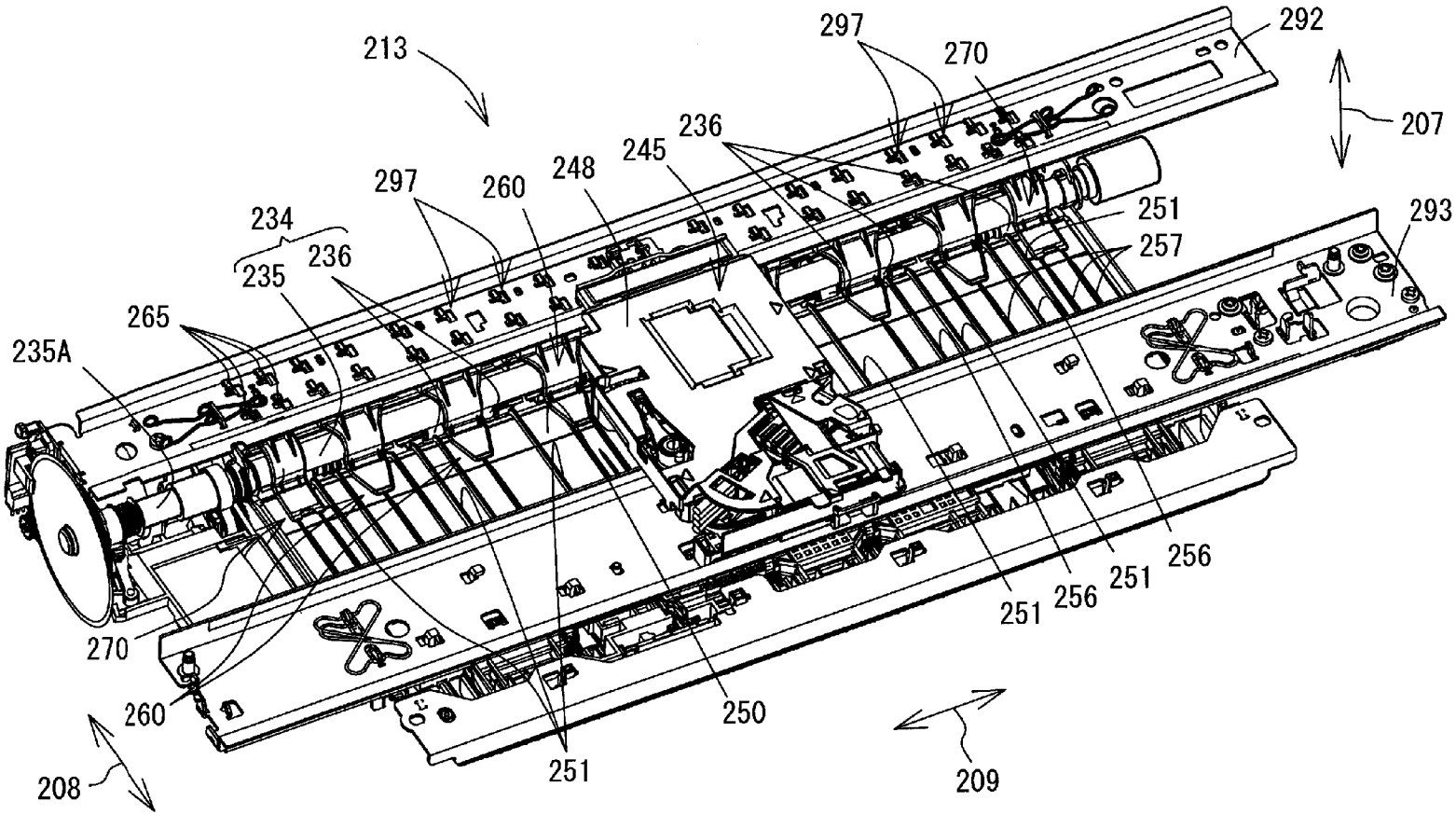
FIG. 13 is a perspective view depicting essential parts of the main body in the second illustrative embodiment according to one or more aspects of the disclosure.
Figure 14:
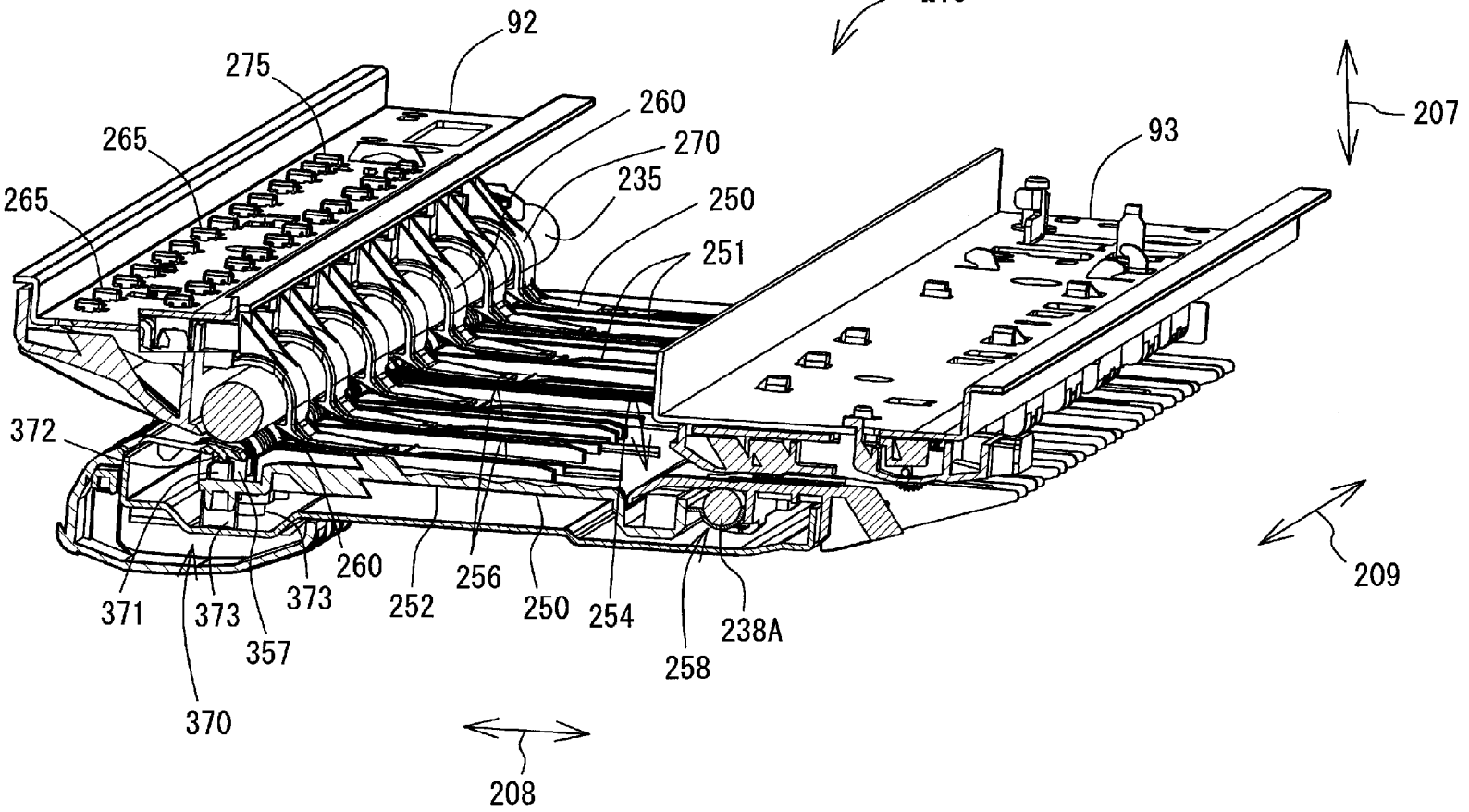
FIG. 14 is a perspective view depicting the essential parts of the main body in the second illustrative embodiment according to one or more aspects of the disclosure.

As depicted in FIGS. 13 and 14, the platen 250 may have sides whose lengths along the front-rear direction 208 and the right-left direction 209 may be greater than a thickness of the platen 250 along the up-down direction 207 while the platen 250 is supported by the frame.

The platen 250 may comprise an engagement portion 258 at its front end. The engagement portion 258 may protrude forward from the front end of the platen 250. The engagement portion 258 may have a cylindrical shape and be configured to engage a periphery of a rotating shaft 238A of discharge rollers 238. The rotating shaft 238A of the discharge rollers 238 may be rotatably fitted in the engagement portion 258. With this configuration, the platen 250 may be configured such that a rearward part of the platen 250 in the front-rear direction 208 may pivot about the rotating shaft 238A of the discharge rollers 238. For example, the platen 250 may be configured to be movable by its pivoting. In the second illustrative embodiment, the platen 250 may be configured to be pivotable about the rotating shaft 238A. Nevertheless, in other embodiments, for example, the platen 250 may be configured to be movable by other configurations. For example, the platen 250 may be configured such that the whole part of the platen 250 may be moved along the up-down direction 207 by a known cam function.

As further depicted in FIG. 13, the platen 250 may comprise a plurality of first ribs 251, a plurality of eighth ribs 256, and a plurality of ribs 257 that may protrude toward the recording head 246 (upward) from an upper surface of the platen 250.

Figures 21A, 21B:
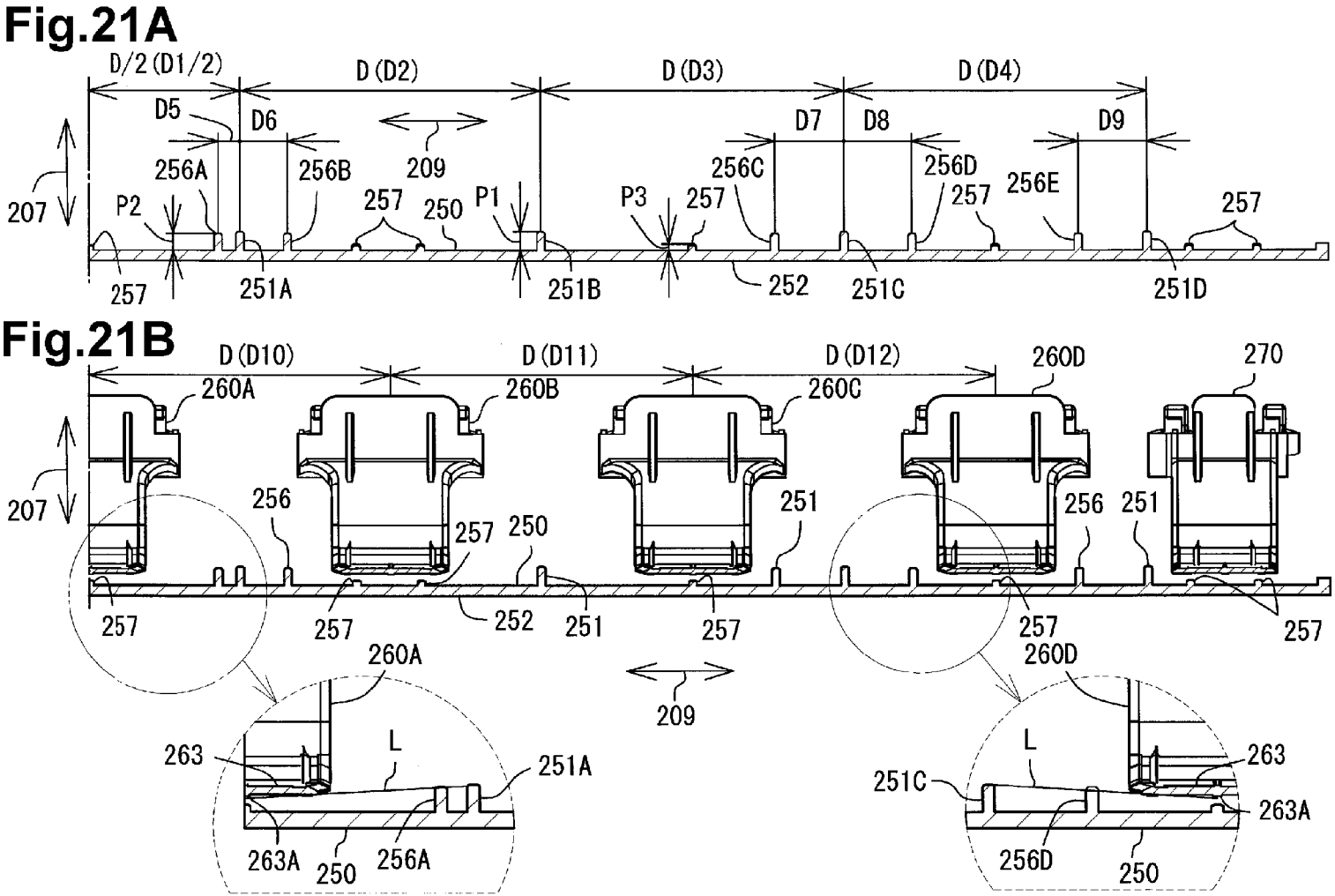
FIG. 21A is a sectional view depicting the platen, taken along the line extending in the right-left direction, in the second illustrative embodiment according to one or more aspects of the disclosure.
FIG. 21B is a sectional view depicting the platen and the contact members, taken along the line extending in the right-left direction, in the second illustrative embodiment according to one or more aspects of the disclosure.
Figure 22A:
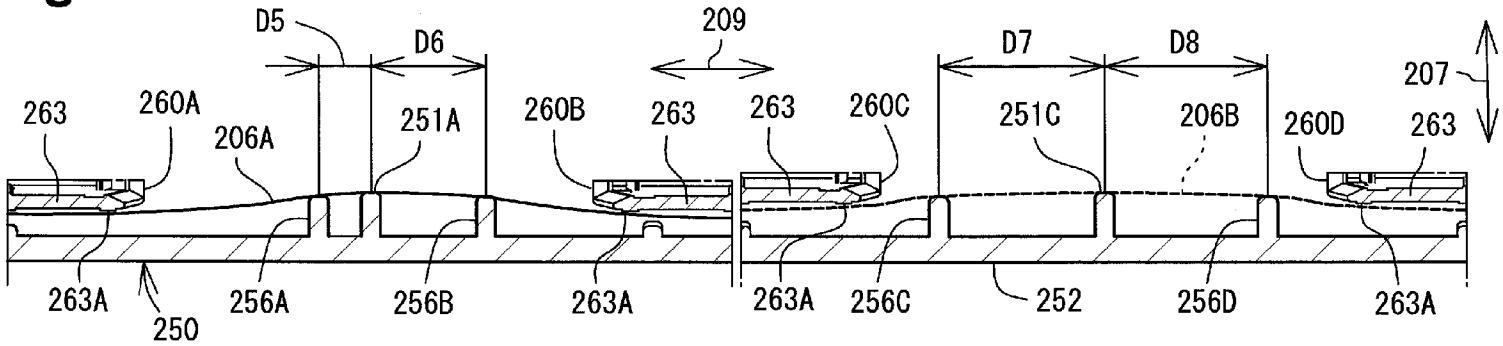
FIG. 22A is a sectional view depicting the platen and the contact members, taken along the line extending in the right-left direction, in the second illustrative embodiment according to one or more aspects of the disclosure.

As depicted in FIG. 22A, the first ribs 251 (251A-251D) may be provided for holding the sheet 206 (206A, 206B) being conveyed to form ridge portions in the sheet 206 (206A, 206B). Each of the first ribs 251 may be disposed between adjacent contact members 260 (260A-260D) with respect to the right-left direction 209. In a particular example, as depicted in FIG. 21A, the first rib 251A that may be disposed at a position closest to the middle of the platen 50 with respect to the right-left direction 209 may be disposed at a distance D1/2 from the middle of the platen 250. The first rib 251B disposed on the right of the first rib 251A may be disposed at a distance D2 from the first rib 251A. The first rib 251C disposed to the right of the first rib 251B may be disposed at a distance D3 from the first rib 251B. The first rib 251D disposed to the right of the first rib 251C may be disposed at a distance D4 from the first rib 251C. Each two adjacent contact members, in the right-left direction 209, of the contact members 260 may be spaced apart from each other at distance D. Each of the first ribs 251A-251D may be disposed at the middle position between each adjacent pair of the contact members 260. Therefore, the distances D1, D2, D3, D4 may be the same as the distance D. The first ribs 251 may extend along the conveying direction 219 such that the first ribs 251 may extend across the platen 250 in the front-rear direction 208. With the arrangement of the first ribs 251 as described above, the distance between a top of a ridge portion and a bottom of a groove portion of each curve in the corrugation pattern along the right-left direction 209 may correspond to the same distance. Thus, the control of the recording head 246 may be facilitated.

As depicted in FIG. 21A, a protruding amount P1 of the first ribs 251 from the an upper surface of a base 252 of the platen 250 may be determined or defined such that upper edges of the first ribs 251 may be located higher than lower edges of front ends of contact ribs 263A of the contact portions 263, respectively, with respect to the front-rear direction 208. With this configuration, the sheet 206 being conveyed may be formed into a corrugated shape in which the sheet 206 may have ridge portions that may be held by the first ribs 251 and groove portions that may be depressed by the contact portions 263. The protruding amount P1 of the first ribs 251A-251D may be equal to form ridge portions having the same height in the sheet 206.

In some arrangements, forming a middle part of the sheet 206 with a corrugated shape may be more difficult than forming the corrugated shape in side parts, in the right-left direction 209, of the sheet 206. Therefore, in some examples, it may be difficult to ensure uniform stiffness in the sheet 206 with respect to the right-left direction 209 by the first ribs 251 and contact members 260, 270 only.

The eighth ribs 256 depicted in FIGS. 21A and 21B may come into contact with a part of the sheet 206 when the sheet 206 is formed into the corrugated shape. At that time, the eighth ribs 256 may allow the curvature radius of the curve formed closer to the middle part of the sheet 206 with respect to the right-left direction 209 to become smaller than the curvature radius of the curves formed farther from the middle part of the sheet 206. The eighth ribs 256 may be provided for increasing or maximizing the uniformity of stiffness of the sheet 206 in the right-left direction 209. Hereinafter, the plurality of eighth ribs 256 may be also referred to as eighth ribs 256A, 256B, 256C, 256D, 256E, which may also represent the order of proximity to the middle of the platen 250 in the right-left direction 209.

A protruding amount P2 of the eighth ribs 256A-256E from the upper surface of the platen 250 may be equal to each other. The eighth rib 256A may be disposed between the contact member 260A and the first rib 251A. The eighth rib 256B may be disposed between the first rib 251A and the contact member 260B. The eighth rib 256C may be disposed between the contact member 260C and the first rib 251C. The eighth rib 256D may be disposed between the first rib 251C and the contact member 260D. The eighth rib 256E may be disposed between the contact member 260D and the first rib 251D.

A distance D5 between the eighth rib 256A and the first rib 251A may be shorter than a distance D6 between the first rib 251A and the eighth rib 256B. The distance D6 may be shorter than a distance D7 between the first rib 251C and the eighth rib 256C. The distance D7 may be equal to a distance D8 between the first rib 251C and the eighth rib 256D. The distance D8 may be equal to a distance D9 between the first rib 251D and the eighth rib 256E.

The protruding amount P2 of the eighth ribs 256 may be determined such that the eighth ribs 256 may be able to hold the sheet 206. For example, the protruding amount P2 may be determined such that protruding edges (upper edges) of the eighth ribs 256 may be located higher than the lower ends of the contact portions 263 and located lower than protruding edges (upper edges) of the first ribs 251. Furthermore, the protruding amount P2 may be determined such that the upper edges of the eighth ribs 256 may located higher than an imaginary line L. The imaginary line L may extend between the upper edge of the first rib 251 closest to the eighth rib 256, and the lower end of the contact portion 263 closest to the eighth rib 256. For example, as depicted in an enlarged view enclosed by a dashed line in FIG. 21B, the upper edge of the eighth rib 256A may be located higher than the imaginary line L that may extend between the lower edge of the central contact rib 263A of the contact member 260A, with respect to the right-left direction 209, and the upper edge of the first rib 251A. As depicted in another enlarged view enclosed by a dashed line in FIG. 21B, the upper edge of the eighth rib 256D may be located higher than the imaginary line L that may extend between the lower edge of the central contact rib 263A of the contact member 260D and the upper edge of the first rib 251C with respect to the right-left direction 209. The protruding amount P2 may be determined such that the upper edges of the eighth ribs 256 may be located lower than the upper edges of the first ribs 251. With this configuration, portions of the sheet 6 that may be held by the eighth ribs 256 may prevented from becoming the tops of the ridge portions in the corrugation pattern.

Figure 22B:
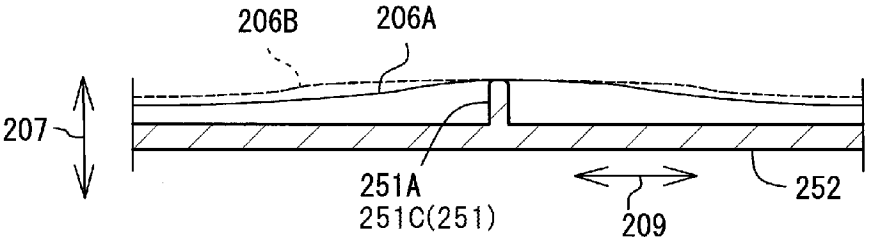
FIG. 22B is a sectional view depicting the platen taken along the line extending in the right-left direction, in which a first case where one of first ribs holds a portion of a sheet and a second case where another of the first ribs holds another portion of the sheet are illustrated in the drawing, in the second illustrative embodiment according to one or more aspects of the disclosure.

With this arrangement of the eighth ribs 256, the curvature radius of the curves disposed closer to the middle part of the sheet 206 with respect to the right-left direction 209 may be smaller than the curvature radius of the curves disposed farther from the middle part of the sheet 206. This arrangement of the eighth ribs 256 are described in detail with reference to FIGS. 22A and 22B. In FIG. 22A, a portion 206A of the sheet 206 and a portion 206B of the sheet 206 are illustrated. The portion 206A may be held by the first rib 251A disposed at the middle part of the platen 250 with respect to right-left direction 209. The portion 206B may be may be held by the first rib 251C disposed at a right-end part of the platen 250. FIG. 22B depicts the portion 206A of the sheet 206 and the portion 206B of the sheet 206 in the same drawing.

The sheet 206 being conveyed may be held by the first ribs 251 and the eighth ribs 256 and depressed the contact portions 263. The distance D5 between the eighth rib 256A and the first rib 251A and the distance D6 between the eighth rib 256B and the first rib 251A may be shorter than the distance D7 between the eighth rib 256C and the first rib 251C or the distance D8 between the eighth rib 252D and the first rib 251C. Therefore, as depicted in FIG. 22B, the radius curvature of the curve of the ridge portion in the portion 206A of the sheet 206 may be smaller than the radius curvature of the curve of the ridge portion in the portion 206B of the sheet 206.

According to the distances D5-D8, the distance between the eighth rib 256C and the contact member 260C in the right-left direction 209 and the distance between the eighth rib 256D and the contact member 260D may be shorter than the distance between the eighth rib 256A and the contact member 260A. In one example, a distance between the eighth rib 256 and the bottom of a corresponding groove portion in the right-left direction 209 may be longer at the position closer to the middle of the platen 250. Therefore, the contact portion 263 of the contact member 260A disposed closer to the middle of the platen 250 may be deformed less than the contact portions 263 of the contact members 260D, 260E disposed farther from the middle of the platen 250. Therefore, the radius curvature of the curve of the groove portion in the corrugation pattern in the portion 206A of the sheet 206 may be smaller than the radius curvature of the curve of the groove portion in the corrugation pattern in the portion 20B of the sheet 206. Moreover, the radius curvature of the curves of the ridge portions and the groove portions in the corrugation pattern in the portion 206A of the sheet 206 may be smaller than the radius curvature of the curves of the ridge portions and the groove portions in the corrugation pattern in the portion 206B of the sheet 206. As a result, the stiffness of the sheet 206 in the right-left direction 209 may be increased. Additionally, the tendency of the corrugation pattern of the sheet 6 to be deformed may be reduced and the image-recording accuracy may be improved.

Figure 22C:
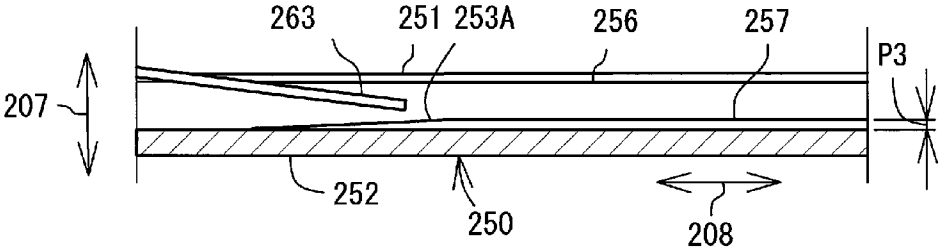
FIG. 22C is a sectional view depicting the platen and the contact members, taken along a line extending in a front-rear direction, in the second illustrative embodiment according to one or more aspects of the disclosure.

When an image is recorded on a sheet 206 other than glossy paper, for example, plain paper or thick paper, with a large amount of ink (e.g., when a photo image is recorded on such a sheet 206), the sheet 206 may swell due to the ink adhered to the sheet 206. The ribs 257 depicted in FIG. 13 may be provided for preventing the groove portions of the sheet 206 from sliding over the upper surface of the platen 250 when such a situation occurs. The ribs 257 may extend along the conveying direction 219 from below downstream ends of the contact portions 263, respectively, with respect to the conveying direction 219 (the front ends of the contact portions 263 with respect to the front-rear direction 208). Each of the ribs 257 may be disposed between adjacent ribs, in the right-left direction 209, of the first ribs 251. As depicted in FIG. 22C, each of the ribs 257 may comprise an inclined surface 253A at its upstream end with respect to the conveying direction 219. The inclined surfaces 235A may be inclined upward along the conveying direction 219. The inclined surfaces 253A may be located below the respective contact portions 263. Therefore, the inclined surfaces 253A of the ribs 277 may reduce catching of the sheet 6 on the ribs 257. As depicted in FIG. 22A, a protruding amount P3 of the ribs 257 from the upper surface of the base 252 of the platen 250 may be determined or defined such that upper edges of the ribs 257 may be located lower than the lower edges of the front ends of the contact ribs 263A, respectively, with respect to the front-rear direction 208

As depicted in FIG. 21B, one of the ribs 257 may be disposed in front of the contact member 260A disposed at the middle of the platen 250 (e.g., the middle of a printing area) in the right-left direction 209. The one of the ribs 257 may be disposed at a position corresponding to the middle of the contact member 260A in the right-left direction 209. Two of the other ribs of the ribs 257 may be disposed in front of the contact member 260B disposed to the right of the contact member 260A. The two other ribs of ribs 257 may be spaced apart from each other with respect to the right-left direction 209. One each of the rest of the ribs 257 may be disposed in front of the contact members 260C, 260D, and at the respective middle positions of the contact members 260C, 260D, in the right-left direction 209. Two of the rest of the ribs 257 may be disposed in front of each of the contact members 270 and spaced apart from each other with respect to the right-left direction 209. For example, when the groove portions of the corrugated sheet 206 move down due to swelling of the sheet 206 due to a large amount of ink adhered to the sheet 206, the groove portions of the sheet 206 may come into contact with the respective ribs 257. The ribs 257 may prevent the groove portions of the sheet 206 from sliding over the upper surface of the platen 250. As a result, the deformation of the corrugation pattern of the sheet 206 and the conveyance resistance to the sheet 206 may be reduced. Thus, the degradation of the image-recording accuracy may be reduced. Two ribs of the ribs 257 may be disposed at a position corresponding to a position of the contact member 260B. Other pairs of ribs of the ribs 257 may also be disposed at each position corresponding to positions of the contact members 270. With this configuration, one or both of the two ribs 257 may be able to hold sheets having slightly different sizes in the right-left direction 209 (for example, postcard and L-size paper (corresponding to 3R-size paper), or legal-size paper and A4-size paper).

Figure 18:
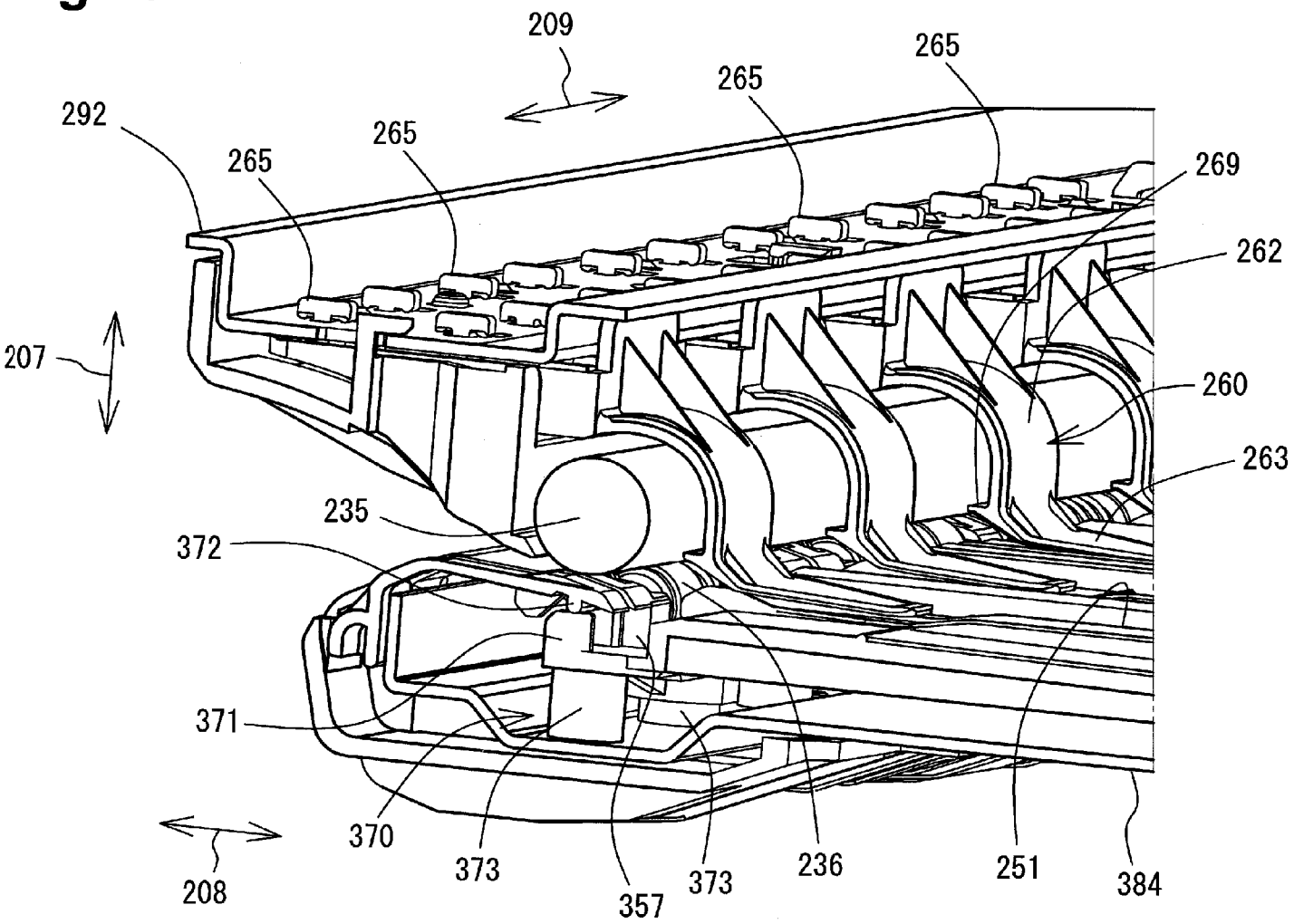
FIG. 18 is a perspective view depicting a portion in the vicinity of the interlocking portion 370 in the second illustrative embodiment according to one or more aspects of the disclosure.

As depicted in FIGS. 14 and 18, the first ribs 251 and the eighth ribs 256 may extend to the respective positions downstream of the contact portions 263, 273 of the contact members 260, 270 with respect to the conveying direction 219. An area 254, disposed downstream of the first ribs 251 and the eighth ribs 256 in the platen 250 in the conveying direction 219 and devoid of the first ribs 251 and the eighth ribs 256 on the platen 250, may be used in borderless printing in which an image may be recorded without white space around the edges of the sheet 206. When the recording head 246 ejects ink droplets onto the edges of the sheet 206 to record an image thereon, the ink droplets may adhere to the platen 250, which may be the outside of the sheet 206, without landing on the sheet 206. If the first ribs 251 and the eighth ribs 256 are disposed in the area where ink droplets may be deposited in borderless printing, the ink droplets ejected to the outside of the sheet 206 may adhere to one or more of the first ribs 251 and the eighth ribs 256 for smaller sheets. As a result, an opposite side to the recording surface of a larger sheet 206 may be held by the first ribs 251 and the eighth ribs 256 during borderless printing, and may thus get dirty with ink. Therefore, the first ribs 251 and the eighth ribs 256 may not be disposed in the area 254.

As described above, the area 254 may be used to record an image to the edges of the sheet 206 in the borderless printing. The first ribs 251 and the eighth ribs 256 may extend to the vicinity of the area 254. This configuration may also reduce the tendency of the corrugation pattern in the sheet 206 to be deformed at the position downstream of the contact portions 263, 273 with respect to the conveying direction 219. Thus, the image-recording accuracy may be improved.

As depicted in FIGS. 14, 17A, 17B, 18, and 19, the printer unit 211 may further comprise an interlocking portion 370. The interlocking portion 370 may comprise a holder 357 of following rollers 236, contact portions 371, receiving portions 372, and springs 373. The platen 250 may comprise the contact portions 371 that may make contact with the holder 357 of the following rollers 236.

Figure 17A:
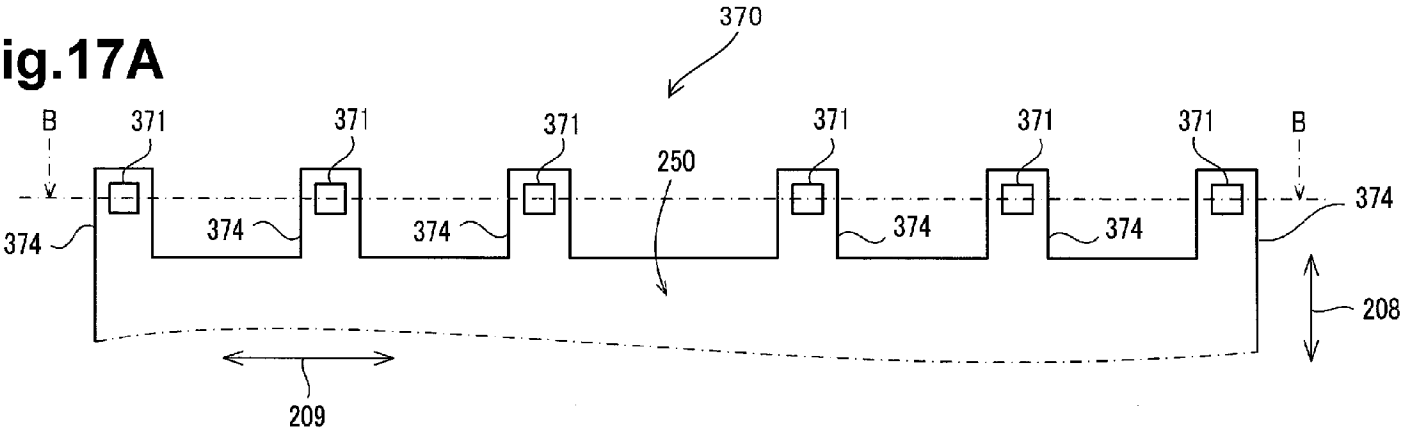
FIG. 17A is a plan view depicting an interlocking portion in the second illustrative embodiment according to one or more aspects of the disclosure.

In the second illustrative embodiment, as depicted in FIG. 17A, a plurality of protrusions 374 may protrude rearward from a rear end of the platen 250. The plurality of protrusions 374 may be spaced apart from each other in the right-left direction 209. The contact portions 371 may extend upward from tip ends of the protrusions 374, respectively. The platen 250 may be configured to pivot about the rotating shaft 238A of the discharge rollers 238 fitted in the engagement portion 258 provided at the front end of the platen 250. The contact portions 371 may be disposed at the pivoting end of the platen 250. The plurality of protrusions 374 may be spaced apart from each other with respect to the right-left direction 209. The contact portions 371 formed with the protrusions 374 may also be spaced apart from each other in the right-left direction 209.

Figure 17B:
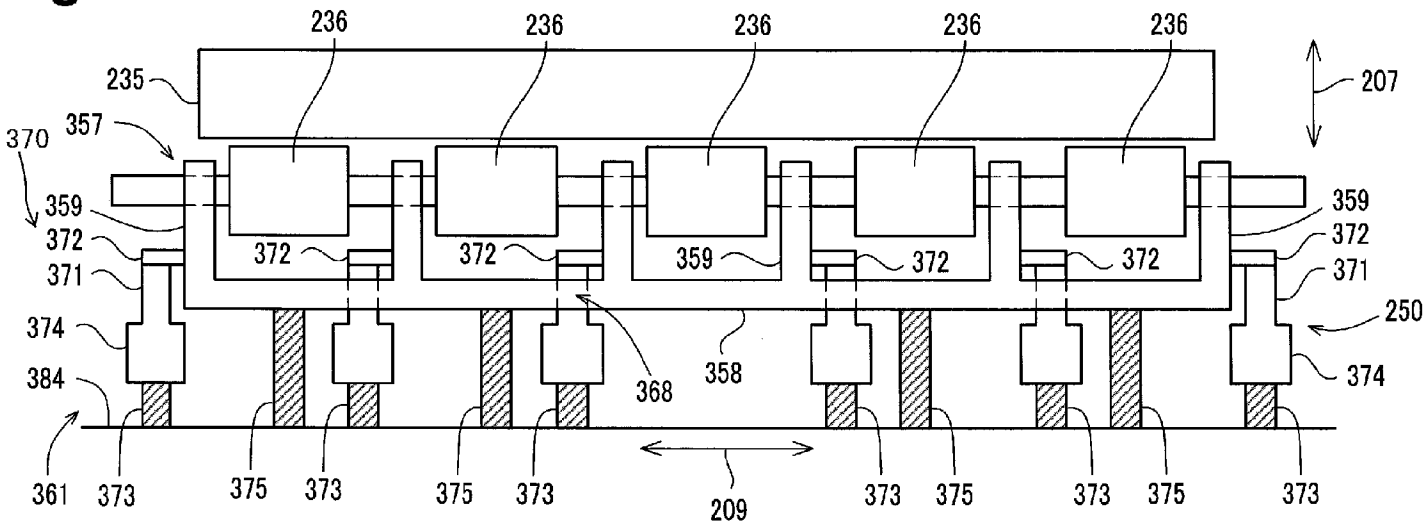
FIG. 17B is a sectional view depicting the interlocking portion, taken along a line extending along the right-left direction, viewed from a direction of an appended arrows B, in the second illustrative embodiment according to one or more aspects of the disclosure.

As depicted in FIG. 17B, the contact portions 371 may be separately disposed from each other at diametrically opposed positions about the center line of the platen 250 in the right-left direction 209. Each of the contact portions 371 may contact a corresponding one of the receiving portions 372 of the holder 357 of the following rollers 236 at each position between the following rollers 236. The holder 357 may have openings 368 in a bottom plate 358 of the holder 357 at respective positions opposite to the respective contact portions 371. The contact portions 371 may be inserted into the respective openings 368 and allowed to come into contact with the respective receiving portions 372 through the openings 368.

The holder 357 of the following rollers 236 may comprise the receiving portions 372 that the respective contact portions 371 may come into contact with. As depicted in FIG. 17B, the receiving portions 372 may be projections, each of which may extend rightward or leftward from a side surface of each of support portions 359 of the holder 357. The support portions 359 may be disposed at predetermined intervals in the right-left direction 209. The receiving portions 372 of the support portions 359 may also be spaced apart from each other in the right-left direction 209.

The receiving portions 372 may be disposed at diametrically opposed positions about the center line of the platen 250 with respect to the right-left direction 209. The receiving portions 372 may be disposed opposite to the corresponding contact portions 371 with respect to the up-down direction 207. Lower surfaces of the receiving portions 372 may be made in contact with upper surfaces of the contact portions 371, respectively.

The springs 373 may be disposed under the platen 250 to urge the platen 250 toward the holder 357 of the following rollers 236. The springs 373 may be disposed at respective positions opposite to the corresponding pairs of the contact portion 371 and the receiving portion 372, respectively, with respect to the right-left direction 209. The springs 373 may be configured to support the respective protrusions 374 of the platen 250 from below. Lower ends of the springs 373 may be attached to a frame 384 of the printer unit 211. With this configuration, the platen 250 may be urged by the springs 373 and the upper surfaces of the contact portions 371 may be in pressure contact with the lower surfaces of the receiving portions 372, respectively.

The protrusions 374 of the platen 250 may be spaced apart from each other with respect to the right-left direction 209. Therefore, the springs 373 disposed under the respective protrusions 374 may be spaced apart from each other in the right-left direction 209.

The springs 373 may be disposed at the respective positions opposite to the corresponding pairs of the contact portion 371 and the receiving portion 372 with respect to the right-left direction 209. The pairs of the contact portion 371 and the receiving portion 372 may be separately disposed from each other at diametrically opposed positions about the center line of the platen 250 with respect to the right-left direction 209. The springs 373 may also be separately disposed from each other at diametrically opposed positions about the center line of the platen 250 with respect to the right-left direction 209. With this arrangement, the springs 373 may urge the platen 250 toward the holder 357 of the following rollers 236 across the platen 250 from the left end portion to the right end portion. That is, the springs 373 may urge at least the middle portion of the platen 250, with respect to the right-left direction 209, toward the holder 357 of the following rollers 236.

The holder 357 of the following rollers 236 may be urged toward the conveyor roller 235 by springs 375. Therefore, the following rollers 236 may be made in pressure contact with the conveyor roller 235. When the sheet 206 enters between the conveyor roller 235 and the following rollers 236, the following rollers 236 may be moved downward by the thickness of the sheet 206 against the springs 373, 375. As the following rollers 236 and the holder 357 are moved downward, the downward movement of the holder 357 may be transmitted to the platen 250 via the receiving portions 372 and the contact portions 371. Thus, the rearward part (the rear-end side where the protrusions 374 may be present) of the platen 250 may be moved downward in accordance with the movement of the following rollers 236.

As depicted in FIG. 12, the recording portion 245 may comprise a carriage 248 disposed above the platen 250, and the recording head 246 mounted on the carriage 248. As depicted in FIG. 13, the carriage 248 may be supported by a pair of front and rear guide rails 292, 293 disposed above the platen 250 and may be configured to reciprocate along the right-left direction 209. The guide rails 292, 293 may be supported by the frame (not depicted) at both ends of the guide rails 292, 293 with respect to the right-left direction 209. The guide rail 293 may be provided with a belt (not depicted) to which the carriage 248 may be fixed. The belt may be rotated by a drive motor (not depicted) to allow the carriage 248 to reciprocate along the right-left direction 209.

Figure 20:
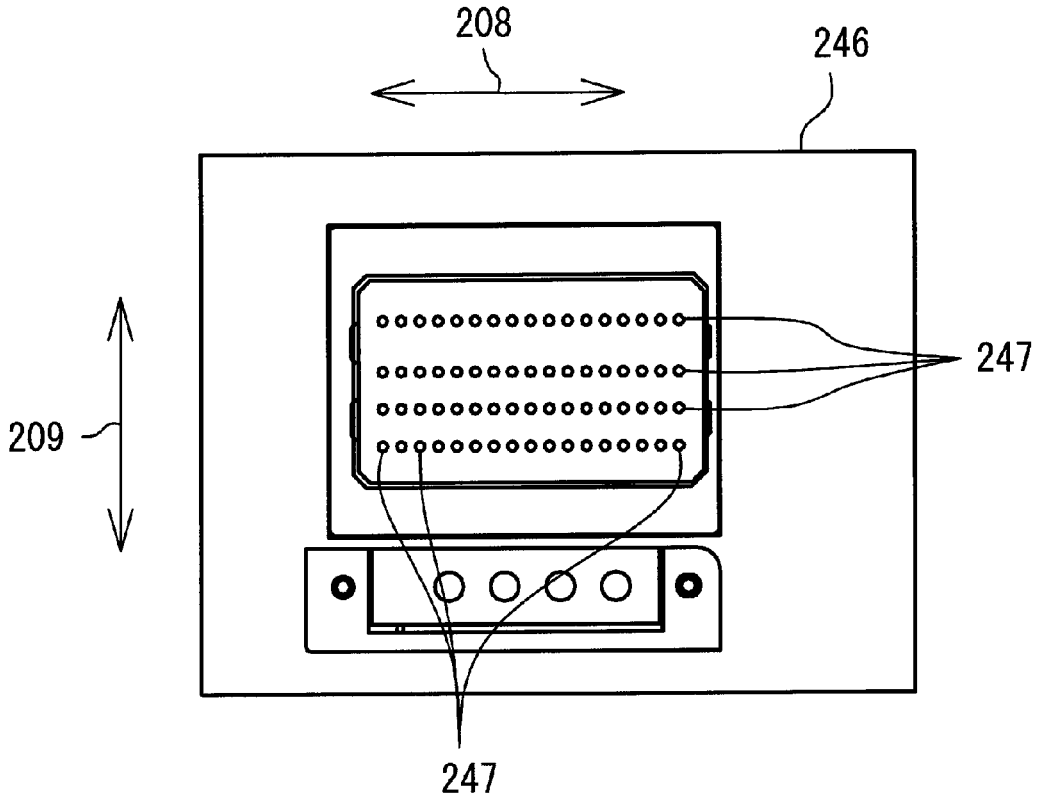
FIG. 20 is a bottom view depicting a recording head in the second illustrative embodiment according to one or more aspects of the disclosure.

Referring again to FIG. 12, the recording head 246 may be mounted on the carriage 248 and disposed above the platen 250 while leaving a gap G between the recording head 246 and the platen 250. As depicted in FIG. 20, the recording head 46 has a plurality of nozzles 47 in a lower surface of the recording head 46 to eject ink droplets therefrom. The recording head 246 may be configured to record an image onto a sheet 206 by ejecting ink droplets from the nozzles 247 onto the sheet 206 held on the platen 250.

FIG. 12 illustrates a conveyor roller pair 234 (as an example of a first conveyor) disposed upstream of the platen 250 (behind the platen 250 with respect to the front-rear direction 208) in the conveying direction 219. The conveyor roller pair 234 may be configured to nip the sheet 206 fed from the feeding portion 240 and convey the fed sheet 206 along the conveying direction 219.

The conveyor roller pair 234 may comprise a rotating shaft 235A, a conveyor roller 235, and the following rollers 236. The rotating shaft 235A may extend along the right-left direction 209 (a direction perpendicular to the drawing sheet of FIG. 12). The conveyor roller 235 may be disposed on the rotating shaft 235A and may be rotated integrally with the rotating shaft 235A. The following rollers 236 may be disposed below the conveyor roller 235. The rotating shaft 235A may be supported by the frame (not depicted) at both ends of the rotating shaft 235A with respect to the right-left direction 209 and may be configured to be rotated by a drive motor (not depicted).

The following rollers 236 may be rotatably supported by the holder 357. The holder 357 may be urged toward the recording head 246 (upward) by the springs 373, 375. The following rollers 236 may be in pressure contact with the conveyor roller 235 by the urging force of the springs 373, 375. The conveyor roller pair 234 may nip the sheet 206 by the conveyor roller 235 and the following rollers 236 and convey the sheet 206 along the conveying direction 219. The sheet 206 being conveyed may be formed into a corrugated shape by the first ribs 251 of the platen 250 and the contact members 260, 270.

As depicted in FIGS. 12 and 13, the contact members 260, 270 may allow the sheet 206 being conveyed to be formed into the corrugated shape in conjunction with the first ribs 251 of the platen 250. As described later, the contact members 260, 270 and the first ribs 251 may form the sheet 206 into the corrugated shape in which the sheet 206 may have ridge portions that may be held by the first ribs 251 and groove portions that may be depressed by the contact members 260, 270.

The first ribs 251 may be disposed at diametrically opposed positions about the center line of the platen 250 with respect to the right-left direction 209. Therefore, the leftward part of the platen 250, in the right-left direction 209, is omitted from the drawing of FIG. 21B. In FIG. 21B, the left end of the platen 250 corresponds to the middle of the platen 250 with respect to the right-left direction 209. One (e.g., contact member 260A) of the contact members 260 may be disposed above the middle of the platen 250 with respect to the right-left direction 209. Three (e.g., contact members 260B, 260C, 260D) of the contact members 260 may be disposed on the right of the contact member 260A disposed at the middle of the platen 250 with respect to the right-left direction 209 while leaving a distance D (D10, D11, D12) between each of the contact members 260. Another three of the contact members 260 may also be disposed on the left of the contact member 260A disposed at the middle of the platen 250 with respect to the right-left direction 209 while leaving the distance D10, D11, D12 between each of the contact members 260.

In one or more examples, the distance D10, the distance D11, and the distance D12 may be equal to each other, e.g., the distance D, to provide the same distance between the ridge portions in the sheet 6 (to form the ridge portions in the sheet 6 at constant intervals). The recording head 246 may be configured to eject ink droplets in consideration of a periodically changeable distance between the recording head 246 and the sheet 206 due to the corrugation pattern formed in the sheet 206. Therefore, the image-recording accuracy may be improved. The distance between the recording head 246 and the sheet 206 may be periodically changed as described above. Accordingly, the control of the recording head 246 may be facilitated.

Hereinafter, the contact members 260 are described in detail with respect to FIGS. 23A-24D. In some arrangements, all of the contact members 260 may have the same configuration, and therefore, the description is provided with respect to one of the contact members 260. In FIGS. 23A-24D, the up-down direction 207, the front-rear direction 208 and the right-left direction 209 may be defined while the contact member 260 may be attached to the guide rail 292.

As depicted in FIG. 23, the contact member 260 may comprise a fixing portion 261, the contact portion 263, and a curved portion 262. The contact member 260 may be configured to be attached to the guide rail 292 via the fixing portion 261. The contact portion 263 may be configured to press the sheet 206. The curved portion 262 may connect the fixing portion 261 and the contact portion 263 therebetween. The contact member 260 may be molded of resin material having elasticity such that the contact portion 263 may be deformable elastically. The elastic deformation of the contact portion 263 is described in further detail below.

The fixing portion 261 may comprise a plurality of stiffening ribs 264, a plurality of, for example, four, protrusions 265 and a projection 288, all of which may upwardly protrude from an upper surface of the fixing portion 261. The four protrusions 265 may be configured to be inserted into respective insertion openings 297 (see FIG. 24A) of the guide rail 292. The projection 288 may be configured to be inserted into an insertion opening 296 (see FIG. 24A) of the guide rail 292. Pairs of the four protrusions 265 may be arranged with respect to the front-rear direction 208 and the right-left direction 209. The projection 288 may be disposed between the rear protrusions 265 in the front-rear direction 208. The projection 288 may upwardly protrude from an elastic portion 259 that may be elastically deformable with respect to the up-down direction 207.

Each of the protrusions 265 may comprise a pair of front and rear pawls 266, 267 at its protruding end (an upper end). The pair of pawls 266, 267 may engage the upper surface of the guide rail 292. The pawl 266 may protrude forward from the protruding end (the upper end) of each of the protrusions 265 in the front-rear direction 208. The pawl 267 may protrude rearward from the upper end of each of the protrusions 265 with respect to the front-rear direction 208.

The contact member 260 may further comprise a regulating portion 280A between the fixing portion 261 and the curved portion 262. The regulating portion 280A may have a flat-plate shape. The regulating portion 280A may protrude higher than the fixing portion 261 and extend along the right-left direction 209 when the contact member 260 is attached to the guide rail 292. The regulating portion 280A may be configured to contact the guide rail 292 with its upper end surface and position the contact member 260 in an upper limit position by contacting the guide rail 292. The contact member 260 may further comprise regulating portions 280B on both sides of the fixing portion 261 with respect to the right-left direction 209. The regulating portions 280B may upwardly protrude from the upper surface of the fixing portion 261. Upper end surfaces of the regulating portions 280B may be located lower than the upper end surface of the regulating portion 280A with respect to the up-down direction 207. The regulating portion 208B may also be configured to contact the guide rail 292 with their upper end surfaces and position the contact member 260 in the upper limit position.

Figure 24A:
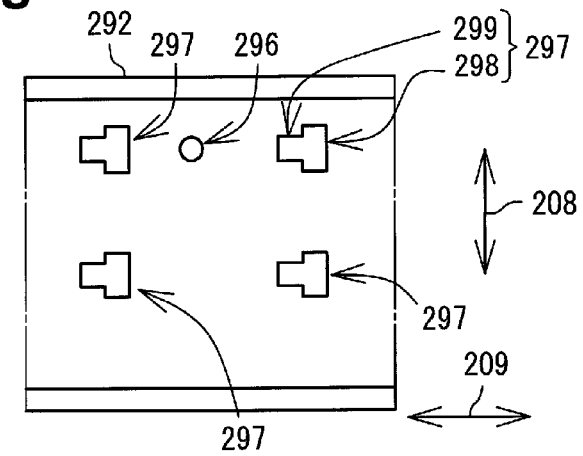
FIGS. 24A-24C are plan views depicting a process of attaching the one of the contact members to a guide rail in the second illustrative embodiment according to one or more aspects of the disclosure.
Figure 24B:
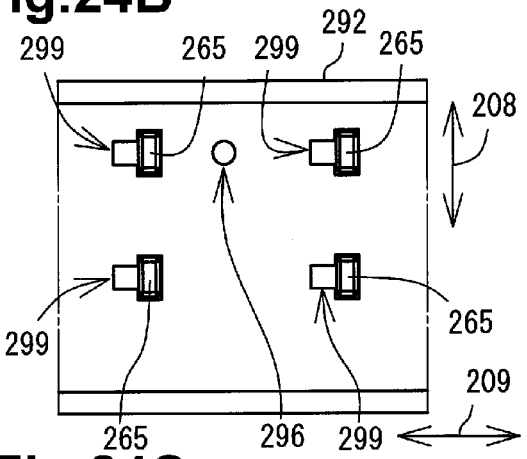
Figure 24C:
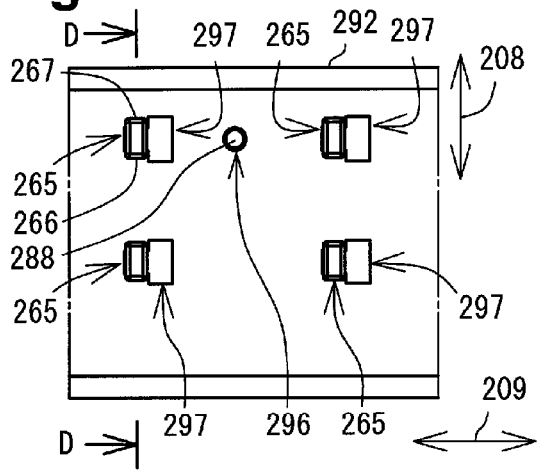
Figure 24D:
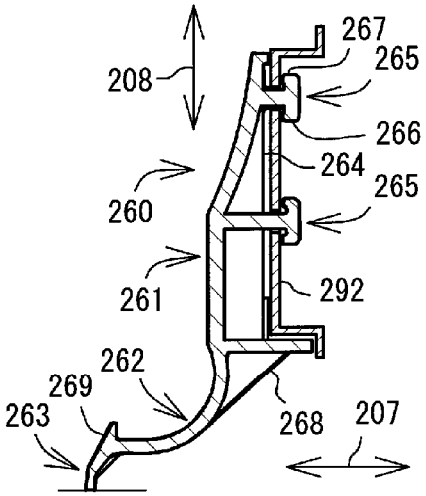
FIG. 24D is a sectional view depicting the one of the contact members that is attached to the guide rail in the second illustrative embodiment according to one or more aspects of the disclosure.
Figure 25B:
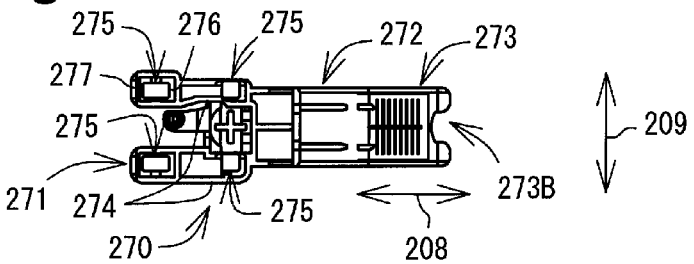
FIG. 25B is a plan view of the one of the another contact members in the second illustrative embodiment according to one or more aspects of the disclosure.
Figure 25C:
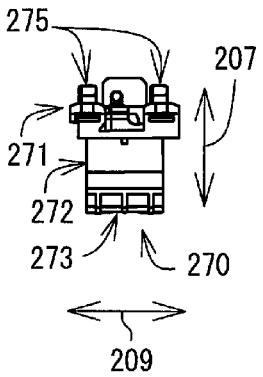
FIG. 25C is a back view of the one of the another contact members in the second illustrative embodiment according to one or more aspects of the disclosure.
Figure 25A:
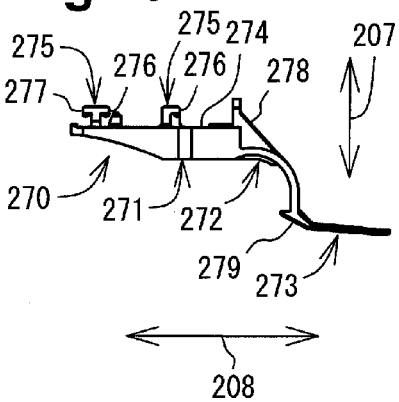
FIG. 25A is a side view of one of another contact members in the second illustrative embodiment according to one or more aspects of the disclosure.
Figure 25D:
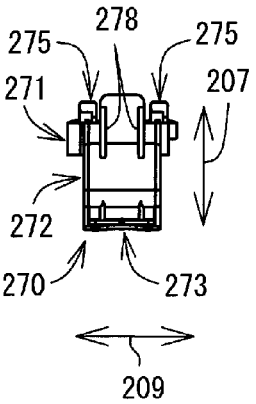
FIG. 25D is a front view of the one of the another contact members in the second illustrative embodiment according to one or more aspects of the disclosure.
Figure 25F:
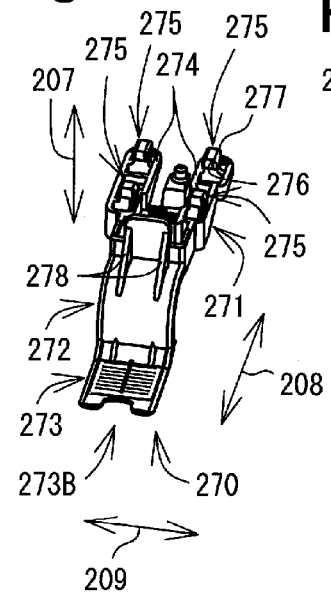
FIG. 25F is a perspective view of the one of the another contact members in the second illustrative embodiment according to one or more aspects of the disclosure.
Figure 25E:
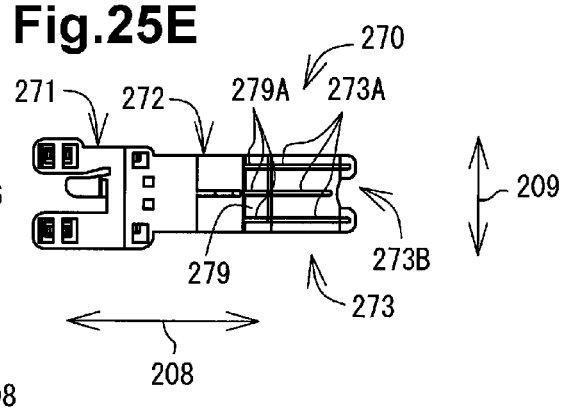
FIG. 25E is a bottom view of the one of the another contact members in the second illustrative embodiment according to one or more aspects of the disclosure.

As depicted in FIG. 24B, in order to attach the contact member 260 to the guide rail 292, first, the protrusions 265 may be inserted into respective first openings 298 from below the guide rail 292. At that time, the projection 288 and the insertion opening 296 might not be aligned with each other. Therefore, the projection 288 may make contact with the lower surface of the guide rail 292 and the elastic portion 259 may be downwardly deformed. Then, the contact member 260 may be slid leftward in the right-left direction 209 to engage the protrusions 265 in respective second openings 299 as depicted in FIGS. 24C and 24D. In the fixing portion 261, the protrusions 265 may make contact with a wall surface defining the second openings 299 with respect to the front-rear direction 208, and the pawls 266, 267 may engage the upper surface of the guide rail 292. Thus, the fixing portion 261 of the contact member 260 may be attached to the guide rail 292. Therefore, the projection 288 and the insertion opening 296 may be aligned with each other and the elastic portion 259 that has been downwardly deformed may return to its position. As a result, the projection 288 may be engaged in the insertion opening 296.

Figure 23B:
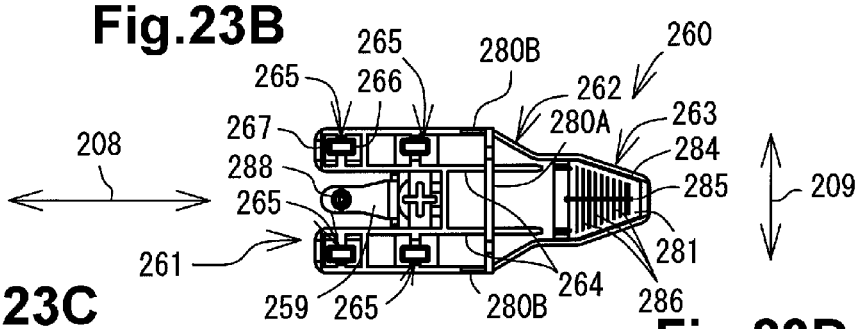
FIG. 23B is a plan view of the one of the contact members in the second illustrative embodiment according to one or more aspects of the disclosure.
Figure 23C:
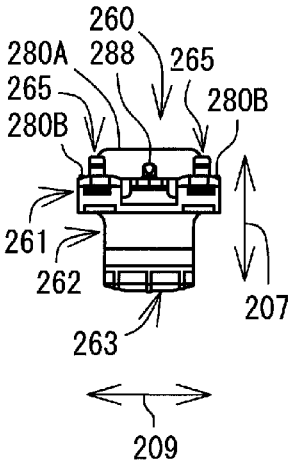
FIG. 23C is a back view of the one of the contact members in the second illustrative embodiment according to one or more aspects of the disclosure.
Figure 23A:
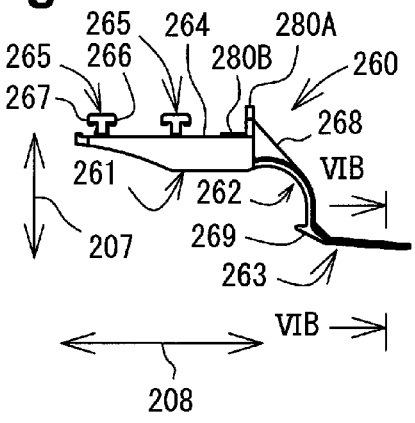
FIG. 23A is a side view of one of the contact members in the second illustrative embodiment according to one or more aspects of the disclosure.
Figure 23D:
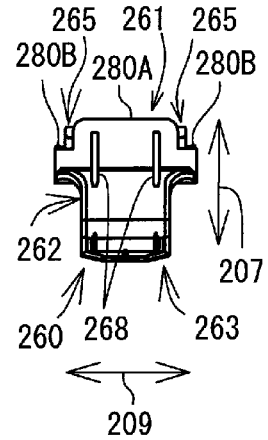
FIG. 23D is a front view of the one of the contact members in the second illustrative embodiment according to one or more aspects of the disclosure.

As depicted in FIG. 23A, the curved portion 262 may be curved into an arc shape such that the curved portion 262 extends along a circumference of the conveyor roller 235. This configuration may avoid and/or help prevent contact between the curved portion 62 of the contact member 60 and the conveyor roller 235. The curved portion 262 may be reinforced with stiffening ribs 268 to reduce its deformation.

The curved portion 262 may comprise a guide portion 269 at its lower end. The guide portion 269 may be provided for guiding a downstream edge (also referred to as a leading edge) of the sheet 206 being conveyed with respect to the conveying direction 219 to the contact portion 263. More specifically, the guide portion 269 of the curved portion 262 may protrude from the curved portion 262 toward a nip point of the conveyor roller pair 234, and may comprise an inclined surface at a lower surface of the protruding part. The inclined surface of the guide portion 269 may be inclined downwardly toward the front. The guide portion 269 may comprise a plurality of, for example, three, guide ribs 269A at its lower surface, as depicted in FIG. 21E. The guide ribs 269A may downwardly protrude from the lower surface of the guide portion 269. The guide ribs 269A may be disposed at the center and at both sides, with respect to the right-left direction 209, of the lower surface of the guide portion 269. The leading edge of the sheet 206 conveyed by the conveyor roller pair 234 may make contact with protruding edges (lower edges) of the guide ribs 269A and be guided to the contact portion 263.

Figure 19:
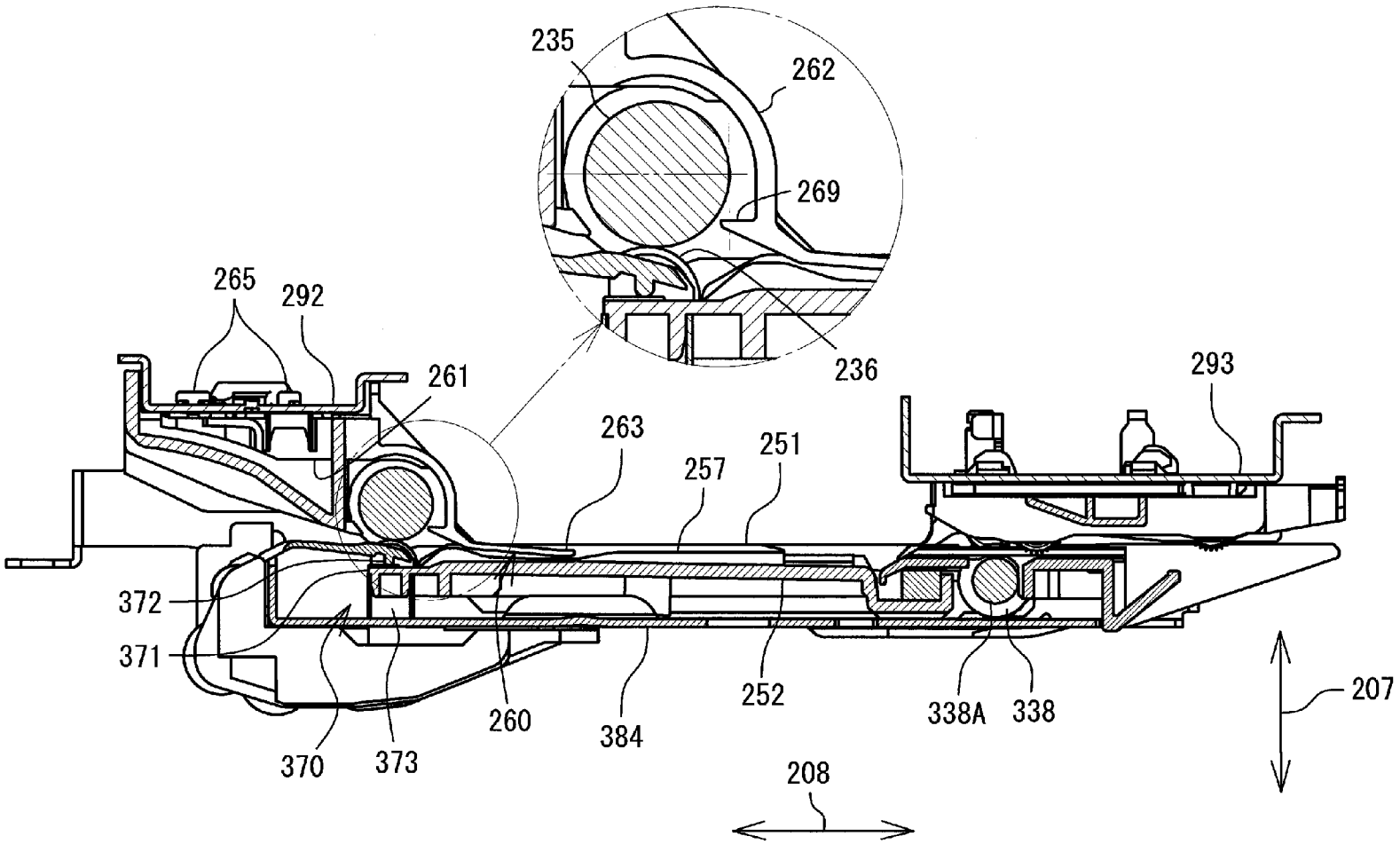
FIG. 19 is a sectional view depicting the portion in the vicinity of the interlocking portion 370 in the second illustrative embodiment according to one or more aspects of the disclosure.

As depicted in FIG. 19, while the contact member 260 is attached to the guide rail 292, the guide portion 269 may protrude to a position upstream of a downstream end of the conveyor roller 235 with respect to the conveying direction 219. For example, the position to which the guide portion 269 protrudes may correspond to a position where a most protruding portion of a roller surface of the conveyor roller 235 protruding downstream in the conveying direction 19 is located. The guide portion 269 may be located below the most protruding portion of the downstream end of the conveyor roller 235. Therefore, while the conveyor roller pair 234 conveys the sheet 206 onto the platen 250, the guide portion 269 may allow the leading edge of the sheet 206 to move to the contact portion 263 without the sheet entering the conveyor roller 235 and the curved portion 262 of the contact member 260 and the contact portion 263 of the contact member 260 may press a surface of the sheet 206 facing the recording head 246 toward the platen 250.

As depicted in FIGS. 23A-23E, the contact portion 263 may have a plate-like shape and extend obliquely downward from the front of the lower end of the curved portion 262 with respect to the front-rear direction 208. The contact portion 263 may be inclined with respect to a horizontal surface such that a more forward part of the contact portion 263 may located closer to the upper surface of the platen 250. A front end of the contact portion 263 with respect to the front-rear direction 208 may be located behind and adjacent to the nozzles 247 (see FIG. 20) of the recording head 246 in the front-rear direction 208. The plurality of contact members 260 may be attached to the guide rail 292 such that the contact portions 263 of the contact members 260 may be located at the same respective positions in both the up-down direction 207 and the front-rear direction 208.

In one or more arrangements, the contact portion 263 of the contact member 260 may be inclined. In such a configuration, the contact portion 263 may allow the leading edge of the sheet 206 to move to the front end of the contact portion 263 with respect to the front-rear direction 208. The contact portion 263 may have the plate-like shape. With this configuration, the front end of the contact portion 263 may be located in the gap G in which a thickness of the contact portion 263 with respect to the up-down direction 207 may be minimized or reduced while maintaining an appropriate strength of the contact portion 263. The front end of the contact portion 263 with respect to the front-rear direction 208 may be located near the nozzles 247. With this configuration, the contact portion 263 may be allowed to press the sheet 206 near the nozzles 247, thereby improving the image-recording accuracy.

According to other aspects, the contact portion 263 may be tapered toward the front end with respect to the front-rear direction 208 such that both edges of the contact portion 263 in the right-left direction 209 become closer to each other toward the front, with respect to the front-rear direction 208.

This configuration may allow the contact portion 263 to be deformed in the up-down direction 207. A more forward part of the contact portion 263 may have a thinner thickness with respect to the front-rear direction 208. As described above, the forward part of the contact portion may be tapered and have a thinner thickness. Therefore, the forward part of the contact portion 263 may be deformed when forming the sheet 206 being conveyed into the corrugated shape. The forward part of the contact portion 263 may be configured to be deformed to adjust the shape of a curve of the corrugation pattern formed in the sheet 206. When a sheet 206 having relatively greater thickness is conveyed, the forward part of the contact portion 263 may be deformed to reduce an occurrence of jamming of the sheet 206 between the contact portion 263 and the platen 250. As described above, the forward part of the contact portion 263 may have a thinner thickness. Therefore, a gap between a nozzle surface (the lower surface) of the recording head 246 and the contact portion 263 may become greater. This configuration may prevent the contact portion 263 and the recording head 246 to come into contact with each other. Further, this configuration may facilitate a removal of the sheet 206 jammed at the contact portion 263.

The contact portion 263 may comprise a plurality of, for example, three, contact ribs 263A at its lower surface. The contact ribs 263A may protrude downward from the lower surface of the contact portion 263 and extend along a direction in which the contact portion 263 extends (obliquely downward toward the front). The contact ribs 263A may be disposed at the center and at both sides of the contact portion 263 with respect to the right-left direction 209. The contact ribs 263A may be connected with the respective guide ribs 269A of the guide portion 269 of the curved portion 262. The contact ribs 263A may come into contact with an upper surface of the sheet 206 being conveyed and press the sheet 206 from above. The provision of the contact ribs 263A may reduce a contact area between the contact member 260 and the sheet 206, and thus, the conveyance resistance to the sheet 206 may become smaller. Therefore, the image-recording accuracy may be improved.

Figure 30A:
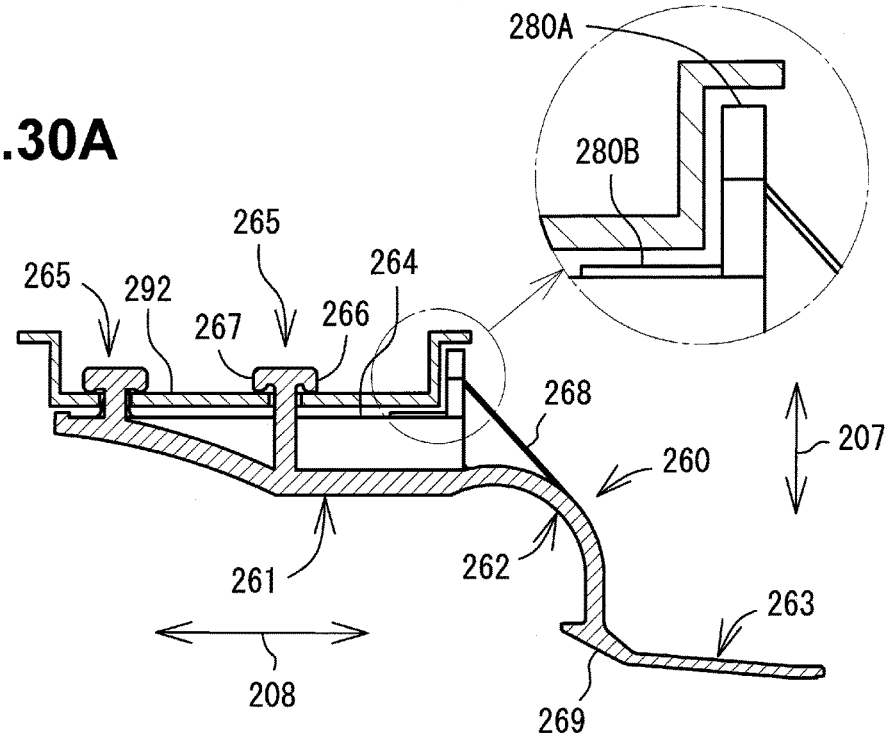
FIG. 30A is a sectional view depicting the one of the contact members located in a lower limit position, taken along a line extending along the front-rear direction, in the second illustrative embodiment according to one or more aspects of the disclosure.
Figure 30B:
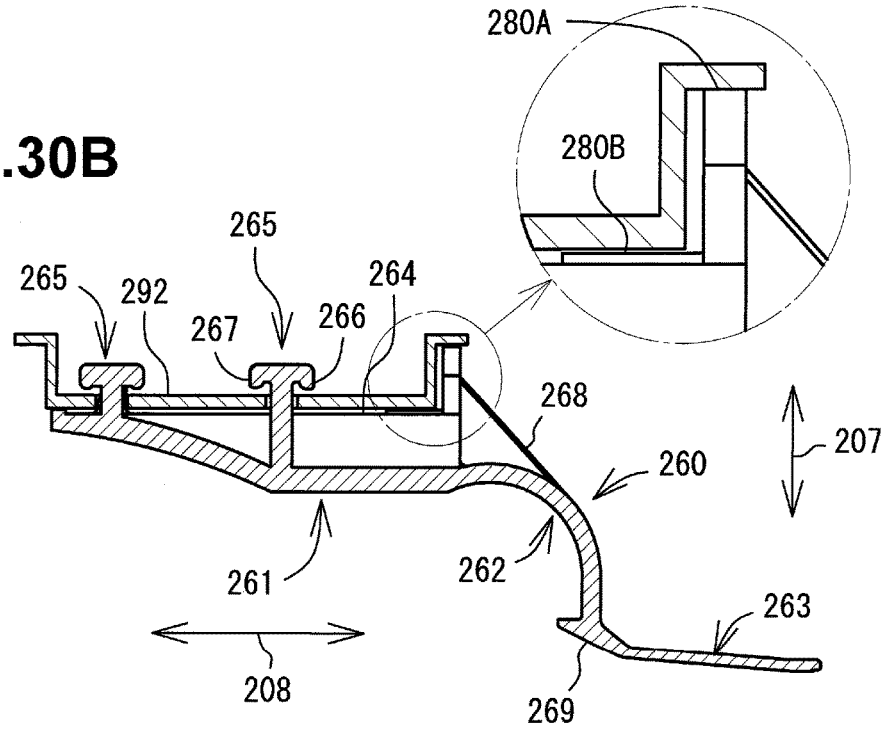
FIG. 30B is a sectional view depicting the one of the contact members located in an upper limit position, taken along the line extending along the front-rear direction, in the second illustrative embodiment according to one or more aspects of the disclosure.

A distance between a front end of the pawl 266 and a rear end of the pawl 267 with respect to the front-rear direction 208 may be slightly smaller than a width of the first opening 298 with respect to the front-rear direction 208 such that the protrusion 265 may be allowed to be inserted into the corresponding first opening 298. The distance between the front end of the pawl 266 and the rear end of the pawl 267 may be greater than a width of the second opening 299 such that the protrusion 265 may engage the upper surface of the guide rail 292 when the pawls 266, 267 are engaged with the corresponding second opening 299. A distance between the upper edge of each of the stiffening ribs 264 and a lower end of each of the pawls 266, 267 may be greater than a thickness of the guide rail 292 to facilitate moving the contact member 260 within the corresponding insertion opening 297 along the right-left direction 209. Therefore, the contact member 260 may be configured to be movable along the up-down direction 207 between a lower limit position where the pawls 266, 267 make contact with the upper surface of the guide rail 292 (see FIG. 30A) and the upper limit position where the upper edges of the stiffening ribs 264 make contact with the lower surface of the guide rail 292 (see FIG. 30B).

As described above, the contact member 260 may be locked in the guide rail 292 so as not to be movable along the front-rear direction 208 and the right-left direction 209 but may be movable along the up-down direction 207. The contact member 260 may be located in the lower limit position under its own weight when no external force is applied to the contact member 260. The contact member 260 may be moved to the upper limit position depicted in FIG. 30B by the sheet 206 from the lower limit position depicted in FIG. 30A when the sheet 206 contacts the contact portion 263 of the contact member 260. When the contact member 260 is located in the upper limit position, the upper end surface of the regulating portion 280A of the contact member 260 may make contact with an upwardly bent portion of an edge of the guide rail 292 and the upper end surface of the regulating portion 280B of the contact member 260 may make contact with the lower surface of the guide rail 292.

Figure 23F:
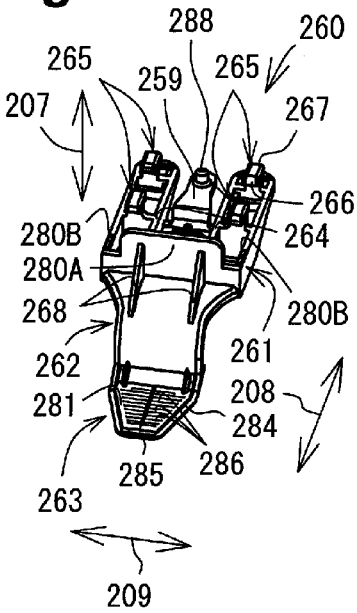
FIG. 23F is a perspective view of the one of the contact members in the second illustrative embodiment according to one or more aspects of the disclosure.
Figure 23E:
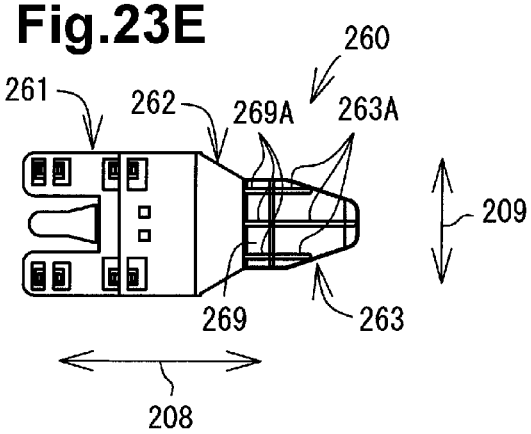
FIG. 23E is a bottom view of the one of the contact members in the second illustrative embodiment according to one or more aspects of the disclosure.

As depicted in FIGS. 23B and 23F, the contact portion 263 may comprise a surrounding rib 284 disposed at a periphery of an upper surface 281 of the contact portion 263. The surrounding rib 284 may upwardly protrude from the periphery of the upper surface 281. The surrounding rib 284 may surround both edges of the upper surface 281 with respect to the right-left direction 209 and a front edge of the upper surface 281 with respect to the front-rear direction 208. The surrounding rib 284 may define a recessed space for storing ink in conjunction with the upper surface 281.

Figure 31A:
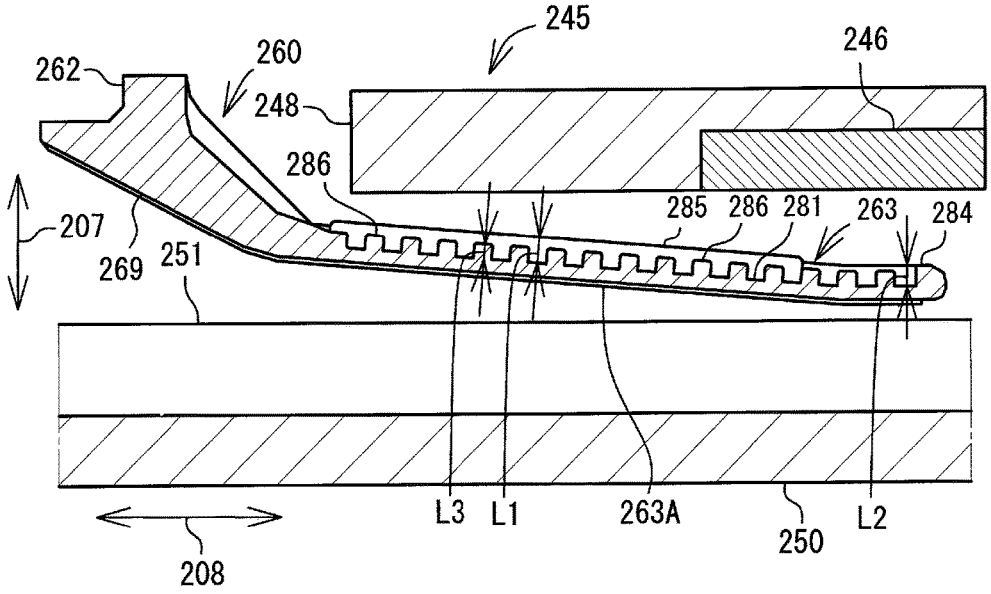
FIG. 31A is a sectional view depicting a portion in the vicinity of a contact portion of one of the contact members, taken along a line extending along the front-rear direction, in the second illustrative embodiment according to one or more aspects of the disclosure.
Figure 31B:
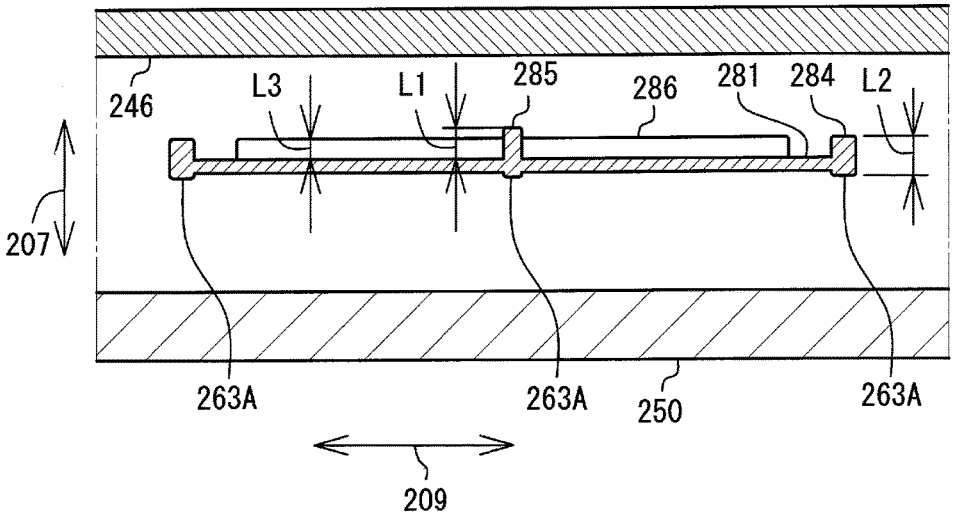
FIG. 31B is a sectional view depicting the portion in the vicinity of the contact portion of the one of the contact members, taken along a line extending along the right-left direction, in the second illustrative embodiment according to one or more aspects of the disclosure.

A rib 285 may upwardly protrude from the center of the upper surface 281 with respect to the right-left direction 209 and may extend along a direction that the contact portion 263 may be inclined (e.g., obliquely downward toward the front). As depicted in FIGS. 31A and 31B, a protruding amount L1 of the rib 285 from the upper surface 281 may be greater than a protruding amount L2 of the surrounding rib 284 from the upper surface 281. Therefore, when one or both of the recording head 246 and the contact portion 263 are relatively moved in a direction in which the recording head 246 and the contact portion 263 become closer to each other, the rib 285 of the contact portion 263 may come into contact with the lower surface of the recording head 245. At that time, when ink is present on the lower surface of the recording head 246 due to an occurrence of ink mist, the ink may adhere to an upper edge of the rib 285. Then, the ink adhered to the rib 285 may move, by its own weight, to the upper surface 281 via the surface of the rib 285. The rib 285 may be disposed inside the surrounding rib 284 and spaced apart from the surrounding rib 284 to prevent the ink adhered to the rib 285 from moving to the upper edge of the surrounding rib 284.

The contact portion 263 may comprise a plurality of ribs 286 on the upper surface 281 to prevent the ink that has moved to the upper surface 281 from staying near the rib 285. The plurality of ribs 286 may be disposed on opposite sides of the rib 285 with respect to the right-left direction 209. The ribs 286 may extend along the right-left direction 209 and be spaced apart from each other with respect to the front-rear direction 208. One end of the ribs 286 may extend to the rib 285 in the right-left direction 209 and the other end of the ribs 286 may be separated from the surrounding rib 284. A protruding amount L3 of the ribs 286 from the upper surface 281 may be less than the protruding amount L1 of the rib 285. Therefore, the ribs 286 might not come into contact with the recording head 246. Each pair of adjacent ribs of the ribs 286 may define a channel therebetween that may extend along the right-left direction 209. The ink adhered to the rib 285 may move to the channels along and via the rib 285. Then, the ink may spread over the channels by a capillary phenomenon and move to channels defined by the ribs 286 and the surrounding rib 284. Therefore, the ink adhered to the rib 285 might not remain near the rib 285. Accordingly, when the rib 285 and the recording head 246 make contact with each other again, this configuration may prevent or reduce the undesired movement of the ink from the rib 285 to the recording head 246.

As depicted in FIG. 13, the contact member 270 may be disposed above the platen 250 and at each end portion of the platen 250 with respect to the right-left direction 209. The contact members 270 may have a configuration that may be slightly different from the contact members 260. Hereinafter, the contact members 270 are described in further detail with reference to FIGS. 25A-25F. In some arrangements, both of the contact members 270 may have the same configuration, and therefore, the description may be provided with respect to one of the contact members 270. In FIGS. 25A-25F, the up-down direction 207, the front-rear direction 208 and the right-left direction 209 may be defined while the contact member 270 may be attached to the guide rail 292.

The contact member 270 may comprise a fixing portion 271, a curved portion 272, and a contact portion 273. Similar to the contact member 260, the fixing portion 271 may comprise a plurality of stiffening ribs 274 and a plurality of, for example, four, protrusions 275. The fixing portion 271 may be configured to be attached to the guide rail 292 via the protrusions 275, pawls 276, 277 of the protrusions 275 and the stiffening ribs 274 in a similar manner to the fixing portion 261 of the contact member 260.

The curved portion 272 may comprise stiffening ribs 278, a guide portion 279 and guide ribs 279A. The curved portion 272 of the contact member 270 may have the same or substantially the same shape as the curved portion 262 of the contact member 260.

The contact portion 273 may have a substantially rectangular-plate-like shape. The contact portion 273 may be inclined with respect to the horizontal surface such that its front end may be located lower than its rear end with respect to the front-rear direction 208. The front end (lower end) of the contact portion 273 with respect to the front-rear direction 208 may be located at the same position, with respect to the up-down direction 207 and the front-rear direction 208, as the front end (lower end) of the contact portion 263 with respect to the front-rear direction 208 when the contact members 260, 270 are attached to the guide rail 292.

The contact member 270 may be attached to the guide rail 292 such that one of the right and left edges of the sheet 206 (for example, A4-size paper or legal-size paper) with respect to the right-left direction 209 may pass between adjacent ribs of a plurality of contact ribs 273A protruding from a lower surface of the contact portion 273. Therefore, in some cases, the sheet 206 may make contact with only one of the contact ribs 273A with respect to the right-left direction 209. If the contact portion 273 is tapered toward the front end like the contact portion 263 of the contact member 260, the contact portion 273 may not be able to press the sheet 206 near the nozzles 247 (see FIG. 3B). In view of the above, in some examples, the contact portion 273 might not be tapered but, instead, have a substantially rectangular-plate-like shape. The contact member 270 may be configured to press the sheet 206 by one or more of the contact ribs 273A at each position inside either of the right and left edges of the sheet 206 with respect to the right-left direction 209 until the sheet 206 is conveyed to the vicinity of the nozzles 247. The contact portion 273 may have a cutaway portion 273B at a middle portion with respect to the right-left direction 209 of a forward part of the contact portion 273 with respect to the front-rear direction 208. The contact portion 273 may be partially cut away from its front edge toward the rear to define the cutaway portion 273B. A front end of the contact rib 273A that protrudes at the center of the contact portion 273, with respect to the right-left direction 209, may be located at a position further to the rear than front ends of the other contact ribs 273A protruding at positions at either side of the center contact rib 273A.

As described above, the forward part of the contact portion 273 may have a smaller or thinner thickness. Therefore, the forward part of the contact portion 273 may be deformable when forming the sheet 206 into the corrugated shape. The forward part of the contact portion 273 may be configured to be deformed to adjust the shape of a curve of the corrugation pattern formed in the sheet 206. When a sheet 206 having relatively greater thickness is conveyed, the forward part of the contact portion 273 may be deformed to reduce an occurrence of jamming of the sheet 206 between the contact portion 273 and the platen 250. As described above, the forward part of the contact portion 273 may have a thinner thickness. Therefore, a gap between the nozzle surface (the lower surface) of the recording head 246 and the contact portion 273 may become greater. This configuration might not allow the contact portion 273 and the recording head 246 to come into contact with each other. Further, this configuration may facilitate a removal of the sheet 206 jammed at the contact portion 273.

Although the detailed description is omitted, similar to the contact member 260, the contact member 270 may also be configured to be movable between the lower limit position and the upper limit position with respect to the guide rail 292. The contact portion 273 of the contact member 270 may also comprise a plurality of ribs that may be similar to the surrounding rib 284, the rib 285, and the ribs 286 of the contact member 260. The contact portion 273 of the contact member 270 may also comprise regulating portions that may be similar to the regulating portions 280A, 280B of the contact portion 263 of the contact member 260.

As depicted in FIG. 12, the discharge roller pair 237 (as an example of a second conveyor) may comprise the rotating shaft 238A, the plurality of discharge rollers 238, and a plurality of first spurs 239. The rotating shaft 238A may be disposed downstream of the platen 250 with respect to the conveying direction 219 (e.g., in front of the platen 250 with respect to the front-rear direction 208). The plurality of discharge rollers 238 may be disposed on the rotating shaft 238A and above the respective discharge rollers 238.

Figure 26:
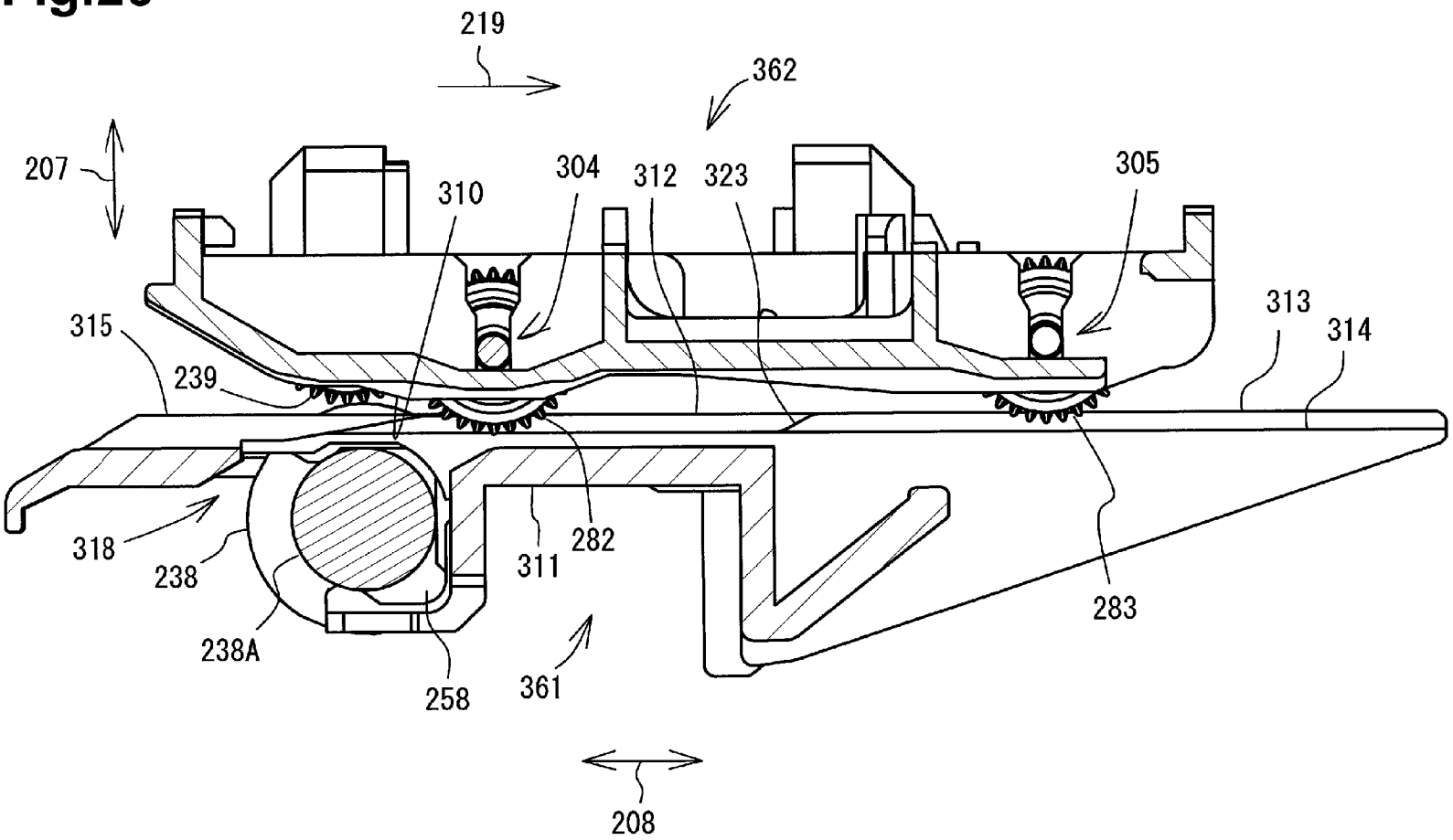
FIG. 26 is a sectional view depicting the first defining member and a second defining member, taken along a line extending in a front-rear direction, in the second illustrative embodiment according to one or more aspects of the disclosure.

The rotating shaft 238A may extend along the right-left direction 209 (the direction perpendicular to the drawing sheet of FIG. 12). The rotating shaft 238A may be rotatably supported by the frame (not depicted) at both ends. The rotating shaft 238A may be configured to be rotated by a drive motor (not depicted). As depicted in FIG. 26, the rotating shaft 238A may be located such that nip points of the discharge roller pair 237 may be located closer to the second defining member 362 than upper edges of fifth ribs 275. This configuration may allow the sheet 206 to move such that the tops of the ridge portions of the corrugated sheet 6 held by the fifth ribs 275 may fall on and contact the respective nip points of the discharge roller pair 237. The first defining member 361 may have openings 318. Roller surfaces of the discharge rollers 238 may be exposed in the first conveying path 231 via the openings 318, respectively, of the first defining member 361.

Figure 16:
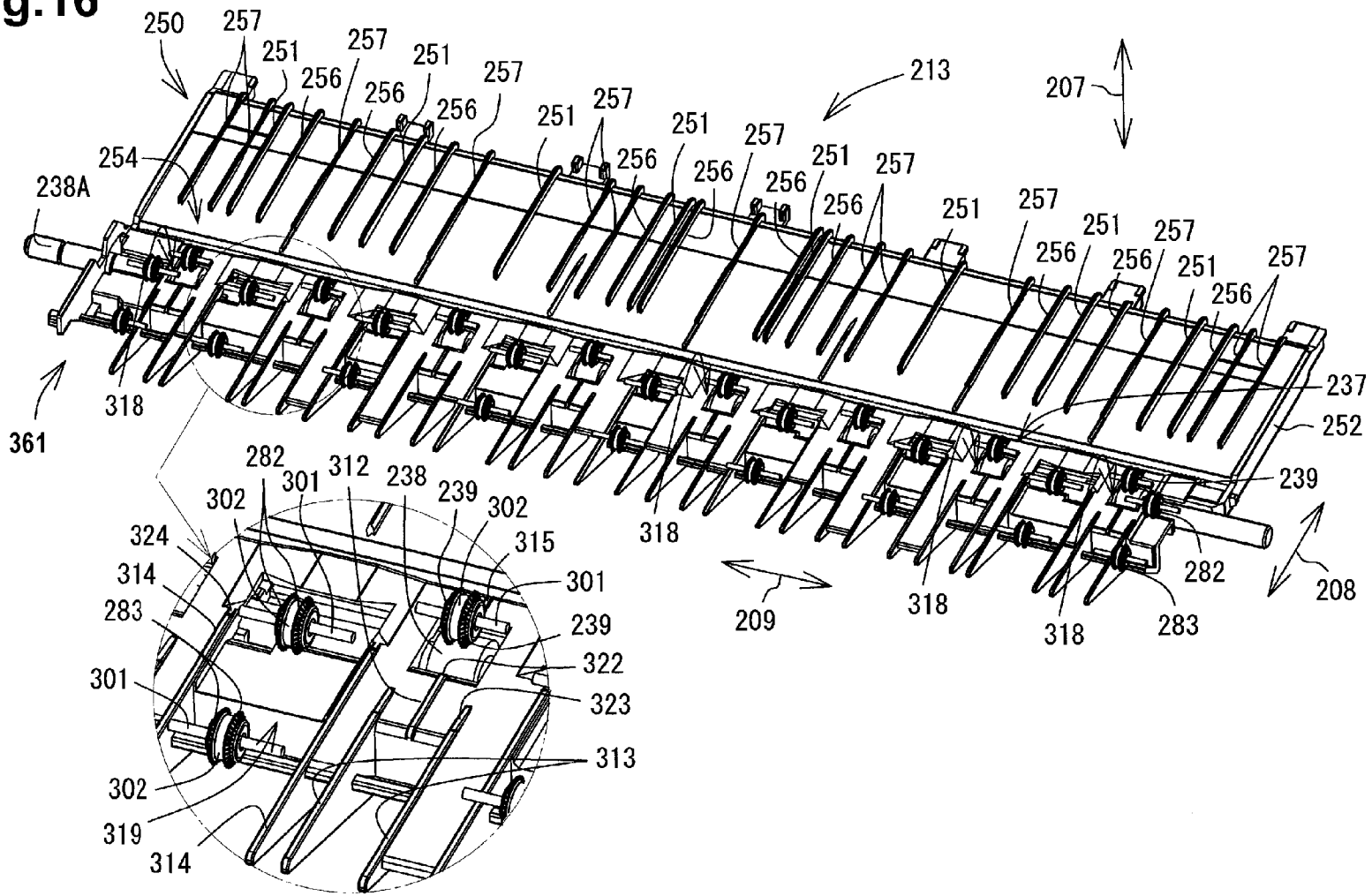
FIG. 16 is a perspective view depicting the platen and a first defining member in the second illustrative embodiment according to one or more aspects of the disclosure.

As depicted in FIG. 16, the first spurs 239 may be rotatably disposed on elastic shafts 301, respectively. each of the elastic shafts 301 may have elasticity with respect to a diameter direction thereof. More specifically, the first spurs 239 may be disposed in pairs on respective elastic shafts 301. The pair of right and left first spurs 239 may be spaced apart from each other with respect to the right-left direction 209 by a spacer 302 disposed on the elastic shaft 301. Both ends of the elastic shaft 301 with respect to the right-left direction 209 may be fixed to the second defining member 362 (see FIG. 26). The second defining member 362 may be disposed opposite to the first defining member 361 and downstream of the platen 250 with respect to the conveying direction 219 to define the first conveying path 231. The elastic shaft 301 may be configured to be deformed such that a middle part of the elastic shaft 301 with respect to the right-left direction 209 may be located higher than the both ends of the elastic shaft 101 when the pair of first spurs 239 is in contact with the corresponding discharge roller 238. In this state, the elastic shaft 301 may urge the pair of first spurs 239 downward. The pair of first spurs 239 may be in pressure contact with the corresponding discharge roller 238 by an urging force of the elastic shaft 301. In one or more configurations, all of the pairs of first spurs 239 and the elastic shafts 301 may have the same configuration.

As depicted in FIG. 16, the discharge roller pair 237 may be disposed such that the nip points of the discharge roller pair 237 may be disposed on extensions of the first ribs 251, respectively, along the conveying direction 219 (e.g., in front of the respective first ribs 251 with respect to the front-rear direction 208). The tops of the ridge portions of the corrugated sheet 206 may reach the nip points of the discharge roller pair 237 and then be nipped by the discharge roller pair 237 after being held by the first ribs 251, respectively.

As depicted in a drawing enclosed within a dashed line in FIG. 12, a distance L1 between the nip points of the conveyor roller pair 234 and the respective nip points of the discharge roller pair 237 with respect to the conveying direction 219 may be shorter than a length of a longer side of a sheet 206 having the shortest length useable (e.g., acceptable for the image forming device) with respect to the conveying direction 219. Therefore, a downstream edge of a sheet 206 of any size may be nipped by the discharge roller pair 237 before an upstream edge of the sheet 206 passes the nip points of the conveyor roller pair 234 with respect to the conveying direction 219.

As depicted in FIG. 26, the first defining member 361 and the second defining member 362 may be disposed opposite to each other in the up-down direction 207 while the first defining member 361 may be disposed under the second defining member 362. The first defining member 361 and the second defining member 362 may define the first conveying path 231 therebetween. The first defining member 361 and the second defining member 362 may be supported by the frame (not depicted).

The second defining member 362 may comprise a plurality of first fixing portions (not depicted), a plurality of second fixing portions 304, and a plurality of third fixing portions 305. The plurality of first fixing portions may be configured to fix both ends of the elastic shafts 301 of the first spurs 239, respectively, with respect to the right-left direction 209. The plurality of second fixing portions 304 may be configured to fix both ends of the elastic shafts 301 of second spurs 282, respectively, with respect to the right-left direction 209. The plurality of third fixing portions 305 may be configured to fix both ends of the elastic shafts 301 of third spurs 283, respectively, with respect to the right-left direction 209. The first fixing portions, the second fixing portions 304, and the third fixing portion 305 may have the same configuration in one or more examples.

The first fixing portions may be disposed above respective discharge rollers 238 and spaced apart from each other in the right-left direction 209. The second fixing portions 304 may be disposed on extensions of the contact portions 263, respectively, and downstream of the first fixing portions with respect to the conveying direction 219 (e.g., in front of the first fixing portions with respect to the front-rear direction 208). The second fixing portions 304 may be spaced apart from each other with respect to the right-left direction 209. The third fixing portions 305 may be disposed on extensions of the second fixing portions 304, respectively, and downstream of the second fixing portions 304 with respect to the conveying direction 219. The third fixing portions 305 may also be spaced apart from each other with respect to the right-left direction 209.

As depicted in FIG. 26, the second defining member 362 may comprise first guide surfaces 310 (as an example of a guide portion) for guiding the groove portions of the corrugated sheet 206 to the second spurs 282. The first guide surfaces 310 may be disposed on extensions of the contact members 260, respectively, along the conveying direction 219 such that the first guide surfaces 310 may come into contact with respective groove portions formed in the leading edge of the corrugated sheet 206. Each of the first guide surfaces 310 may be located between a corresponding one of the nip points of the discharge roller pair 237 and a lower end of a corresponding one of the second spurs 282 with respect to the conveying direction 219. The first guide surfaces 310 may extend obliquely downward along the front-rear direction 208 from above the nip points of the discharge roller pair 237, respectively. For example, the first guide surfaces 310 may extend obliquely toward the first defining member 361. Front ends of the first guide surfaces 310 with respect to the front-rear direction 208 may be located at the same or substantially the same level as the nip points of the discharge roller pair 237 with respect to the up-down direction 207. The leading edge of the sheet 206 being conveyed may come into contact with the first guide surfaces 310 to move obliquely downward. In other embodiments, for example, the second defining member 362 may comprise one or more inclined surfaces that may extend obliquely downward along the front-rear direction 208 from a position upstream of the nip points of the discharge roller pair 237 with respect to the conveying direction 219, e.g., toward the first defining member 361. In this case, an area that may extend between the nip points of the discharge roller pair 37 and the lower ends of the second spurs 82, with respect to the conveying direction 219, may correspond to the guide portion.

As depicted in FIG. 12, the first defining member 361 may be disposed under the second defining member 362 and configured to hold the sheet 206 to be pressed by the second spurs 282 and the third spurs 283. The sheet 206 may be discharged onto the sheet discharge tray 229 from a discharge port 218 provided downstream of a downstream end of the first defining member 361 with respect to the conveying direction 219.

Figure 27A:
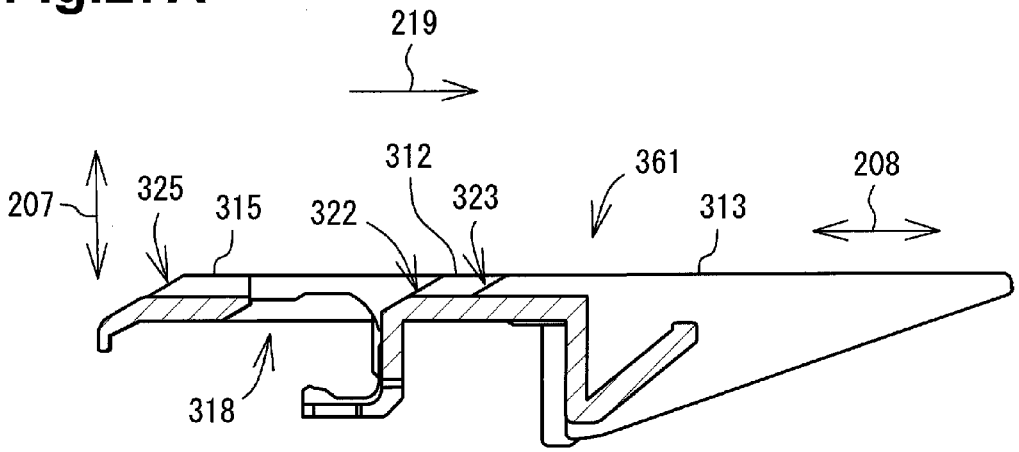
FIG. 27A is a sectional view depicting the first defining member, taken along a line that extends in the front-rear direction and passes one of second ribs and one of fifth ribs, in the second illustrative embodiment according to one or more aspects of the disclosure.
Figure 27B:
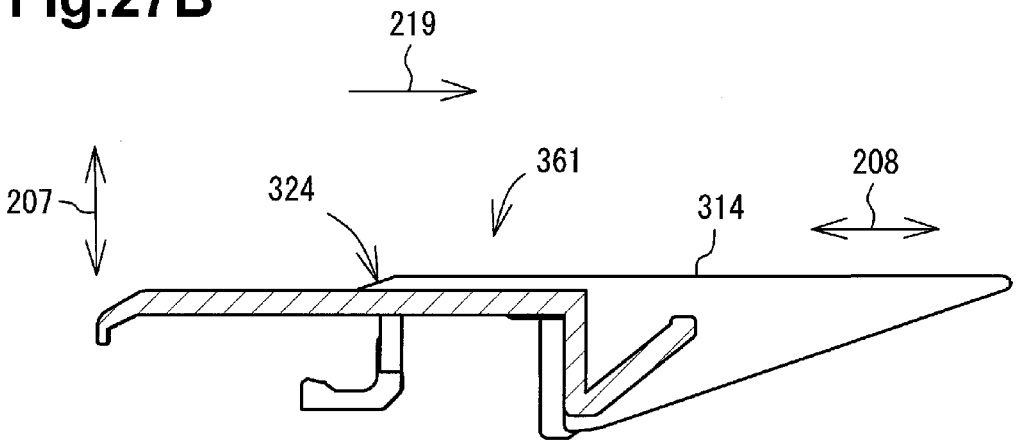
FIG. 27B is a sectional view depicting the first defining member, taken along a line that extends in the front-rear direction and passes one of fourth ribs, in the second illustrative embodiment according to one or more aspects of the disclosure.

As depicted in FIGS. 26, 27A and 27B, the first defining member 361 may comprise a plate-shaped base 311, a plurality of second ribs 312, a plurality of third ribs 313, a plurality of fourth ribs 314, and a plurality fifth ribs 315. The base 311 may be disposed between the rotating shaft 238A and the second defining member 362 and fixed to the frame (not depicted). The second ribs 312, the third ribs 313, the fourth ribs 314 and the fifth ribs 315 may protrude from an upper surface of the base 311. As depicted in FIG. 16, the base 311 may have the plurality of opening 318. The discharge rollers 238 may stick out (e.g., extend upward) from the upper surface of the base 311 via the openings 318, respectively.

The fifth ribs 315 may be provided for guiding the tops of the ridge portions of the corrugated sheet 206 to the nip points of the discharge roller pair 237. Each of the fifth ribs 315 may extend from the midpoint (with respect to the right-left direction 209) of an upstream edge (with respect to the conveying direction 219) of a corresponding one of the openings 318 (a rear edge of the opening 318 with respect to the front-rear direction 208) to an upstream end of the base 311 with respect to the conveying direction 219 (the rear end of the base 311 with respect to the front-rear direction 208). The fifth rib 315 may be disposed on extensions of the first ribs 251, respectively, with respect to the conveying direction 219. Protruding edges (upper edges) of the fifth ribs 315 may be located at the same or substantially the same level as the protruding edges (upper edges) of the first ribs 251. Therefore, the fifth ribs 315 may hold the tops of the ridge portions of the corrugated sheet 206, respectively. The platen 250 may have the pivotable configuration. Thus, the first ribs 251 of the platen 250 may not be able to extend to the nip points of the discharge roller pair 237. Accordingly, the first defining member 361 may need to be provided with the fifth ribs 315.

As depicted in FIG. 27A, each of the fifth ribs 315 may comprise a fifth guide surface 325 at an upstream end of each of the fifth ribs 315 with respect to the conveying direction 219 (see FIG. 12). In each of the fifth ribs 315, the fifth guide surface 125 may extend obliquely upward from an upstream end of the upper surface of the base 311 to an upper edge of the fifth rib 315 with respect to the conveying direction 219. The fifth guide surfaces 325 may come into contact with the leading edge of the sheet 206 to allow the sheet 206 to move to the upper edges of the fifth ribs 315. This configuration may reduce catching of the sheet 6 on the upstream ends of the fifth ribs 315 with respect to the conveying direction 219.

As depicted in FIG. 16, the second ribs 312 may be provided for holding the tops of the ridge portions of the corrugated sheet 6. The second ribs 312 may be disposed on the extensions of the first ribs 251, respectively, with respect to the conveying direction 219. Protruding edges (upper edges) of the second ribs 312 may be the same or substantially the same level as the protruding edges (upper edges) of the first ribs 251. Therefore, the second ribs 312 may hold the tops of the ridge portions of the corrugated sheet 206, respectively. Each of the second ribs 312 may extend along the conveying direction 219 from the midpoint (with respect to the right-left direction 219) of a downstream edge (with respect to the conveying direction 219) of a corresponding one of the openings 318 (the front edge of the opening 318 with respect to the front-rear direction 208).

Downstream ends of the second ribs 312 may be located downstream of the lower ends of the second spurs 82, respectively, with respect to the conveying direction 219 (in front of the lower ends of the second spurs 82 with respect to the front-rear direction 208). Upstream ends of the second ribs 312 may be located upstream of the lower ends of the second spurs 282, respectively, with respect to the conveying direction 219. This configuration may allow the second ribs 312 to hold the ridge portions of the corrugated sheet 206 when the second spurs 282 press the groove portions of the corrugated sheet 206 from above. Each of the second ribs 312 may extend from the downstream edge of a corresponding one of the openings 318 to a position between the second spurs 312 and the third spurs 283 along the conveying direction 219 because the third ribs 313 may be provided on the platen 250.

As depicted in FIG. 27A, each of the second ribs 312 may comprise a second guide surface 322 at an upstream end of each of the second ribs 312 with respect to the conveying direction 219. In each of the second ribs 312, the second guide surface 322 may extend obliquely upward from a downstream edge of a corresponding one of the openings 318 to an upper edge of the second rib 312. The second guide surfaces 322 may come into contact with the leading edge of the sheet 206 that has passed the nip points of the discharge roller pair 237, and allows the sheet 6 to move to the upper edges of the second ribs 312. This configuration may reduce catching of the sheet 6 on the upstream ends of the second ribs 312 with respect to the conveying direction 219.

The third ribs 313 may be provided for holding the ridge portions of the corrugated sheet 206 by taking over from the second ribs 312. As depicted in FIG. 16, the third rib 313 may be disposed on both sides of each of the second ribs 312 with respect to the right-left direction 209 such that each pair of the third ribs 313 may hold the right and left portions of the top of the corresponding ridge portion of the corrugated sheet 6. The third ribs 313 may extend from respective positions upstream of downstream ends of the second ribs 312 to respective positions downstream of the second spurs 282 with respect to the conveying direction 219. With this configuration, the third ribs 73 may take over from the second ribs 312 to hold the sheet 206. Protruding edges (upper edges) of the third ribs 313 may be located lower than the protruding edges (upper edges) of the second ribs 312, e.g., closer to the first defining member 361 than the protruding edges (upper edges) of the second ribs 312. In FIG. 26, the second ribs 312 and the third ribs 313 have the same or substantially the same height because a height difference therebetween may be very slight. While the sheet 206 is conveyed, the third ribs 313 may hold the right and left portions of the tops of the ridge portions of the sheet 6, respectively, after the second ribs 312 holds the tops of the ridge portions of the sheet 6, respectively.

As depicted in FIG. 27A, each of the third ribs 313 may comprise a third guide surface 323 at an upstream end of each of the third ribs 313 with respect to the conveying direction 219. In each of the third ribs 313, the third guide surface 323 may extend obliquely upward from the upper surface of the base 311 to an upper edge of the third rib 313. The third guide surfaces 323 may come into contact with the leading edge of the sheet 206 to allow the sheet 206 to move to the upper edges of the third ribs 313. This configuration may reduce catching of the sheet 6 on the upstream ends of the third ribs 313 with respect to the conveying direction 219.

The fourth ribs 314 may be provided for holding the right and left portions of the bottoms of the groove portions of the corrugated sheet 206 being pressed by the second spurs 282 and the third spurs 283. As depicted in FIG. 16, the fourth ribs 314 may extend from respective positions upstream of the second spurs 282 to respective positions downstream of the third spurs 283 with respect to the conveying direction 19. The fourth rib 314 may be disposed between each third rib 313 and each second spur 282 that may be adjacent to each other with respect to the right-left direction 209. With this configuration, the fourth ribs 314 may hold the right and left portions of the bottoms of the groove portions of the corrugated sheet 206. Protruding edges (upper edges) of the fourth ribs 314 may be located lower than the protruding edges (upper edges) of the third ribs 313, e.g., closer to the first defining member 361 than the protruding edges (upper edges) of the third ribs 313, to hold the groove portions of the corrugated sheet 206.

As depicted in FIG. 27B, each of the fourth ribs 314 may comprise a fourth guide surface 324 at an upstream end of each of the fourth ribs 314 with respect to the conveying direction 219. In each of the fourth ribs 314, the fourth guide surface 324 may extend obliquely upward from the upper surface of the base 311 to an upper edge of the fourth rib 314. The fourth guide surfaces 324 may come into contact with the leading edge of the sheet 206 to allow the sheet 206 to move to the upper edges of the fourth ribs 314. This configuration may reduce catching of the sheet 6 on the upstream ends of the fourth ribs 314 with respect to the conveying direction 219. While the sheet 206 is conveyed, the fourth ribs 314 may hold the right and left portions of the groove portions of the corrugated sheet 6, respectively.

The base 311 may have openings 319 (see FIG. 16). Each of the openings 319 may be disposed between adjacent ribs of the fourth ribs 314 and at a position corresponding to one of the pairs of the second spur 282 and the third spur 283 aligned along the conveying direction 219. The base 311 might not have an upper surface where the openings 319 may present. With this configuration, for example, when a corrugated sheet 206 swells due to a large amount of ink adhered to the sheet 206 and groove portions of the corrugated sheet 206 move down due to the swelling of the sheet 206, the groove portions of the sheet 206 might not come into contact with the upper surface of the base 311. Therefore, this configuration may prevent the groove portions of the sheet 206 from sliding over the upper surface of the base 311. As a result, the deformation of the corrugation pattern of the sheet 206 and the conveyance resistance to the sheet 206 may be reduced. Additionally, the degradation of the image-recording accuracy may be reduced.

The second spurs 282 and the third spurs 283 may be provided for maintaining the corrugation pattern of the sheet 206 by pressing the bottoms of the groove portions of the corrugated sheet 206 from above. In some examples, and as depicted in FIG. 16, the second spurs 282 and the third spurs 283 may have the same configuration as the first spurs 239. The second spurs 282 and the third spurs 283 may be also rotatably disposed on respective elastic shafts 301. Therefore, the second spurs 282 and the third spurs 283 may be allowed to retract upwardly when a sheet 206 having higher stiffness is conveyed. The second spurs 282 may be disposed in pairs on respective elastic shafts 301 and each pair of second spurs 282 may be separated from each other by the spacer 302 in the right-left direction 209. The third spurs 283 may also be disposed in pairs on respective elastic shafts 301 and each pair of third spurs 283 may also be separated from each other by the spacer 302 in the right-left direction 209. In each pair of second spurs 282, a middle position between the second spurs 282 connected with each other by the spacer 302 with respect to the right-left direction 209 may correspond to a corresponding one of the bottoms of the groove portions of the corrugated sheet 206. The second spurs 282 and the third spurs 283 may be disposed in pairs on the respective elastic shafts 301 to scatter or distribute their forces that may act on the sheet 206 when the second spurs 282 and the third spurs 283 press the sheet 206.

As depicted in FIG. 26, both ends of the elastic shafts 301 of the second spurs 282, with respect to the right-left direction 209, may be fixed to the second fixing portions 304 of the second defining member 362, respectively. The lower ends of the second spurs 282, e.g., protruding ends of the second spurs 282 facing the first defining member 361, may be located closer to the first defining member 361 than the nip points of the discharge roller pair 237. The lower ends of the second spurs 282 may be located at the same or substantially the same level as the front ends (the lower ends) of the contact portions 263 of the contact members 260, respectively, with respect to the front-rear direction 208. Therefore, the second spur 282 may be configured to press the bottoms of the groove portions of the corrugated sheet 206, respectively, toward the first defining member 361.

As depicted in the drawing enclosed within the dashed line in FIG. 12, the second spurs 282 may be disposed such that a distance L2 between the lower ends of the second spurs 282 and the respective nip points of the discharge roller pair 237 with respect to the conveying direction 219 may be shorter than a distance L3 between the nip points of the conveyor roller pair 234 and the respective front ends of the contact portions 263 with respect to the conveying direction 219. With this configuration, the leading edge of the sheet 206 may reach the second spurs 282 while the trailing edge of the sheet 206 with respect to the conveying direction 219 may be nipped between the first ribs 51 and the contact portions 263 from above and below. Therefore, the sheet 206 may already have been in contact with the second spurs 282 when the trailing edge of the sheet 206 passes between the first ribs 251 and the contact portions 263. Accordingly, the upstream part and the downstream part of the sheet 206 with respect to the conveying direction 219 may be maintained in the corrugated shape.

As depicted in FIG. 26, both ends of the elastic shafts 301 of the third spurs 83 with respect to the right-left direction 209 may be fixed to the third fixing portions 305 of the second defining member 362, respectively. The lower ends of the third spurs 283, e.g., protruding ends of the third spurs 283 facing the first defining member 361, may be located closer to the first defining member 361 than the nip points of the discharge roller pair 237. The lower ends of the third spurs 283 may be located at the same or substantially the same level as the lower ends of the contact portions 263 of the contact members 260, respectively. Therefore, the third spurs 283 may be configured to press the bottoms of the groove portions of the corrugated sheet 206, respectively.

The third spurs 283 may be disposed downstream of the second spurs 282 with respect to the conveying direction 219 and spaced apart from the second spurs 282, respectively. With this configuration, the second spurs 282 and the third spurs 283 press the respective groove portions of the corrugated sheet 206 at the two points spaced apart from each other with respect to the conveying direction 219. Therefore, the curling of the trailing edge of the sheet 206 on the platen 250 may be reduced after the trailing edge of the sheet 206 passes the contact portions 263. When the distance L2 between the second spurs 282 and the third spurs 283 is long, the trailing edge of the sheet 206 may pass the contact portions 263 before the leading edge of the sheet 206 reaches the third spurs 283 and thus the sheet 206 may pivot about the second spurs 282. Therefore, the third spurs 283 may be disposed at appropriate positions (e.g., distances) from the second spurs 282 such that the leading edge of the sheet 206 having a shortest length with respect to the conveying direction 219 may reach the third spurs 283 before the trailing edge of the sheet 206 passes the contact portions 263.

Figure 28:
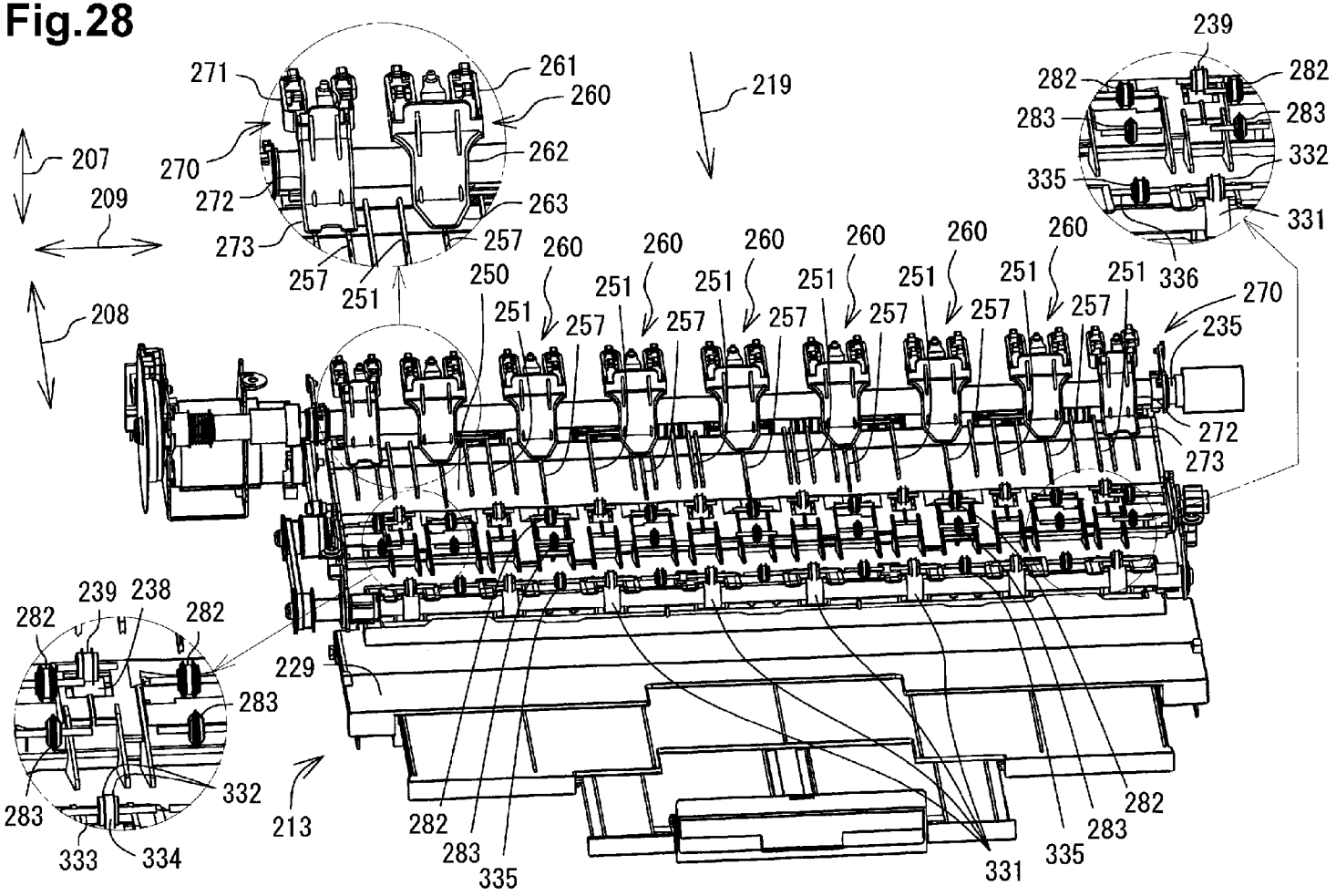
FIG. 28 is a perspective view depicting the essential parts of the main body in the second illustrative embodiment according to one or more aspects of the disclosure.

As depicted in FIGS. 12 and 28, a reversible roller pair 330 (as an example of a third conveyor) may be disposed downstream of the third spurs 283 and the first junction 22 in the first conveying path 231 with respect to the conveying direction 219. The reversible roller pair 330 may comprise a rotating shaft 331A, a plurality of reversible rollers 331, and a plurality of fifth spurs 332. The rotating shaft 331A may be disposed downstream of the first junction 224 with respect to the conveying direction 219 (in front of the first junction 224 with respect to the front-rear direction 208). The reversible rollers 331 may be disposed on the rotating shaft 331A. The fifth spurs 332 may be disposed above the respective reversible rollers 331.

The rotating shaft 331A may be supported by the frame (not depicted) at both ends with respect to the right-left direction 209 (the direction orthogonal to the drawing sheet of FIG. 12). The rotating shaft 331A may be configured to be rotated by the drive motor (not depicted).

As depicted in FIG. 28, the fifth spurs 332 may be rotatably disposed on elastic shafts 333, respectively. Each of the elastic shafts 333 may have elasticity with respect to a diameter direction thereof. In one or more examples, the fifth spurs 332 may be disposed in pairs on respective elastic shaft 333. The pair of right and left fifth spurs 332 may be spaced apart from each other with respect to the right-left direction 209 by a spacer 334 disposed on the elastic shaft 301. Both ends of the elastic shaft 333 with respect to the right-left direction 209 may be fixed to one of the conveying-path defining members (not depicted). The elastic shaft 333 may be configured to be deformed such that a middle part of the elastic shaft 333 with respect to the right-left direction 209 may be located higher than either end of the elastic shaft 333 with respect to the right-left direction 209 when the pair of fifth spurs 332 is in contact with the corresponding reversible roller 331. In this state, the elastic shaft 333 may urge the pair of fifth spurs 332 downward. The pair of fifth spurs 332 may be in pressure contact with the corresponding reversible roller 331 by urging force of the elastic shaft 333. According to some examples, all of the pairs of fifth spurs 332 and the elastic shafts 101 may have the same configuration.

As depicted in FIG. 28, the reversible roller pair 330 may be disposed such that the nip points of the reversible roller pair 330 may be disposed on extensions of the first ribs 251, respectively, along the conveying direction 219 (in front of the first rib 251 with respect to the front-rear direction 8). After the first ribs 251 hold the tops of the ridge portions of the corrugated sheet 206, the discharge roller pair 37 may nip the tops of the ridge portion of the corrugated sheet 206 as the tops of the ridge portions reach the nip points of the discharge roller pair 237. Then, the discharge roller pair 237 may convey the sheet 206 while nipping the sheet 206. As the sheet 206 may reach the nip points of the reversible roller pair 330, the reversible roller pair 330 may nip the sheet 6.

The fourth spurs 335 may be provided for maintaining the corrugation pattern of the sheet 6 by pressing the bottoms of the groove portions of the corrugated sheet 6 from above, e.g., from the side where the second defining member 362 may be present. As depicted in FIG. 28, the fourth spurs 335 may have the same configuration as the first spurs 239. With this configuration, the fourth spurs 335 may be allowed to retract upward when a sheet 206 having higher stiffness, is conveyed. The fourth spurs 335 may be disposed in pairs on respective elastic shafts 336 and each pair of fourth spurs 335 may be separated from each other by a spacer 337 with respect to the right-left direction 209. In each pair of fourth spurs 335, a middle position between the pair of fourth spurs 335, connected with each other by the spacer 337 with respect to the right-left direction 209, may correspond to a corresponding one of the bottoms of the groove portions of the corrugated sheet 206. The fourth spurs 335 may be disposed in pairs on the respective elastic shafts 336 to scatter or distribute their forces that may act on the sheet 206 when the fourth spurs 335 press the sheet 206. In FIG. 12, the fourth spurs 335 may be disposed at the same position as the fifth spurs 332 with respect to the direction perpendicular to the drawing sheet. Therefore, the fourth spurs 335 are not depicted in FIG. 12.

Lower ends of the fourth spurs 335, e.g., protruding ends of the fourth spurs 335 facing the first defining member 361, may be located closer to the first defining member 361 than the nip points of the reversible roller pair 330. The lower ends of the fourth spurs 335 may be disposed at the same or substantially the same level as the lower ends of the contact portions 263 of the contact members 260, respectively. Therefore, the fourth spurs 335 may be configured to press the bottoms of the groove portions of the corrugated sheet 206, respectively, from the side where the second defining member 362 is present (e.g., located or disposed).

Figure 29:
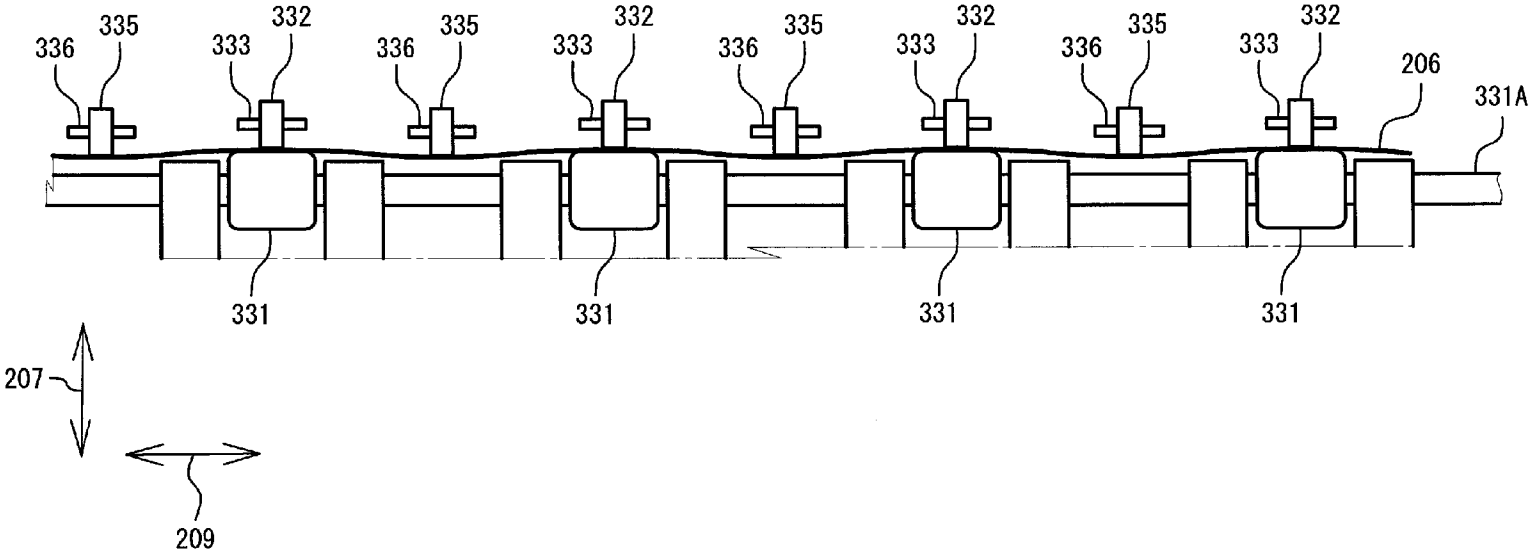
FIG. 29 is a schematic view depicting a reversible roller pair that conveys a sheet having relatively lower stiffness in the second illustrative embodiment according to one or more aspects of the disclosure.

As depicted in FIG. 29, the lower ends of the fourth spurs 335 may be located lower than the nip points of the reversible rollers 331 and the fifth spurs 332 with respect to the up-down direction 207. Each of the fourth spurs 335 may be disposed between the pairs of reversible roller 331 and fifth spur 332 with respect to the right-left direction 209. With this configuration, the sheet 206 may be formed into the corrugated shape in which the sheet 206 has ridge portions that may be nipped by the pairs of reversible roller 331 and fifth spur 332 and groove portions that may be held by the fourth spurs 335 with respect to the right-left direction 209.

As depicted in FIG. 12, a plurality of path switching portions 340 may be disposed downstream of the third spurs and in an upper area of the first conveying path 231. The path switching portions 340 may be arranged side by side along the right-left direction 209. The path switching portions 340 may correspond to a switching member.

Each of the path switching portions 340 may comprise sixth spurs 341, a flap 343, and a support shaft 344. The support shaft 344 may extend along the right-left direction 209 and may be rotatably attached to the frame of the printer unit 211. The flap 343 may comprise a plurality of ribs that extend from the support shaft 344 downstream in the conveying direction 219. The ribs of the flap 343 may be disposed at respective positions corresponding to the discharge rollers 238 of the discharge roller pair 237 with respect to the right-left direction 209. The flap 343 may be configured to pivot in accordance with rotation of the support shaft 344.

The sixth spur 341 may be disposed between each of the ribs of the flap 343. The sixth spurs 341 may be disposed between a base end and a free end of the flap 343. The sixth spurs 341 may partially protrude downward from a lower surface of the flap 343. The sixth spurs 341 may be configured to be rotatable about an axis extending along the right-left direction 209 and may be spaced apart from each other with respect to the right-left direction 209.

The flap 343 may be configured to be pivotable between a sheet-discharge position (e.g., indicated by a dashed line in FIG. 12) and a sheet-reverse position (e.g., indicated by a solid line in FIG. 12). When the flap 343 is located in the sheet-discharge position, the lower surface of the flap 343 may be located closer to the second defining member 362 than the first defining member 361. When the flap 343 is located in the sheet-reverse position, the free end of the flap 343 may be located in the second conveying path 223 across the first defining member 361. For example, the free end of the flap 343 located in the sheet-reverse position may be located lower than the free end of the flap 343 located in the sheet-discharge position and/or the sheet-reverse position may be located lower than the sheet-discharge position.

In some instances, the flap 343 may stay in the sheet-reverse position under its own weight. The flap 343 may be moved (e.g., raised) from the sheet-reverse position to the sheet-discharge position by the sheet 206 being conveyed in the first conveying path 231 along the conveying direction 219. When the flap 343 is located in the sheet-discharge position, the sheet 206 may be conveyed to the end of the first conveying path 231. At that time, the sixth spurs 341 may be rotated by which the sixth spurs 341 may contact the upper surface of the sheet 206 being conveyed. That is, the path switching portions 340 located in the sheet-discharge position may be configured to guide the upper surface of the sheet 206 and to allow the sheet 206 to move along the conveying direction 219 in the first conveying path 231.

When the trailing edge of the sheet 206 passes immediately below the sixth spurs 341, the downward force of the flap 343 resulting from its own weight may become greater than the force of the sheet 206 causing the flap 343 upward. Therefore, the flap 343 may be move or return from the sheet-discharge position to the sheet-reverse position under its own weight. Thus, the direction in which the trailing edge of the sheet 206 points may be changed toward the second conveying path 223. When the reversible rollers 331 rotate in the conveying direction 219 under this condition, the sheet 206 may be discharged onto the sheet discharge tray 229.

When the reversible rollers 331 rotate in a direction reverse to the conveying direction 219 when the trailing edge of the sheet 206 points toward the second conveying path 223, the sheet 206 may be guided into the second conveying path 223. For example, when the flap 343 is located in the sheet-reverse position, the sheet 206 may be conveyed to the second conveying path 223 while the ridge portions of the corrugated sheet 206 contact the ribs of the flap 343, respectively.

Additionally or alternatively, a reverse roller pair 350 may be disposed in the second conveying path 223. The reverse roller pair 350 may comprise a reverse roller 351 and a pinch roller 352. The reverse roller 351 and pinch roller 352 may be in contact with each other and may be configured to nip and convey the sheet 206. The reverse roller 351 may be configured to be rotated by transmission of a drive force from the motor (not depicted) via a power transmission mechanism (not depicted). The power transmission mechanism may comprise planet gears, for example. The power transmission mechanism may be configured to rotate the reverse roller 351 in one rotation direction to convey the sheet 206 along the conveying direction 217 although the conveyor motor may be rotated in either one of a normal direction and a reverse direction.

An upper guide member 364 and a lower guide member 365 may define the second conveying path 233 while the upper guide member 364 may be disposed above the lower guide member 365. The upper guide member 364 and the lower guide member 365 may be opposed to each other and separated from each other to allow the sheet 206 to pass therebetween. The upper guide member 364 and the lower guide member 365 may extend along a direction perpendicular to the drawing sheet of FIG. 12, e.g., along the right-left direction 209.

As depicted in FIG. 12, the upper guide member 364 defining the second conveying path 223 may be bent at a position upstream of the reverse roller 351 with respect to the conveying direction 217. More specifically, a surface of the upper guide member 364 defining the second conveying path 223 may comprise a first surface 366 and a second surface 367. Although not depicted in detail in FIG. 12, the first surface 366 and the second surface 367 may comprise a plurality of ribs that may extend along the conveying direction 217 on the upper guide member 364. Protruding surfaces of the plurality of ribs may provide the first and second surfaces 366, 367. The sheet 206 being conveyed in the second conveying path 223 may be guided along the conveying direction 217 by the protruding surfaces of the ribs.

The first surface 366 may be an inclined surface that may decline rearward. For example, the first surface 366 may be inclined a predetermined angle with respect to a horizontal surface that may extend along the front-rear direction 208 and the right-left direction 209. The second surface 367 may be a substantially horizontal surface that may extend substantially parallel to the front-rear direction 108 and the right-left direction 109. In one example, the first surface 366 may be inclined greater than the second surface 367 with respect to the horizontal surface. In other embodiments, for example, the second surface 367 may also be an inclined surface that may be inclined less than the first surface 366. In this second illustrative embodiment, the first surface 366 may be the inclined surface and the second surface 367 may be the substantially horizontal surface. Therefore, a portion where the first surface 366 and the second surface 367 may join each other may be a projecting portion 363. As described above, the first surface 366 and the second surface 367 may be planes that may extend along the right-left direction 209. Thus, the projecting portion 363 at which the first surface 366 and the second surface 367 may join each other may constitute a line that may extend along the right-left direction 209.

The projecting portion 363 may project toward the lower guide member 365 and may be located below a dashed line 390 (see FIG. 12), which may be a phantom line extending between the nip points of the reversible roller pair 330 and the respective nip points of the reverse roller 351. For example, the projecting portion 363 may project toward the lower guide member 365 with respect to the dashed line 390 when viewed from the side.

Hereinafter, various operations of the inkjet recording apparatus 210 in various situations are described. A first situation may correspond to the inkjet recording apparatus 210 performing image recording onto a sheet 206 having relatively low stiffness, for example, plain paper. A second situation correspond to the inkjet recording apparatus 210 performing image recording onto a sheet 206 having relatively higher stiffness. A third situation correspond to the inkjet recording apparatus 210 performing the image recording onto a sheet 206 having relatively greater thickness.

First, an operation of the inkjet recording apparatus 210 in the first situation where the inkjet recording apparatus 210 may record an image onto a sheet having relatively lower stiffness is described with reference to FIGS. 15B, 20, 21A, and 21B. One or more sheets 206, for example, plain paper, may be placed in the sheet feed cassette 220 and centered therein by the side guide mechanism 227. The feed roller 243 may feed, one by one, the one or more sheets 206 into the first conveying path 231. Then, the conveyor roller pair 234 may convey the one or more fed sheets 206 successively. The guide portions 269, 279 of the contact members 260, 270 may guide a leading edge of the sheet 206 that has passed the nip points of the conveyor roller pair 234 to the contact portions 263, 273. When the sheet 206 contacts the contact portions 263, 273, the contact members 260, 270 may be moved from the lower limit position to the upper limit position (see FIG. 30). The sheet 206 being used, for example, plain paper, may have relatively lower stiffness. Therefore, the platen 250 may hardly be pivoted, and thus, the first ribs 251 and the eighth ribs 256 may hold the sheet 206. Under this condition, the lower surfaces of the contact portions 263, 273 may be located lower than the upper edges of the first ribs 251. Accordingly, the lower surfaces of the contact portions 263, 273 may press the sheet 206 downward to form a corrugated shape in the sheet 206 (see FIG. 15B). In the inkjet recording apparatus 210, the one or more sheets 6 may be centered in the sheet feed cassette 220 and the contact members 260, 270, the first ribs 251, and the eighth ribs 256 may be disposed at diametrically opposed positions relative to the center line of the platen 250 with respect to the right-left direction 209. This configuration may provide a symmetric corrugation pattern in the sheet 206. Further, all of the distances D1-D4 between the first ribs 251 may be the same distance D and each of the contact members 260 may be disposed at the middle position between the adjacent first ribs 251. This configuration may form the corrugated shape in the sheet 206 such that the distance between a top of a ridge portion and a bottom of a groove portion of each curve in the corrugation pattern along the right-left direction 209 may become the same distance. In addition to this, the eighth ribs 256 may allow the curvature radius of the curve formed closer to the middle part of the sheet 206 with respect to the right-left direction 209 to become smaller than the curvature radius of the curves formed farther from the middle part of the sheet 206.

The corrugation pattern may increase the stiffness of the sheet 206 and reduce an occurrence of the curling in the sheet 206. The sheet 206 may be conveyed under this condition. When the leading edge of the sheet 206 being conveyed reach the position under the nozzles 247 of the recording head 246 under this condition, the conveyor roller 235 may be allowed to stop rotating. After that, while the carriage 248 may reciprocate along the right-left direction 209, the recording head 246 may eject ink droplets from the nozzles 247 onto the sheet 206 to perform a single line of printing. At that time, the recording head 246 may eject the ink droplets in consideration of the distance between the sheet 206 and each nozzle 247 that may be changed periodically due to the corrugation pattern formed in the sheet 206. The inkjet recording apparatus 210 may determine a sheet type, whether the sheet 206 has relatively lower stiffness, for example, plain paper, based on information included in a print instruction. After the inkjet recording apparatus 210 performed the single line of printing, the conveyor roller 235 may be allowed to start rotating again to convey the sheet 206 by a single line to start next single line of printing in a new line. The inkjet recording apparatus 210 may record an image on the sheet 206 by alternately performing a single line of printing and a line feed.

The conveyor roller 235 may convey the sheet 206 over the platen 250 while the first ribs 251 may hold the tops of the ridge portions of the corrugated sheet 206, and then the fifth ribs 315 of the first defining member 361 may hold the tops of the ridge portions of the sheet 206. After that, when the tops of the ridge portions of the corrugated sheet 206 held by the fifth ribs 315 reach the nip point of the discharge roller pair 237, the discharge roller pair 237 may be nip the tops of the ridge portions of the corrugated sheet 206 and convey the sheet 206 along the conveying direction 219.

Then, the second ribs 312 may hold the tops of the ridge portions of the corrugated sheet 206 that have passed the nip points of the discharge roller pair 237. The first guide surfaces 310 and the fourth guide surfaces 324 may guide the groove portions of the corrugated sheet 206 to the lower ends of the second spurs 282 and the second spurs 282 may press the sheet 206 from above. At that time, each of the fourth ribs 314 may hold the right and left portions of each of the groove portions of the corrugated sheet 206, and the trailing edge of the sheet 206 has not passed the contact portions 263, 273. Therefore, the sheet 206 may be held such that the forward part and rearward part of the sheet 206 may be maintained in the corrugated shape. Accordingly, the sheet 206 may be reliably maintained in the corrugated shape.

After passing the second spurs 282, the leading edge of the sheet 206 may reach the third ribs 313 and the forth ribs 314. The first conveyor roller 335 may convey the sheet 206 along the conveying direction 219 to the third spurs 283 while each of the third ribs 313 may hold the right and left portions of each of the ridge portions of the corrugated sheet 206 and each of the fourth ribs 314 may hold the right and left portions of each of the groove portions of the corrugated sheet 206. When the sheet 206 reaches the third spurs 283, the third spurs 283 may press the bottoms of the groove portions of the corrugated sheet 206. The sheet 206 may be pressed at the two points that may be the second spurs 282 and the third spurs 283 spaced apart from each other with respect to the conveying direction 219. Therefore, the sheet 206 may be conveyed without being pivoted about the second spurs 282 after the sheet 206 passes the contact portions 263, 273.

After passing the third spurs 283, the leading edge of the sheet 206 may reach the first junction 224 in the first conveying path 231, and then may come into contact with the sixth spurs 341 of the path switching portions 340. Then, the flaps 343 may be pivoted upward about the respective support shafts 344 by the stiffness of the corrugated sheet 206. Thus, the proceeding direction of the leading edge of the sheet 206 may be changed at the first junction 224 and the sheet 206 may be conveyed toward the reversible roller pair 330. Although the sixth spurs 341 may be made contact with the ridge portions of the corrugated sheet 206, the corrugated shape of the sheet 206 may not be deformed by the weight of the flaps 343.

The tops of the ridge portions of the corrugated sheet 206 that allowed the flaps 343 to pivot upward may reach the nip points of the reversible roller pair 330. At that time, the reversible roller pair 330 may nip the tops of the ridge portions of the corrugated sheet 206 and the fourth spurs 335 may press the bottoms of the groove portions of the corrugated sheet 206 from above. With this configuration, the sheet 206 may be reliably maintained in the corrugated shape.

After completing the image recording onto the sheet 206, the inkjet recording apparatus 210 may discharge the sheet 206 onto the sheet discharge tray 229 by the discharge roller pair 237 and the reversible roller pair 330.

Next, an operation of the inkjet recording apparatus 210 in the second situation where the inkjet recording apparatus 210 may record an image onto a sheet 206 having relatively higher stiffness is described with reference to FIG. 15C. The feed roller 243 may feed, one by one, one or more sheets 206, which may be placed in the sheet feed cassette 220, into the first conveying path 231, and the conveyor roller pair 234 may convey the one or more fed sheets 206 successively.

As the sheet 206 enter between the conveyor roller 235 and the following rollers 236, the following rollers 236 may be moved downward by the thickness of the sheet 206 against the urging force of the springs 373, 375. The sheet 206 has a thickness that may be greater than the plain paper. Therefore, the rearward part (the rear-end side where protrusions 374 may be present) of the platen 250 may be moved downward in accordance with the downward movement of the following rollers 236.

The guide portions 269, 279 of the contact members 260, 270 may allow the leading edge of the sheet 206 that has passed the nip points of the conveyor roller pair 234, to move to the contact portions 263, 273. When the sheet 206 comes into contact with the contact portions 263, 273, the contact members 260, 270 may be moved from the lower limit position to the upper limit position (see FIGS. 30A and 30B). The sheet 206 may have relatively higher stiffness. Therefore, when the contact members 260, 270 are positioned in the upper limit position, the platen 250 may be pivoted by the sheet 206 such that the upstream part of the platen 250 with respect to the conveying direction 219 may be moved downward. Thus, the contact portions 371 of the platen 250 may be separated from the receiving portions 372 of the holder 357, respectively. That is, the platen 250 may be moved downward and separated from the holder 357. The following rollers 236 may not be moved downward further although the sheet 206 may be nipped by the first ribs 251 of the platen 250 and the contact portions 263, 273 of the contact members 260, 270.

Figure 15A:
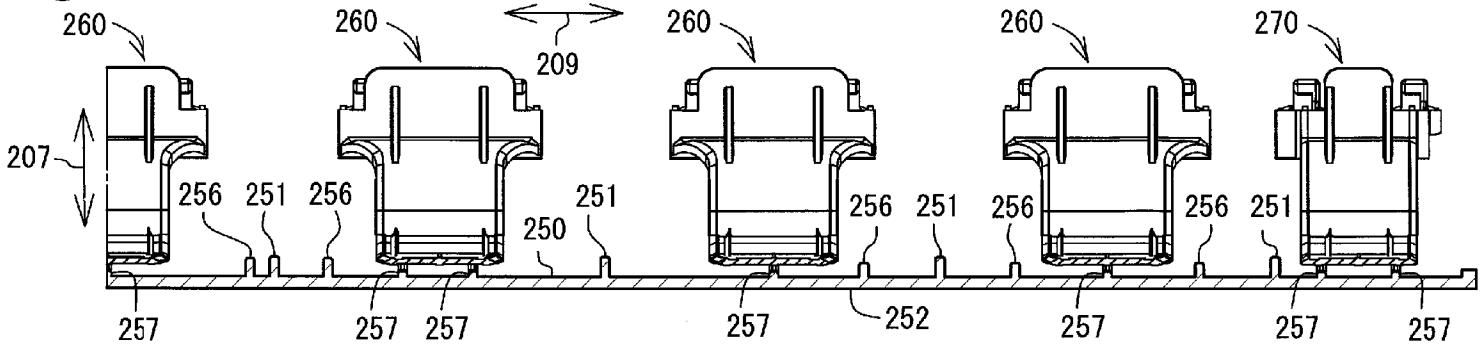
FIG. 15A is a sectional view depicting a platen and contact members, taken along a line extending in a right-left direction, in the second illustrative embodiment according to one or more aspects of the disclosure.
Figure 15B:
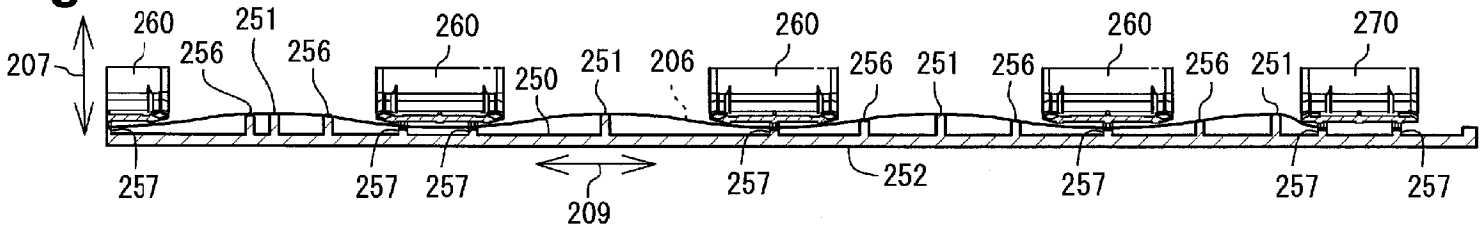
FIG. 15B is a sectional view depicting the platen and the contact members when a sheet having relatively lower stiffness is conveyed, taken along the line extending in the right-left direction, in the second illustrative embodiment according to one or more aspects of the disclosure.
Figure 15C:
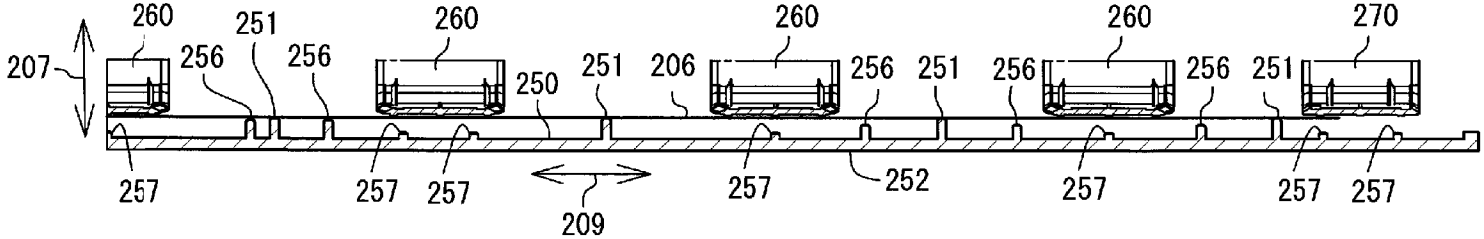
FIG. 15C is a sectional view depicting the platen and the contact members when a sheet having relatively higher stiffness is conveyed, taken along the line extending in the right-left direction, in the second illustrative embodiment according to one or more aspects of the disclosure.

Therefore, as depicted in FIG. 15C, the sheet 206 may be conveyed without being corrugated. Then, the recording head 246 may record an image on the sheet 206. As described above, the sheet 206 may not be formed into the corrugated shape. Thus, the recording head 246 may eject ink droplets after the inkjet recording apparatus 210 determined that the distance between the sheet 206 and each nozzle 247 is constant with respect to the up-down direction 207. The inkjet recording apparatus 210 may determine a sheet type, whether the sheet 206 has relatively higher stiffness, based on information included in a print instruction.

As the sheet 206 held by the fifth ribs 315 reach the nip points of the discharge roller pair 237, the discharge roller pair 237 may nip the sheet 206. Then, the first guide surfaces 310 and the fourth guide surfaces 324 may allow the leading edge of the sheet 206 that has passed the nip points of the discharge roller pair 237, to move to the lower ends of the second spurs 282. The sheet 206 may have relatively higher stiffness. Therefore, the sheet 206 may deform the elastic shafts 301 of the second spurs 282 and move the second spurs 282 upward when the sheet 206 passes the second spurs 282. The sheet 206 may be conveyed with being maintained in the flat shape by moving the second spurs 282 upward.

After the leading edge of the sheet 206 passes the second spurs 282, the leading edge of the sheet 206 may reach the third spurs 283 while being held by the third ribs 313. When passing the third spurs 283, the sheet 206 having relatively higher stiffness may deform the elastic shafts 301 of the third spurs 283 and move the third spurs 283 upward. Therefore, the sheet 206 may be conveyed with being maintained in the flat shape.

After passing the third spurs 283, the leading edge of the sheet 206 may reach the first junction 224 in the first conveying path 231 and come into contact with the sixth spurs 341 of the path switching portions 340. At that time, the flaps 343 may be pivoted upward about the respective support shafts 344 by the stiffness of the sheet 206 having relatively higher stiffness. Thus, the proceeding direction of the leading edge of the sheet 206 may be changed at the first junction 224 and thus the sheet 206 may be conveyed toward the reversible roller pair 330.

As the sheet 206 may reach the nip points of the reversible roller pair 330 after allowing the flaps 343 to pivot upward, the reversible roller pair 330 may nip the sheet 206. When passing the fourth spurs 335, the sheet 206 having relatively higher stiffness may deform the elastic shafts 336 of the fourth spurs 335 and move the fourth spurs 335 upward. Therefore, the sheet 206 may be conveyed with being maintained in the flat shape. Then, the discharge roller pair 237 and the reversible roller pair 330 may discharge the sheet 206 onto the sheet discharge tray 229.

Next, an operation of the inkjet recording apparatus 210 in the third situation where the inkjet recording apparatus 210 may record an image onto a sheet 206 having relatively greater thickness is described with reference to FIG. 22A. The feed roller 243 may feed, one by one, one or more sheets 206, which may be placed in the sheet feed cassette 220, into the first conveying path 231, and the conveyor roller pair 234 may convey the one or more fed sheets 206 successively. The guide surfaces 269, 279 of the contact members 260, 270 may allow the leading edge of the sheet 206 that has passed the nip points of the conveyor roller pair 234, to move to the contact portions 263, 273. As the sheet 206 comes into contact with the contact portions 263, 273, the contact members 260, 270 may be moved from the lower limit position to the upper limit position (see FIGS. 30A and 30B). The sheet 206 has a thickness that may be greater than a thickness of the plain paper. Therefore, the platen 250 may be slightly pivoted by the sheet 206 when the contact members 260, 270 are positioned in the upper limit position. Therefore, the sheet 206 may be formed into the corrugated shape (indicated with a solid line) that may be more gentle (have a smaller amplitude) than the corrugated shape of the plain paper (indicated with a dashed line), as depicted in FIG. 22A. The recording head 246 may eject ink droplets after the inkjet recording apparatus 210 determined that the sheet 206 has a gentle corrugated shape. More specifically, the recording head 246 may eject ink droplets after the inkjet recording apparatus 210 determined that the distance between the sheet 206 and each nozzle 247 is periodically changed wherein the degree of the distance change is smaller than the degree of the distance change in the plain paper. The inkjet recording apparatus 210 may determine a sheet type, whether the sheet 206 has relatively greater stiffness, based on information included in a print instruction.

The conveyor roller 235 may convey the sheet 206 over the platen 250 while the first ribs 251 may hold the tops of the ridge portions of the corrugated sheet 206, and then the fifth ribs 315 of the first defining member 361 may hold the tops of the ridge portions of the corrugated sheet 206. After that, as the tops of the ridge portions of the corrugated sheet 206 held by the fifth ribs 315 may reach the nip points of the discharge roller pair 237, the discharge roller pair 237 may nip the tops of the ridge portions of the corrugated sheet 206 and convey the sheet 206 along the conveying direction 219.

Then, the second ribs 312 may hold the tops of the ridge portions of the corrugated sheet 206 that has passed the nip points of the discharge roller pair 237. The first guide surfaces 310 and the fourth guide surfaces 324 may allow the groove portions of the corrugated sheet 206 to move to the lower ends of the second spurs 282, and the second spurs 282 may press the sheet 206 from above. The sheet 206 may have the thickness that may be greater than the thickness of the plain paper. Therefore, the elastic shafts 301 of the second spurs 282 may be slightly deformed by the sheet 206 and the second spurs 282 may be slightly moved upward. Thus, the sheet 206 may be conveyed while being maintained in the corrugated shape that may be more gentle (have a smaller amplitude) than the corrugated shape of the plain paper. At that time, the trailing edge of the sheet 206 has not passed the contact portions 263, 273 yet. Therefore, the sheet 206 may be held such that the forward part and rearward part of the sheet 206 may be maintained in the gentle corrugated shape. Accordingly, the sheet 206 may be reliably maintained in the gentle corrugated shape.

After passing the second spurs 282, the leading edge of the sheet 206 may reach the third ribs 313 and the fourth ribs 314. The conveyor roller 235 may convey the sheet 206 along the conveying direction 219 to the third spurs 283 while each of the third ribs 313 may hold the right and left portions of each of the ridge portions of the corrugated sheet 206 and each of the fourth ribs 314 may hold the right and left portions of each of the groove portions of the corrugated sheet 206. As the sheet 206 reaches the third spurs 283, the third spurs 283 may press the bottoms of the groove portions of the corrugated sheet 206. The sheet 206 may have the thickness that may be greater than the thickness of the plain paper. Therefore, the elastic shafts 301 of the third spurs 283 may be slightly deformed by the sheet 206 and the third spurs 283 may be slightly moved upward. Therefore, the sheet 206 may be conveyed while being formed in the corrugated shape that may be more gentle (have a smaller amplitude) than the corrugated shape of the plain paper. The sheet 206 may be pressed at the two points that may be the second spur 282 and the third spur 283 spaced apart from each other with respect to the conveying direction 219. Therefore, the sheet 206 may be conveyed without rotating about the second spurs 282 after the sheet 206 passes the contact portions 263, 273.

After passing the third spurs 283, the leading edge of the sheet 206 may reach the first junction 224 in the first conveying path 231, and then may come into contact with sixth spurs 341 of the path switching portions 340. The flaps 343 may be pivoted upward about the respective support shafts 344 by the stiffness of the sheet 206 formed into the gentle corrugated shape. Thus, the proceeding direction of the leading edge of the sheet 206 may be changed at the first junction 224 and this the sheet 206 may be conveyed toward the reversible roller pair 330.

The tops of the ridge portions of the corrugated sheet 206 that allowed the flaps 343 to pivot upward may reach the nip points of the reversible roller pair 330. At that time, the reversible roller pair 330 may nip the tops of the ridge portions of the corrugated sheet 206 and the fourth spurs 335 may press the bottoms of the groove portions of the corrugated sheet 206 from above. The sheet 206 may have the thickness that may be greater than the thickness of the plain paper. Therefore, the elastic shafts 336 of the fourth spurs 335 may be slightly deformed by the sheet 206 and the fourth spurs 335 may be moved upward slightly. Thus, the sheet 206 may be conveyed while being maintained in the corrugated shape that may be more gentle (have a smaller amplitude) than the corrugated shape of the plain paper. Accordingly, the sheet 206 may be reliably maintained in the gentle corrugated shape.

After the image recording is completed, the discharge roller pair 237 and the reversible roller pair 330 may discharge the sheet 206 onto the sheet discharge tray 229.

The inkjet recording apparatus 210 may be allowed to perform double-sided printing on sheets 206 of any types. In the double-sided printing, the reversible rollers 331 may be stopped temporarily before the trailing edge of the sheet 206, on which an image has been recorded on a first side (for example, an upper side) of the sheet 206, passes the nip points of the reversible roller pair 330 after the trailing edge of the sheet 206 passed the first junction 224 in the first conveying path 231. Then, the reversible rollers 331 may be rotated in the direction opposite to the conveying direction 219. Thus, the upstream edge (the trailing edge) of the sheet 206 with respect to the conveying direction 219 may become a leading edge of the sheet 206 with respect to the reverse direction and the sheet 206 may be conveyed along the first conveying path 231 in the direction reverse to the conveying direction 219, and reach the first junction 224. At the first junction 224, the free ends of the flaps 343 have been moved downward by the path switching portions 340 such that the sheet 206 may proceed to the second conveying path 223. Therefore, the flaps 343 may allow the sheet 26 to rotated about the nip points of the reversible roller pair 330 such that the leading edge of the sheet 206 may proceed to the second conveying path 223.

The leading edge of the sheet 206 being conveyed may proceed along the conveying direction 217 in the second conveying path 223 along the first surface 366 of the upper guide member 364. After passing the projecting portion 363 in the second conveying path 223, the leading edge of the sheet 206 may proceed while being made contact with the lower guide member 365. Accordingly, the proceeding direction of a part of the sheet 206 that has passed the projecting portion 363 may be slightly changed so as to be different from the proceeding direction of a part of the sheet 206 that has not passed the projecting portion 363 yet. The sheet 206 may be slightly bent by the change of the proceeding direction. Thus, the height difference between the top and the bottom of each curve of the corrugated sheet 206, that is, amplitude of the corrugation, may be slightly reduced.

When the reverse roller pair 350 nip the leading edge of the sheet 206, the reversible roller pair 330 may nip the trailing edge of the sheet 206. In this state, the sheet 206 may be stretched along the conveying direction 217 between the reversible roller pair 330 and the reverse roller pair 350 and the upper surface of the sheet 206 may be made contact with the projecting portion 363.

When the reverse roller pair 350 may convey the sheet 206 further along the conveying direction 217 under this condition, the upper surface of the sheet 206 may be drawn by the projecting portion 363. Therefore, the amplitude of the corrugation in the sheet 206 may be further reduced. That is, the corrugated sheet 206 may become the substantially flat by removing the corrugated pattern by the projecting portion 363.

Then, the sheet 206 may reach the second junction 225 in the first conveying path 231 via the second conveying path 223 and proceed to the curved section 232 of the first conveying path 231 again while the sheet 206 may be turned upside down, that is, a second surface of the sheet 206 may face the recording head 246. Then, the conveyor roller pair 234 may again nip the sheet 206 and convey the sheet 206 onto the platen 250. As described above, the corrugated pattern has been removed from the sheet 206. Therefore, the conveyor roller pair 234 may nip the sheet 206 smoothly. The inkjet recording apparatus 210 may record an image on the second surface of the sheet 206 on the platen 250 in a similar manner described above. After that, the discharge roller pair 237 and the reversible roller pair 330 may discharge the sheet 206 onto the sheet discharge tray 229.

The second illustrative embodiment may also provide the same effects that may be provided by the above-described first illustrative embodiment. It may be needless to say that various variations similar to the variations applied to the above-described first illustrative embodiment may be also applied to the second illustrative embodiment.

What is claimed is:

1. An inkjet recording apparatus, comprising:

a recording head including nozzles that eject ink droplets onto a sheet that is conveyed in a conveying direction through a transport path;

a plurality of first conveyors spaced apart from each other with respect to a scanning direction orthogonal to the conveying direction, and wherein the plurality of first conveyors includes a first nip member and a second nip member defining a first nip point therebetween, and wherein the first nip point of the plurality of first conveyors located downstream of the nozzles with respect to the conveying direction;

a first spur roller disposed between a pair of the first conveyors with respect to the scanning direction, and wherein a lower end of the first spur roller is located downstream of the first nip point of the plurality of first conveyors in the conveying direction, and wherein the first spur roller is configured to contact the sheet and form a corrugated shape in the sheet in conjunction with the plurality of first conveyors;

a second spur roller, wherein a lower end of the second spur roller is located downstream of the lower end of the first spur roller in the conveying direction, wherein the second spur roller at least partially overlaps with the first spur roller when viewed in the conveying direction, and wherein the second spur roller is configured to maintain the corrugated shape in the sheet in conjunction with the first spur roller and the plurality of first conveyors; and a plurality of second conveyors spaced apart from each other with respect to the scanning direction, and wherein the plurality of second conveyors includes a first nip member and a second nip member defining a second nip point therebetween, and wherein the second nip point of the plurality of second conveyors is located downstream of the lower end of the second spur roller with respect to the conveying direction.

2. The inkjet recording apparatus according to claim 1, further comprising a guide member including a guide portion disposed between the nozzles and the first nip point of the plurality of first conveyors with respect to the conveying direction, the guide portion configured to guide a downstream edge of the sheet with respect to the conveying direction to the first nip point of the plurality of first conveyors.

3. The inkjet recording apparatus according to claim 2, wherein the guide portion is inclined downwardly along the conveying direction.

4. The inkjet recording apparatus according to claim 2, wherein the guide member is configured to support the first nip member of the plurality of first conveyors and the first spur roller and the second spur roller.

5. The inkjet recording apparatus according to claim 1, wherein the lower end of the first spur roller is located lower than the first nip point of the plurality of first conveyors.

6. The inkjet recording apparatus according to claim 1, wherein the first and second nip members of the first conveyors comprise a first pair of rollers, and wherein the first and second nip members of the second conveyors comprise a second pair of rollers.

7. The inkjet recording apparatus according to claim 1, wherein the inkjet recording apparatus comprises a plurality of first spur rollers, wherein each lower end of the plurality of first spur rollers is located downstream of the first nip point with respect to the conveying direction, and wherein each of the plurality of first spur rollers is disposed between a different respective pair of the plurality of first conveyors with respect to the scanning direction.

8. The inkjet recording apparatus according to claim 1, further comprising a support member disposed downstream of the nozzles with respect to the conveying direction, the support member including a plurality of ribs configured to support the sheet conveyed by the plurality of first conveyors, wherein the plurality of ribs are spaced apart from each other with respect to the scanning direction, and wherein the second spur roller is disposed between a pair of ribs of the plurality of ribs with respect to the scanning direction, and wherein the second spur roller is configured to form a corrugated shape in the sheet in conjunction with the pair of ribs.

9. The inkjet recording apparatus according to claim 8, wherein the lower end of the second spur roller is located lower than upper ends of the pair of ribs.

10. The inkjet recording apparatus according to claim 9, wherein the plurality of ribs extend to respective positions downstream of the lower end of the second spur roller with respect to the conveying direction.

11. The inkjet recording apparatus according to claim 9, wherein the plurality of ribs extend from respective positions upstream of the lower end of the first spur roller with respect to the conveying direction.

12. The inkjet recording apparatus according to claim 8, wherein the inkjet recording apparatus comprises a plurality of second spur rollers, wherein each lower end of the plurality of second spur rollers is located downstream of the lower end of the first spur roller with respect to the conveying direction, and wherein each of the plurality of second spur rollers is disposed between a different respective pair of the plurality of ribs with respect to the scanning direction.

13. The inkjet recording apparatus according to claim 1, further comprises a third spur roller, wherein a lower end of the third spur roller is disposed downstream of the lower end of the second spur roller with respect to the conveying direction, wherein the third spur roller at least partially overlaps with the second spur roller when viewed in the conveying direction, and wherein the lower end of the third spur roller is located lower than the second nip point of the plurality of second conveyors.

* * * * *